US010975661B2

(12) United States Patent
Akkerman

(10) Patent No.: US 10,975,661 B2
(45) Date of Patent: Apr. 13, 2021

(54) TOP-DOWN FRACTURING SYSTEMS AND METHODS

(71) Applicant: ABD TECHNOLOGIES LLC, Houston, TX (US)

(72) Inventor: Neil H. Akkerman, Houston, TX (US)

(73) Assignee: ABD Technologies LLC, Houston, TX (US)

( * ) Notice: Subject to any disclaimer, the term of this patent is extended or adjusted under 35 U.S.C. 154(b) by 289 days.

(21) Appl. No.: 15/946,471

(22) Filed: Apr. 5, 2018

(65) Prior Publication Data

US 2018/0291708 A1 Oct. 11, 2018

Related U.S. Application Data

(60) Provisional application No. 62/481,847, filed on Apr. 5, 2017, provisional application No. 62/545,827, filed on Aug. 15, 2017.

(51) Int. Cl.

| | |
|---|---|
| ***E21B 34/14*** | (2006.01) |
| ***E21B 43/26*** | (2006.01) |
| ***E21B 34/10*** | (2006.01) |

(52) U.S. Cl.

CPC ..... *E21B 34/14* (2013.01); *E21B 34/103* (2013.01); *E21B 43/26* (2013.01); *E21B 2200/06* (2020.05)

(58) Field of Classification Search

CPC ..... E21B 2200/06; E21B 34/142; E21B 34/14
See application file for complete search history.

(56) References Cited

U.S. PATENT DOCUMENTS

| | | | | |
|---|---|---|---|---|
| 3,263,752 | A * | 8/1966 | Conrad | E21B 34/14 166/154 |
| 4,522,259 | A | 6/1985 | Akkerman | |
| 4,628,998 | A | 12/1986 | Akkerman | |
| 5,513,703 | A | 5/1996 | Mills et al. | |
| 6,032,735 | A | 3/2000 | Echols | |
| 6,513,595 | B1 | 2/2003 | Freiheit et al. | |
| 6,755,249 | B2 | 6/2004 | Robison et al. | |
| 6,763,892 | B2 | 7/2004 | Kaszuba | |
| 8,613,321 | B2 | 12/2013 | Ravensbergen et al. | |
| 9,238,953 | B2 * | 1/2016 | Fleming | E21B 21/103 |
| 10,301,927 | B2 * | 5/2019 | Sallwasser | E21B 34/14 |
| 2006/0124310 | A1 * | 6/2006 | Lopez de Cardenas | E21B 43/08 166/313 |
| 2009/0056934 | A1 * | 3/2009 | Xu | E21B 43/26 166/244.1 |
| 2009/0084553 | A1 | 4/2009 | Rytlewski et al. | |
| 2009/0308588 | A1 | 12/2009 | Howell et al. | |
| 2010/0089587 | A1 | 4/2010 | Stout | |

(Continued)

*Primary Examiner* — Steven A MacDonald
(74) *Attorney, Agent, or Firm* — Conley Rose, P.C.

(57) ABSTRACT

A flow transported obturating tool for actuating a valve in a wellbore includes a housing including a radially translatable engagement assembly, and a core slidably disposed in the housing, wherein the engagement assembly is configured to shift the valve from a first closed position to an open position when the core is in a first position relative to the housing, and wherein the engagement assembly is configured to shift the valve from the open position to a second closed position in response to the core being displaced from the first position to a second position that is spaced from the first position in a first axial direction.

24 Claims, 52 Drawing Sheets

(56) References Cited

U.S. PATENT DOCUMENTS

| | | | | |
|---|---|---|---|---|
| 2013/0112435 | A1* | 5/2013 | Fleming | E21B 23/006 166/386 |
| 2013/0206402 | A1* | 8/2013 | Coon | E21B 43/14 166/255.1 |
| 2014/0076542 | A1* | 3/2014 | Whitsitt | E21B 34/14 166/250.1 |
| 2015/0218904 | A1* | 8/2015 | Chauffe | E21B 33/128 166/250.01 |
| 2015/0226034 | A1* | 8/2015 | Jani | E21B 34/16 166/297 |
| 2016/0108722 | A1* | 4/2016 | Whitsitt | E21B 34/14 166/254.1 |
| 2016/0251923 | A1* | 9/2016 | Keerthivasan | E21B 34/063 166/383 |
| 2016/0265302 | A1* | 9/2016 | Acosta | E21B 33/1295 |
| 2016/0362957 | A1* | 12/2016 | Barbato | E21B 34/14 |
| 2017/0030168 | A1* | 2/2017 | Akkerman | E21B 17/22 |
| 2017/0122068 | A1* | 5/2017 | Graf | E21B 23/10 |
| 2017/0175488 | A1* | 6/2017 | Lisowski | E21B 43/267 |
| 2018/0291708 | A1* | 10/2018 | Akkerman | E21B 34/103 |

* cited by examiner

TOP-DOWN FRACTURING SYSTEMS AND METHODS

CROSS-REFERENCE TO RELATED APPLICATIONS

This application claims benefit of U.S. provisional patent application Ser. No. 62/481,847 filed Apr. 5, 2017, and entitled "Top-Down Fracturing Systems and Methods," and U.S. provisional patent application Ser. No. 62/545,827 filed Aug. 15, 2017, and entitled "Top-Down Fracturing Systems and Methods," each of which is hereby incorporated herein by reference in its entirety.

STATEMENT REGARDING FEDERALLY SPONSORED RESEARCH OR DEVELOPMENT

Not applicable.

BACKGROUND

This disclosure relates generally to well servicing and completion systems for the production of hydrocarbons. More particularly, the disclosure relates to actuatable downhole tools including slideable sleeves for providing selectable access to open (uncased) and cased wellbores during completion, wellbore servicing, and production operations, such as hydraulically fracturing open and cased wellbores and perforating cased wellbores. The disclosure also relates to tools for selectively actuating slideable sleeves of downhole tools for providing selectable access to open and cased wellbores in wellbore servicing and production operations. Further, the disclosure regards tools for hydraulically fracturing a subterranean formation from multiple zones of a wellbore extending through the formation. The disclosure also relates to tools for selectably perforating components of a well string in preparation for hydraulically fracturing a subterranean formation.

Hydraulic fracturing and stimulation may improve the flow of hydrocarbons from one or more production zones of a wellbore extending into a subterranean formation. Particularly, formation stimulation techniques such as hydraulic fracturing may be used with deviated or horizontal wellbores that provide additional exposure to hydrocarbon bearing formations, such as shale formations. The horizontal wellbore includes a vertical section extending from the surface to a "heel" where the wellbore transitions to a horizontal or deviated section that extends horizontally through a hydrocarbon bearing formation, terminating at a "toe" of the horizontal section of the wellbore.

An array of completion strategies and systems that incorporate hydraulic fracturing operations have been developed to economically enhance production from subterranean formations. In particular, a "plug and perf" completion strategy has been developed that includes pumping a bridge plug tethered through a wellbore (typically having a cemented liner) along with one or more perforating tools to a desired zone near the toe of the wellbore. The plug is set and the zone is perforated using the perforating tools. Subsequently, the tools are removed and high pressure fracturing fluids are pumped into the wellbore and directed against the formation by the set plug to hydraulically fracture the formation at the selected zone through the completed perforations. The process may then be repeated moving in the direction of the heel of the horizontal section of the wellbore (i.e., moving "bottom-up"). Thus, although plug and perf operations provide for enhanced flow control into the wellbore and the creation of a large number of discrete production zones, extensive time and a high volume of fluid is required to pump down and retrieve the various tools required to perform the operation.

Another completion strategy incorporating hydraulic fracturing includes ball-actuated sliding sleeves (also known as "frac sleeves") and isolation packers run inside of a liner or in an open hole wellbore. Particularly, this system includes ported sliding sleeves installed in the wellbore between isolation packers on a single well string. The isolation packers seal against the inner surface of the wellbore to segregate the horizontal section of the wellbore into a plurality of discrete production zones, with one or more sliding sleeves disposed in each production zone. A ball is pumped into the well string from the surface until it seats within the sliding sleeve nearest the toe of the horizontal section of the wellbore. Hydraulic pressure acting against the ball causes hydraulic pressure to build behind the seated ball, causing the sliding sleeve to shift into an open position to hydraulically fracture the formation at the production zone of the actuated sliding sleeve via the high pressure fluid pumped into the well string.

The process may be subsequently repeated moving towards the heel of the horizontal section of the wellbore (i.e., moving "bottom-up") using progressively larger-sized balls to actuate the remaining sliding sleeves nearer the heel of the horizontal section of the wellbore. The balls and ball seats of the sliding sleeves may be drilled out using coiled tubing. The use of sliding sleeves and isolation packers disposed along a well string may streamline the hydraulic fracturing operation compared with the plug-and-perf system, but the use of varying size balls and ball seats to actuate the plurality of sliding sleeves may limit the total number of production zones while restricting the flow of fluid to the formation during fracturing, necessitating the use of high pressure and low viscosity fluids to provide adequate flow rates to the formation. Moreover, the use of multiple balls of varying sizes may also complicate the fracturing operation and increase the possibility of issues in performing the operation, such as balls getting stuck during pumping and failing to successfully actuate their intended sliding sleeve.

SUMMARY OF THE DISCLOSURE

An embodiment of a valve for use in a wellbore comprises a housing comprising a housing port, a slidable closure member disposed in a bore of the housing and comprising a closure member port, a seal disposed in the housing, and a detent disposed radially between the closure member and the housing, wherein the closure member comprises a first position in the housing where fluid communication is provided between the closure member port and the housing port, and a second position axially spaced from the first position where fluid communication between the closure member port and the housing port is restricted, wherein, in response to actuating the closure member from the first position to the second position, the closure member is configured to elastically deform the detent. In some embodiments, the detent comprises a shoulder of a locating ring disposed radially between the closure member and the housing. In some embodiments, an outer surface of the closure member comprises an annular locator defined by a pair of frustoconical shoulders, and in response to actuating the closure member from the first position to the second position, the locating ring is forced to radially expand and pass over one of the frustoconical shoulders of the closure member. In certain embodiments, an inner surface of the housing comprises an annular locator defined by a pair of frustoconical shoulders, and in response to actuating the closure member between the first position and the second position, the locating ring is forced to radially contract and pass over one of the frustoconical shoulders of the closure member. In certain embodiments, the locating ring extends entirely about the closure member. In some embodiments, the closure member comprises a third position axially spaced from the first position and the second position where fluid communication between the closure member port and the housing port is restricted, and the valve further comprises a retainer ring permits the closure member to enter the third position when the retainer ring is in a first position and restricts the closure member from entering the third position when in a second position.

An embodiment of a valve for use in a wellbore comprises a housing comprising a housing port, a slidable closure member disposed in a bore of the housing and comprising a closure member port, a seal disposed in the housing, a retainer ring disposed in the housing, and wherein the closure member comprises a first position in the housing where fluid communication is provided between the closure member port and the housing port, a second position axially spaced from the first position where fluid communication between the closure member port and the housing port is restricted, and a third position axially spaced from the first position and the second position where fluid communication between the closure member port and the housing port is restricted, wherein the retainer ring permits the closure member to enter the third position when the retainer ring is in a first position and restricts the closure member from entering the third position when in a second position. In some embodiments, the first position of the retainer ring comprises a radially outer position and the second position of the retainer ring comprises a radially inner position. In some embodiments, the retainer ring comprises a shear pin that is received in a groove formed in the closure member when the closure member is disposed in the third position. In certain embodiments, the valve further comprises a fluid damper disposed in the housing, wherein the fluid damper comprises a flow restriction through which fluid is forced in response to the closure member being displaced between the first and second positions. In certain embodiments, the fluid damper comprises a cylindrical dampening member slidably disposed in a receptacle formed in the housing. In some embodiments, the fluid damper comprises a port extending through an annular flange of the closure member. In some embodiments, the valve further comprises a detent disposed radially between the closure member and the housing, wherein, in response to actuating the closure member from the first position to the second position, the closure member is configured to elastically deform the detent, wherein the detent comprises a shoulder of a locating ring disposed radially between the closure member and the housing, and wherein the locating ring extends entirely about the closure member.

An embodiment of a flow transported obturating tool for actuating a valve in a wellbore comprises a housing comprising a radially translatable engagement assembly, and a core slidably disposed in the housing, wherein the engagement assembly is configured to shift the valve from a first closed position to an open position when the core is in a first position relative to the housing, wherein the engagement assembly is configured to shift the valve from the open position to a second closed position in response to the core being displaced from the first position to a second position that is spaced from the first position in a first axial direction. In some embodiments, the engagement assembly comprises a first engagement member comprising an unlocked position and a locked position, and a second engagement member, axially spaced from the first engagement member, comprising an unlocked position and a locked position. In some embodiments, the first engagement member is disposed in a receptacle formed in the housing and comprises an arcuate slot that receives a lip of the housing to prevent the first engagement member from escaping the receptacle, and engagement between the lip of the housing and the arcuate slot of the first engagement member prevents the first engagement member from rotating in the receptacle of the housing. In certain embodiments, the first engagement member comprises a compound key that comprises a first shoulder and a second shoulder that is radially translatable relative to the first shoulder. In certain embodiments, the obturating tool further comprises an actuation assembly disposed in the housing and configured to permit the core to displace from the first position to the second position in response to sensing a predetermined pressure differential between first and second ends of the obturating tool, and a floating piston slidably disposed between the core and the housing, wherein the floating piston forms a first chamber in the housing in fluid communication with the surrounding environment and a second chamber in the housing sealed from the surrounding environment, and wherein the actuation assembly is disposed in the second chamber, wherein the floating piston is configured to equalize fluid pressure between the first chamber and the second chamber. In some embodiments, the obturating tool further comprises a filter coupled to the housing and configured to permit fluid communication between the housing and the surrounding environment, wherein the filter comprises a plurality of stacked washers, wherein a first end of each washer includes a notch providing an axially extending gap between each washer.

An embodiment of a flow transported obturating tool for actuating a valve in a wellbore comprises a housing comprising a first engagement member comprising an unlocked position and a locked position, and a second engagement member, axially spaced from the first engagement member, comprising an unlocked position and a locked position, and a core slidably disposed in the housing, wherein, when the first engagement member is in the locked position, the first engagement member is configured to shift the valve from an open position to a closed position, wherein, when the second engagement member is in the locked position, the second engagement member is configured to land against a landing shoulder of the valve to prevent the obturating tool from passing through the valve, wherein the core is configured to actuate the first engagement member from the locked position to the unlocked position in response to displacing the core relative to the housing in a first axial direction between a first position and a second position, wherein the core is configured to actuate the second engagement member from the locked position to the unlocked position in response to displacing the core relative to the housing in the first axial direction between the second position and a third position. In some embodiments, the first engagement member is slidably received in a receptacle formed in the housing, and the first engagement member comprises an annular seal disposed on an outer surface of the first engagement member, and wherein the annular seal sealingly engages an inner surface of the receptacle to restrict fluid flow through the receptacle. In some embodiments, the first engagement member comprises a compound key that comprises a first shoulder and a second shoulder that is radially translatable relative to the first shoulder, and the compound key further comprises a biasing member that biases the second shoulder into a radially outer position. In certain embodiments, the obturating tool further comprises an annular seal assembly disposed in a groove formed in the housing, wherein the seal assembly comprises a metallic piston ring and an annular elastomeric seal having an L-shaped cross-sectional profile. In certain embodiments, the obturating tool further comprises an actuation assembly disposed in the housing and configured to permit the core to displace from the first position to the second position in response to sensing a predetermined pressure differential between first and second ends of the obturating tool. In some embodiments, the actuation assembly comprises a valve body that includes a first passage configured to receive fluid pressure acting against the first end of the obturating tool, the obturating tool further comprises a fluid damper positioned upstream of the first passage of the valve body in a passage formed in the core, and wherein the fluid damper is configured to provide to a flow restriction in the passage of the core.

An embodiment of a flow transported obturating tool for actuating a valve in a wellbore comprises a housing comprising a first engagement member comprising an unlocked position and a locked position, and a second engagement member comprising an unlocked position and a locked position, a core slidably disposed in the housing and configured to actuate the first engagement member from the locked position to the unlocked position in response to displacing the core from a first position to a second position in the housing, and an actuation assembly disposed in the housing and comprising a first valve assembly configured to permit the core to displace from the first position to the second position in response to sensing a first pressure differential between first and second ends of the obturating tool, wherein the core is configured to actuate the second engagement member from the locked position to the unlocked position in response to displacing the core from the second position to a third position in the housing, wherein the actuation assembly comprises a first valve assembly configured to permit the core to displace from the first position to the second position in response to sensing a second differential between the first and second ends of the obturating tool. In some embodiments, the second pressure differential is less than the first pressure differential. In some embodiments, the obturating tool further comprises a floating piston slidably disposed between the core and the housing, wherein the floating piston forms a first chamber in the housing in fluid communication with the surrounding environment and a second chamber in the housing sealed from the surrounding environment, wherein the floating piston is configured to equalize fluid pressure between the first chamber and the second chamber. In some embodiments, the obturating tool further comprises a filter coupled to the housing and configured to permit fluid communication between the housing and the surrounding environment, wherein the filter comprises a plurality of stacked washers, wherein a first end of each washer includes a notch providing an axially extending gap between each washer, wherein the notch of each washer is configured to permit particulates of a predetermined size to enter the housing from the surrounding environment. In certain embodiments, both the first valve assembly and the second valve assembly of the actuation assembly comprise a housing, a piston slidably received in the housing, and a check valve assembly received in a valve body of the actuation assembly, wherein the valve body of the actuation assembly includes a first passage configured to receive fluid pressure acting against the first end of the obturating tool and a second passage configured to receive fluid pressure acting against the second end of the obturating tool.

BRIEF DESCRIPTION OF THE DRAWINGS

For a more detailed description of embodiments of the invention, reference will now be made to the accompanying drawings, wherein.

DETAILED DESCRIPTION

Figure 1:
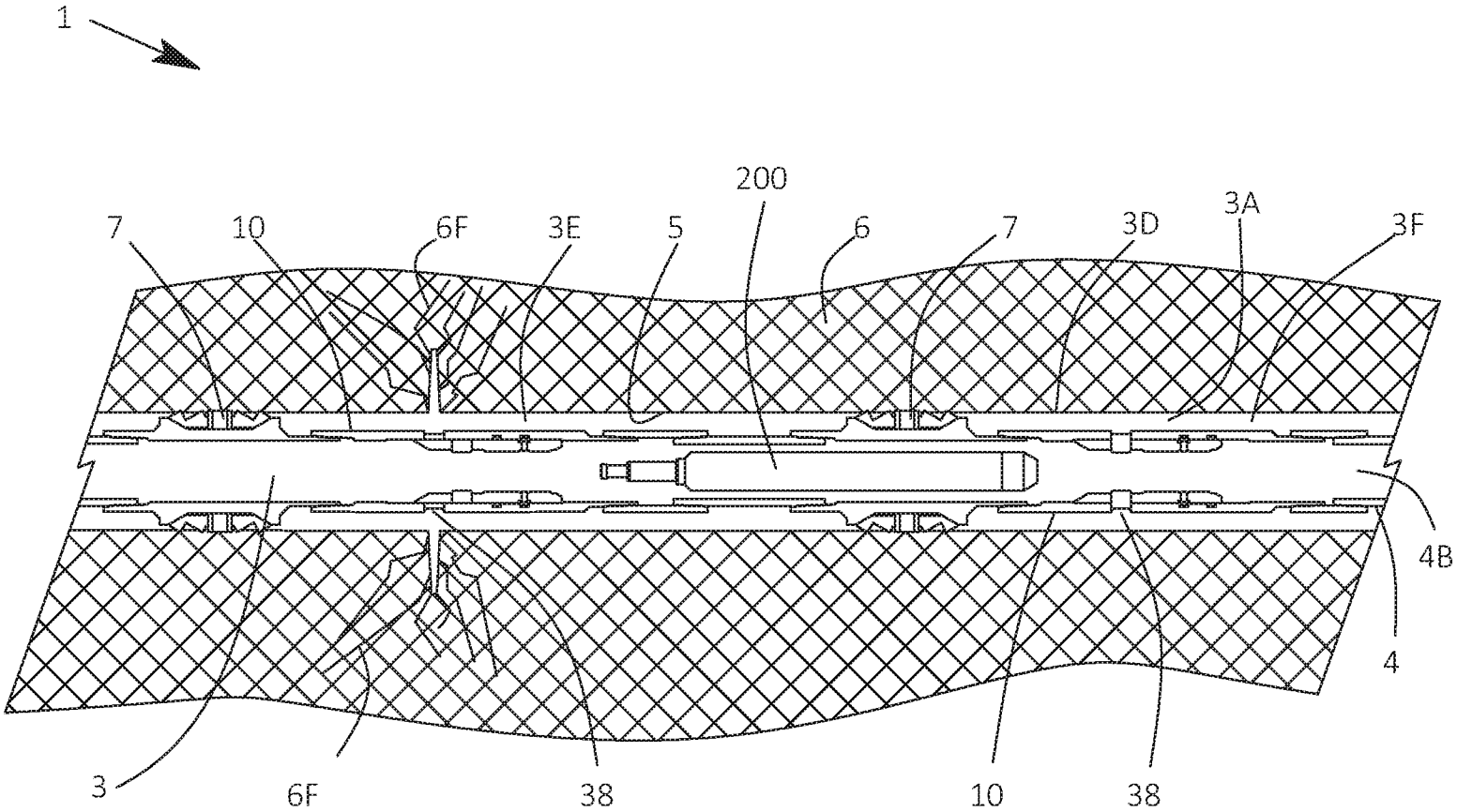
FIG. 1 is a schematic view of an embodiment of a well system in accordance with principles disclosed herein.

The following description is exemplary of embodiments of the disclosure. These embodiments are not to be interpreted or otherwise used as limiting the scope of the disclosure, including the claims. One skilled in the art will understand that the following description has broad application, and the discussion of any embodiment is meant only to be exemplary of that embodiment, and is not intended to suggest in any way that the scope of the disclosure, including the claims, is limited to that embodiment. The drawing figures are not necessarily to scale. Certain features and components disclosed herein may be shown exaggerated in scale or in somewhat schematic form, and some details of conventional elements may not be shown in the interest of clarity and conciseness. In some of the figures, one or more components or aspects of a component may be not displayed or may not have reference numerals identifying the features or components that are identified elsewhere in order to improve clarity and conciseness of the figure.

The terms "including" and "comprising" are used herein, including in the claims, in an open-ended fashion, and thus should be interpreted to mean "including, but not limited to . . . ." Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. If the connection transfers electrical power or signals, the coupling may be through wires or through one or more modes of wireless electromagnetic transmission, for example, radio frequency, microwave, optical, or another mode. In addition, as used herein, the terms "axial" and "axially" generally mean along or parallel to a given axis (e.g., central axis of a body or a port), while the terms "radial" and "radially" generally mean perpendicular to the axis. For instance, an axial distance refers to a distance measured along or parallel to the axis, and a radial distance means a distance measured perpendicular to the axis.

Referring to FIG. 1, an embodiment of a well system 1 is schematically illustrated. Well system 1 generally includes a wellbore 3 extending through a subterranean formation 6, where the wellbore 3 includes a generally cylindrical inner surface 5, a vertical section extending from the surface (not shown) and a deviated section 3D extending horizontally through the formation 6. The deviated section 3D of wellbore 3 extends from a heel (not shown) disposed at the lower end of vertical section and a toe (not shown) disposed at a terminal end of wellbore 3. In the embodiment of well system 1, the wellbore 3 is an open hole wellbore, and thus, the inner surface 5 of wellbore 3 is not lined with a cemented casing or liner, allowing for fluid communication between formation 6 and wellbore 3.

Well system 1 also includes a well string 4 disposed in wellbore 3 having a bore 4B extending therethrough, forming an annulus 3A in wellbore 3 between the inner surface 5 of wellbore 3 and an outer surface of well string 4. Well string 4 includes a plurality of isolation packers 7 and sliding sleeve valves 10. Specifically, each sliding sleeve 10 of well string 4 is disposed between a pair of isolation packers 7. Each isolation packer 7 is configured to seal against the inner surface 5 of the wellbore 3, forming discrete production zones 3E and 3F in wellbore 3, where fluid communication between production zones 3E and 3F is restricted. Although not shown in FIG. 1, well string 4 includes additional isolation packers 7, sliding sleeve valves 10, and discrete production zones extending to the toe of the deviated section 3D of the wellbore 3. As will be described further herein, sliding sleeve valves 10 are configured to provide selectable fluid communication to the wellbore 3 via a plurality of circumferentially spaced ports 38 in response to actuation from an actuation or obturating tool.

As will be discussed further herein, each sliding sleeve valve 10 in the embodiment of FIG. 1 includes an upper-closed position, an open position, and a lower-closed position. Well system 1 includes an obturating tool 200 configured to actuate each sliding sleeve valve 10 between the upper-closed, open, and lower-closed positions. Although in the embodiment of FIG. 1 sliding sleeve valves 10 include three positions, in other embodiments, the valves 10 of well system 1 may include two position valves. In the embodiment of FIG. 1, each sliding sleeve valve 10 is disposed in the upper-closed position prior to the insertion of obturating tool 200 into the bore 4B of well string 4. FIG. 1 illustrates well system 1 following the production of fractures 6F in formation 6 at production zone 3E via obturating tool 200. FIG. 1 also illustrates the sliding sleeve valve 10 of production zone 3E actuated into the lower-closed position by obturating tool 200, with the obturating tool 200 being displaced from the sliding sleeve valve 10 of production zone 3E towards the sliding sleeve valve 10 of production zone 3F, which is disposed in the upper-closed position. In this manner, the formation 6 at production zone 3F may be hydraulically fractured, and each production zone proceeding towards the toe of wellbore 3 may be successively fractured. Once the formation 6 at each production zone (e.g., production zones 3E, 3F, etc.) has been hydraulically fractured using obturating tool 200, and the obturating tool 200 is disposed proximal the toe of wellbore 3, where obturating tool 200 may be fished and removed from the well string 4.

Referring to FIGS. 2A-5, an embodiment of a sliding sleeve valve 10 is illustrated. Lockable sliding sleeve valve 10 is generally configured to provide selectable fluid communication to a desired portion of a wellbore. For instance, in a hydraulic fracturing operation a plurality of sliding sleeve valves 10 may be incorporated into a completion string disposed in an open hole wellbore, where one or more sliding sleeve valves 10 are isolated via a plurality set packers in a series of discrete production zones. In this arrangement, sliding sleeve valve 10 is configured to provide selective fluid communication with a chosen production zone of the wellbore, thereby allowing the chosen production zone to be individually hydraulically fractured or produced.

In the embodiment of FIGS. 2A-5, sliding sleeve valve 10 has a central or longitudinal axis 15 and includes a housing 12, a sliding sleeve or carrier member 50, and a seal assembly 80. Tubular housing 12 includes a first or upper box end 14, a second or lower pin end 16, a central bore or passage 18 extending between first end 14 and second end 16 that is defined by a generally cylindrical inner surface 20, and a generally cylindrical outer surface 22 extending between ends 14 and 16. In the embodiment of FIGS. 2A-5, housing 12 is made up of a series of segments including a first or upper segment 12A and a second or lower segment 12B releasably coupled to upper segment 12A via a threaded coupler or joint 24. In the embodiment of FIGS. 2A-5, coupler 24 comprises a premium connection that restricts fluid communication thereacross; however, in other embodiments, housing 12 may include an annular seal disposed between upper segment 12A and lower segment 12B to seal the connection formed therebetween.

In the embodiment of FIGS. 2A-5, the inner surface 20 of housing 12 includes an annular first or upper shoulder 26, and a reduced diameter section or seal bore 28. Seal bore 28 forms an annular second or intermediate shoulder 30 at an upper end thereof and an annular third or lower shoulder 32 at a lower end thereof. The inner surface 20 of housing 12 additionally includes an annular groove 33 formed therein and located axially directly adjacent upper shoulder 26, and a plurality of circumferentially spaced receptacles 34 that extend axially into the lower segment 12B of housing 12 from a first or upper end 36 thereof. In the embodiment shown in FIGS. 2A-5, housing 12 includes a plurality of circumferentially spaced ports 38, where each port 38 extends radially between inner surface 20 and outer surface 22. Each port 38 is defined by a generally cylindrical inner surface 40 that includes an annular shoulder 42 formed therein.

In the embodiment of FIGS. 2A-5, carrier 50 of sliding sleeve valve 10 has a first or upper end 50A, a second or lower end 50B, a central bore or passage 52 defined by a generally cylindrical inner surface 54, and a generally cylindrical outer surface 56. Carrier 50 includes a plurality of circumferentially spaced ports 58, with each port 58 extending radially between the inner surface 54 and outer surface 56. In the embodiment of FIGS. 2A-5, carrier 50 includes a plurality of circumferentially spaced annular seals 60 disposed in outer surface 56. Particularly, each seal 60 is disposed about or encircles a corresponding port 58 of carrier 50; however, in other embodiments, carrier 50 may not include seals 60. In the embodiment of FIGS. 2A-5, the inner surface 54 of carrier 50 includes an annular first or upper shoulder 62 and an annular second or lower shoulder 64 disposed directly adjacent upper shoulder 62. Additionally, the outer surface 56 of carrier 50 includes an annular groove 66 formed therein that is located proximal upper end 50A, and a plurality of circumferentially spaced, elongate slots 68. As shown particularly in FIG. 4, each elongate slot 68 comprises a planar or flat surface.

The outer surface 56 of carrier 50 further includes an annular shoulder 70 and a plurality of circumferentially spaced elongate dampening members 72. In the embodiment of FIGS. 2A-5, each dampening member 72 has a first or upper end that physically engages or is disposed directly adjacent shoulder 70 of carrier 50 and a second or lower end received in a corresponding receptacle 34. Although the outer surface of each dampening member 72 is not in sealing engagement with the inner surface of a corresponding receptacle 34, a fluid restriction is formed between said surfaces such that dampening members 72 are configured to provide a resistive or dampening force against carrier 50 (via engagement with shoulder 70 of carrier 50) in response to relative axial movement between carrier 50 and housing 12. Particularly, relative axial movement of carrier 50 towards lower end 16 of housing 12 forces fluid trapped in receptacles 34 is extruded therefrom via the interface formed between the outer surface of each dampening member 70 and the inner surface of each corresponding receptacle 34. In the embodiment of FIGS. 2A-5, the outer surface 56 of carrier 50 additionally includes an annular seal 74 disposed therein located proximal lower end 50B of carrier 50.

Seal assembly 80 is configured to provide selective fluid communication between the bore 18 of housing 12 and wellbore 3 depending upon the relative axial position of carrier 50 and housing 12. Each seal assembly 80 generally includes a plurality of circumferentially spaced first sealing members or buttons 82, and a plurality of circumferentially spaced second sealing or planar members 100. Each button 82 is generally cylindrical and had a central or longitudinal axis disposed orthogonal central axis 15. Each button 82 has a central bore or passage 84 extending between a first or outer end and a second or inner end 86, where inner end 86 comprises a first sealing surface 86. Additionally, each button 82 comprises an outer surface that includes an annular shoulder 88, where annular shoulder 88 receives a biasing member 90 therein. In some embodiments, biasing members 90 of buttons 82 comprise wave springs. Further, the outer surface of each button 82 includes an annular seal 92, such as a T-seal, disposed therein and located proximal the outer end of button 82. The seal 92 of each button 82 sealingly engages the inner surface 40 of a corresponding port 38 of housing 12 in which the button 82 is received. Although the embodiment of buttons 82 of FIGS. 2A-5 includes seals 92, in other embodiments, buttons 82 may not include seals 92.

In the embodiment of FIGS. 2A-5, planar members 100 each extend axially relative central axis 15 and include an outer or second sealing surface 102 and a central port or passage 104 extending radially therethrough, where port 104 of each planar member 100 is axially and angularly aligned with a corresponding port 58 of carrier 50, thereby providing fluid communication therebetween. Each planar member 100 is received in a corresponding slot 68 of carrier 50. In the embodiment of FIGS. 2A-5, the axial length of each planar member 100 is less than the axial length of the corresponding slot 68 of carrier 50, providing for a limited amount of relative axial movement between planar member 100 and carrier 50; however, in other embodiments, relative axial movement between planar members 100 and carrier 50 may be restricted.

In the embodiment of FIGS. 2A-5, a metal-to-metal seal is formed between the first sealing surface 86 of each button 82 and the second sealing surface 102 of a corresponding planar member 100. In some embodiments, buttons 82 and planar members 100 of seal assembly 80 are formed from or comprise a hardened material, such as beryllium copper; however, in other embodiments, buttons 82 and planar members 100 may be formed from a variety of materials. In the configuration shown in FIGS. 2A-5, biasing members 90 act against the outer shoulder 42 of each port 38 to bias buttons 82 into sealing engagement with planar members 100. Thus, sealing engagement may be maintained between sealing surfaces 86 and 102 in the event of buttons 82 or planar members 100 being exposed to a pressure differential or other force acting against the contact formed between first and second sealing surfaces 86 and 102. In some embodiments, an annular seal may be disposed about the central bore 84 of each button 82 in the inner end 86 to sealingly engage the sealing surface 102 of a corresponding planar member 100.

In the embodiment of FIGS. 2A-5, sliding sleeve valve 10 additionally includes an annular retainer ring 110 disposed in groove 33 of housing 12. Retainer ring 110 includes a radially inwards extending shearable member or shear pin 112 that is received in groove 66 of carrier 50. In the embodiment of FIGS. 2A-5, retainer ring 110 comprises a biased retainer ring 110 that is inwardly biased towards central axis 15. As shown particularly in FIG. 3, in the embodiment of FIGS. 2A-5, retainer ring 114 comprises a C-ring. Although sliding sleeve valve 10 is shown as including retainer ring 110 in FIGS. 2A-5, in some embodiments, sliding sleeve valve 10 may not include retainer ring 110. For instance, in some embodiments, sliding sleeve valve 10 may rely on other mechanisms, as will be described further herein, for retaining sliding sleeve valve 10 in its various positions.

In the embodiment of FIGS. 2A-5, sliding sleeve valve 10 comprises a three-position valve, as described above with respect to FIG. 1. In FIGS. 2A-5 sliding sleeve valve 10 is shown in the upper-closed position with buttons 82 in sealing engagement with planar members 100 to thereby restrict fluid communication between bore 18 of housing 12 with the surrounding environment (i.e., annulus 3A of the wellbore 3 shown in FIG. 1). Via engagement between shear pin 112 and the surfaces defining groove 66 of carrier 50, retainer ring 110 is configured to retain sliding sleeve 10 in the upper-closed position until a threshold axially downwards directed (i.e., in the direction of lower end 16 of housing 12) force is applied to carrier 50 sufficient to shear the shear pin 112 and overcome the friction between sealing surfaces 86 and 102 of buttons 82 and planar members 100, respectively. In the open position of sliding sleeve valve 10, ports 58 of carrier 50 axially align with bores 84 of buttons 82 to permit fluid communication therebetween, and in-turn, between bore 18 of housing 12 and the surrounding environment. In the lower-closed position of sliding sleeve valve 10, the lower end 50B of carrier 50 is disposed directly adjacent or physically engages intermediate shoulder 30 of housing 12, positioning ports 58 of carrier 50 in sufficient axial misalignment with bores 84 of buttons 82 to restrict fluid communication therebetween via sealing engagement between sealing surfaces 86 and 102.

Referring to FIGS. 6A-22B, an embodiment of an untethered, flow transported obturating tool 200 of well system 1, where obturating tool 200 is configured to actuate the sliding sleeve valve 10 shown in FIGS. 2A-5 between the upper-closed, open, and lower-closed positions. For clarity, FIGS. 6A-6D show a first side cross-sectional view of obturating tool 200 while FIGS. 7A-7D show a second side cross-sectional view of obturating tool 200 that is rotated 90° from the view shown in FIGS. 6A-6D. Obturating tool 200 can be disposed in the bore 4B of well string 4 at the surface of wellbore 3 and pumped downwards through wellbore 3 towards the heel of wellbore 3, where obturating tool 200 can selectively actuate one or more sliding sleeve valves 10 moving from the heel of wellbore 3 to the toe of wellbore 3. In the embodiment shown in FIG. 6A, obturating tool 200 has a central or longitudinal axis and generally includes a generally tubular housing 202, a core or cam 300 disposed therein, and an actuation assembly 400 configured to control the actuation of core 300 within housing 202.

Housing 202 of obturating tool 200 includes a first or upper end 204, a second or lower end 206, a central bore or passage 208 extending between ends 204 and 206 defined by a generally cylindrical inner surface 210, and a generally cylindrical outer surface 212 extending between ends 204 and 206. Housing 202 is made up of a series of segments including a first or upper segment 202A, intermediate segments 202B and 202C, and a lower segment 202D, where segments 202A-202D are releasably coupled together via releasable connections or threaded couplers 214.

In the embodiment of FIGS. 6A-22B, upper segment 202A of housing 202 includes an annular wiper 216 at upper end 204, and an annular first or upper screen or filter 218 disposed in outer surface 212 proximal upper end 204. Wiper 216 is configured to wipe or clean an outer cylindrical surface 306 of core 300 in response to relative axial movement between core 300 and housing 202, where core 300 is slidably disposed in bore 208 of housing 202. Upper filter 218 is configured to filter particulates of a predetermined size from entering bore 208 of housing 202 from the surrounding environment (e.g., from the bore 4B of well string 4) while permitting fluid communication between bore 208 and the surrounding environment via a port 220 formed in housing 202. In the embodiment of FIGS. 6A-22B, upper filter 218 comprises a wire-wrapped screen; however, in other embodiments, upper filter 218 may comprise other mechanisms for filtering particulate matter.

Housing 202 includes a plurality of circumferentially spaced first or upper slots 222, a plurality of circumferentially spaced second or intermediate slots 224, a plurality of circumferentially spaced third or intermediate slots 226, and a plurality of circumferentially spaced fourth or lower slots 228. Upper slots 222 of housing 202 each receive a corresponding compound key or engagement member 230 therein, where each compound key 230 is radially translatable within its respective upper slot 222 between a radially retracted position and a radially expanded position (shown in FIG. 6A) respective housing 202. Compound key 230 includes an arcuate upper shoulder 232 and a retractable pin or lower shoulder 234 that is disposed within a slot extending through compound key 230. Particularly, lower shoulder 234 extends axially at an angle from the longitudinal axis of obturating tool 200 and is radially translatable within its respective slot between a radially retracted position and a radially expanded position (shown in FIG. 6A) respective compound key 230. The lower shoulder 234 of each compound key 230 is biased into the radially expanded position by a biasing member 236 received within the corresponding slot of the compound key 230. Additionally, each compound key 230 includes an annular seal 238 that sealingly engages an inner surface of the corresponding upper slot 222 and a pair of retainers 240 (shown in FIG. 8) that couple compound keys 230 with housing 202. Similarly, lower shoulder 234 also includes a retainer 234R (shown in FIG. 8) to couple lower shoulder 234 with upper shoulder 232 and an annular seal 242 that sealingly engages an inner surface formed in the slot of compound key 230.

In the embodiment of FIGS. 6A-22B, each intermediate slot 224 of housing 202 receives an intermediate radially translatable member or key 244, each intermediate slot 226 receives a radially translatable bore sensor 250, and each lower slot 228 receives a lower radially translatable member or key 254. Each intermediate key 244 includes an annular seal 246 that sealingly engages an inner surface of the corresponding intermediate slot 224 and a retainer 248 that couples the intermediate key 244 with housing 202. Additionally, each bore sensor 250 includes an annular seal 252 that sealingly engages an inner surface of the corresponding intermediate slot 226 and a flanged lower end to prevent bore sensors 250 from falling out of housing 202. Further, each lower key 254 includes an annular seal 256 that sealingly engages an inner surface of the corresponding lower slot 228 and a retainer 258 that couples the lower key 254 with housing 202.

Section 202B of the housing 202 of obturating tool 200 includes a plurality of stacked piston rings 260 configured to sealingly engage against a seal bore, such as seal bore 28 of sliding sleeve valve 10, by forming a metal-to-metal seal therebetween. In some embodiments, piston rings 260 comprise brass, beryllium copper, alloy steel, plastics, elastomers, etc.; however, in other embodiments, piston rings 260 may comprise various materials. Section 202B of housing 202 additionally includes an annular second or lower screen or filter 262 disposed in outer surface 212. Lower filter 262 is configured to filter particulates of a predetermined size from entering bore 208 of housing 202 from the surrounding environment (e.g., from the bore 4B of well string 4) while permitting fluid communication between bore 208 and the surrounding environment via a port 264 formed in housing 202. In the embodiment of FIGS. 6A-22B, lower filter 262 comprises a wire-wrapped screen; however, in other embodiments, lower filter 262 may comprise other mechanisms for filtering particulate matter.

In the embodiment of FIGS. 6A-22B, the lower end of section 202B of housing 202 includes a pair of circumferentially spaced first or long fingers 264 and a pair of circumferentially spaced second or short fingers 266 (shown in FIG. 20), where long fingers 264 and short fingers 266 each extend axially towards lower end 206 of housing 202. Long fingers 264 extend a greater axial distance than short fingers 266, and in the embodiment of FIGS. 6A-22B, long fingers 264 are spared approximately 180° apart while short fingers 266 are spaced less than 180° apart, although, in other embodiments, the circumferential spacing of fingers 264 and 266 may vary. In other embodiments, the number of fingers 264 and 266 may also vary. Additionally, each longer finger 364 includes an arcuately extending shoulder 264S, where shoulders 264S are substantially axially aligned with the terminal ends of short fingers 266. Further, each long finger 264 includes an indexer pin 268 extending radially inwards therefrom, where indexer pin 268 is disposed proximal an outer end of the long finger 264. As will be discussed further herein, indexer pins 268 are configured to interface with a rotatable indexer 360 of core 300. Additionally, an annular seal 270, such as a T-seal, is positioned radially between an interface of section 202B and section 202C of housing 202 to seal therebetween. Section 202D of the housing 202 of obturating tool 200 includes a removable plug 272 located at lower end 206 of housing 202. Additionally, section 202D includes annular seal 274, such as a T-seal, disposed in the inner surface 210 of section 202D proximal an upper end thereof, where seal 274 sealingly engages the outer surface 212 of section 202C.

Core 300 of obturating tool 200 is disposed coaxially with the longitudinal axis of housing 202 and includes an upper end 302 that forms a fishing neck for retrieving obturating tool 200 when it is disposed in a wellbore, and a lower end 304. In this embodiment, core 300 includes a generally cylindrical outer surface 306 extending between ends 302 and 304, and a bore or passage 308 extending between a port 310 proximal upper end 302 and lower end 304. In the embodiment shown in FIGS. 6A-22B, core 300 comprises a first or upper segment 300A and a second or lower segment 300B, where segments 300A and 300B are releasably connected at a shearable coupling 312. Shearable coupling 312 includes an annular seal 314 to seal bore 308 and a shear member or ring 316 to releasably couple upper segment 300A with lower segment 300B. In this configuration, relative axial movement is restricted between segments 300A and 300B until shear ring 316 is sheared in response to the application of an upwards force on the upper end 302 of core 300, thereby permitting limited relative axial movement between upper segment 300A of core 300 and housing 202.

The outer surface 306 of the upper section 300A of core 300 includes an annular first or upper groove 318, an annular first or upper shoulder 320, an annular second or intermediate shoulder 322, an annular second or intermediate groove 324, an annular third or intermediate shoulder 326, an annular third or intermediate groove 328, an annular fourth or lower groove 330, an annular fourth or intermediate shoulder 332, and an annular fifth or lower shoulder 334. Additionally, core 300 of obturating tool 200 includes a radially outwards biased C-ring 336 receivable in intermediate groove 328. Particularly, C-ring 336 is configured to physically engage the radially inner end of bore sensors 250 to thereby bias bore sensors 250 towards a first or radially outwards position shown in FIG. 6B. Core 300 also includes an annular seal 338, such as a T-seal, disposed in outer surface 306 and axially located between intermediate groove 328 and lower groove 330. Further, core 300 includes a releasable connector or coupling 340 for connecting the lower end 304 of core 300 with actuation assembly 400.

In the embodiment of FIGS. 6A-22B, obturating tool 300 includes a floating piston 342 disposed about core 300, where floating piston 342 includes a generally cylindrical inner surface having an annular inner seal 344 disposed therein and a generally cylindrical outer surface having an annular outer seal 346 formed therein. In some embodiments, inner and outer seals 344 and 346 may comprise T-seals. In this configuration, inner seal 344 of floating piston 342 sealingly engages the outer surface 306 of core 300 while outer seal 346 sealingly engages the inner surface 210 of housing 212. The sealing engagement provided by seals 344 and 346 of floating piston 342 form an annular first or upper fluid chamber 348 and an annular second or lower fluid chamber 350. In this configuration, lower fluid chamber 350 is fluidically sealed from the surrounding environment (i.e., at least a portion of the bore 4B of well string 4) while pressure from the surrounding environment is communicated to lower chamber 350 from upper chamber 348 via floating piston 342. In some embodiments, lower chamber 350 is filled with hydraulic fluid for facilitating operation of actuation assembly 400.

In the embodiment of FIGS. 6A-22B, obturating tool 200 includes an annular indexer 360 for assisting actuation assembly 400 in the actuation of obturating tool 200, as will be discussed further herein. Indexer 360 is coupled to the outer surface 306 of core 300 such that relative axial and rotational movement between indexer 360 and core 300 is restricted. As shown particularly in FIG. 21, indexer 360 generally includes a first or upper end 360A, a second or lower end 360B, and a generally cylindrical outer surface 362 extending between ends 360A and 360B. In the embodiment of FIGS. 6A-22B, the outer surface 362 of indexer 360 includes a plurality of circumferentially spaced ridges 364 extending radially outward therefrom, where each ridge 364 extends axially towards lower end 360B from upper end 360A. As will be discussed further herein, ridges 364 radially overlap with long fingers 264 and short fingers 266 of housing 202, and thus, when ridges 364 are angularly aligned with fingers 264 and/or 266, relative axial movement between core 300 and housing 202 may result in physical engagement between the upper axial end of each ridge 364 and the terminal end of each short finger 266 and/or the shoulder 264S of each long finger 264.

In the embodiment of FIGS. 6A-22B, indexer 360 includes four circumferentially spaced ridges 364; however, in other embodiments, core 360 may include varying numbers of ridges 364. Additionally, the outer surface 362 of indexer 360 includes a plurality of circumferentially spaced grooves 366 disposed therein. In this embodiment, indexer 360 includes a pair of grooves 366 spaced approximately 180° apart; however, in other embodiments, indexer 360 may include varying numbers of grooves 366. Each groove 366 receives one of the indexer pins 268 of housing 202, and includes a plurality of angularly extending shoulders 368. As will be discussed further herein, physical engagement or contact between indexer pins 268 and the shoulders 368 of the grooves 366 of indexer 360 is configured to control rotation of core 300 relative housing 202 during the operation of obturating tool 200.

In the embodiment of FIGS. 6A-22B, actuation assembly 400 generally includes a cylindrical valve block or body 402, a first pair of valve assemblies 440A and 440B, and a second pair of valve assemblies 510A and 510B. Valve body 402 includes a first or upper end 404, a second or lower end 406, and a generally cylindrical outer surface 408 extending between ends 404 and 406. The outer surface 408 of valve body 402 includes an annular seal 410, such as a T-seal, disposed therein that sealingly engages the inner surface 210 of housing 202. The sealing engagement provided by seal 410 of valve body 402 divides lower chamber 350 into a first or upper actuation chamber 352A extending between the seals 344 and 346 of floating piston 342 and seal 410 of valve body 402, and a second or lower actuation chamber 352B that extends axially between seal 410 of valve body 402 and a lower terminal end of central bore 208 of housing 202. As will be discussed further herein, actuation assembly 400 is configured to selectively restrict fluid communication between upper actuation chamber 352A and lower actuation chamber 352B.

In the embodiment of FIGS. 6A-22B, valve body 402 of actuation assembly 400 includes a first valve bore or passage 412, a second valve bore or passage 414, a third valve bore or passage 420, and a fourth valve bore or passage 424, where valve bores 412, 414, 420, and 424 each extend axially into valve body 402 from lower end 406. In this arrangement, first valve bore 412 receives at least a portion of valve assembly 440A, second valve bore 414 receives at least a portion of valve assembly 440B, third valve bore 420 receives at least a portion of valve assembly 510A, and fourth valve bore 414 receives at least a portion of valve assembly 510B. A first radial port or passage 416 extends radially through valve body 402 between outer surface 408 and first valve bore 412, where first radial passage 416 intersects first valve bore 412 proximal an inner terminal end of first valve bore 412. Similarly, a second radial port or passage 418 extends radially through valve body 402 between outer surface 408 and second valve bore 414, where second radial passage 418 intersects second valve bore 414 proximal an inner terminal end of second valve bore 414. Radial passages 416 and 418 are each positioned axially in valve body 402 between seal 410 and upper end 404. In this arrangement, when fluid communication is permitted either between first valve bore 412 and first radial passage 416 and/or between second valve bore 414 and second radial passage 418, fluid communication is thereby provided between upper actuation chamber 352A and lower actuation chamber 352B.

Third valve bore 420 of actuation assembly 400 includes a frustoconical sealing surface 420S and is in selective fluid communication with first valve bore 412 via a third radial port or passage 422 extending between first valve bore 412 and an inner terminal end of third valve bore 420. Fourth valve bore 424 similarly includes a frustoconical sealing surface 424S and is in selective fluid communication with an upper chamber bore or passage 428 via a fourth radial port or passage 426 extending radially between third valve bore 424 and upper chamber passage 428. Upper chamber passage 428 extends axially into valve body 402 from upper end 404 and is also in fluid communication with both first valve body 412 and second valve bore 414 via a fifth radial port or passage 430 extending between both first valve bore 412 and second valve bore 414, and upper chamber passage 428.

In the embodiment of FIGS. 6A-22B, valve body 402 additionally includes an inlet or core bore or passage 432 extending axially into valve body 402 from upper end 404. Additionally, valve body 402 includes a neck 434 configured to releasably couple with the connector 340 of core 300, and an annular seal 436 configured to sealingly engage the inner surface of bore 308 of core 300. In this arrangement, fluid communication is provided between core passage 432 of valve body 402 and bore 308 of core 300 while direct fluid communication is restricted (via seal 436) between core passage 432 and lower chamber 350. In the embodiment of FIGS. 6A-22B, core passage 432 of valve body 402 is in fluid communication with both first valve bore 412 and second valve bore 414 via a sixth radial port or passage 438 extending therebetween. Additionally, valve body 402 includes a bypass bore or passage 437 extending axially between upper end 404 and lower end 406 of valve body 402. Bypass passage 437 includes a check valve 439 biased into sealing engagement with the inner surface of bypass passage 437 via a biasing member 441. In this arrangement, check valve 439 permits fluid flow from upper actuation chamber 352A to lower actuation chamber 352B via bypass passage 437 but restricts fluid flow from lower actuation chamber 352B to upper actuation chamber 352A via bypass passage 437. Bypass passage 437 is in fluid communication with second valve bore 414 via a sixth radial port or passage 443 extending therebetween.

Figure 22A:
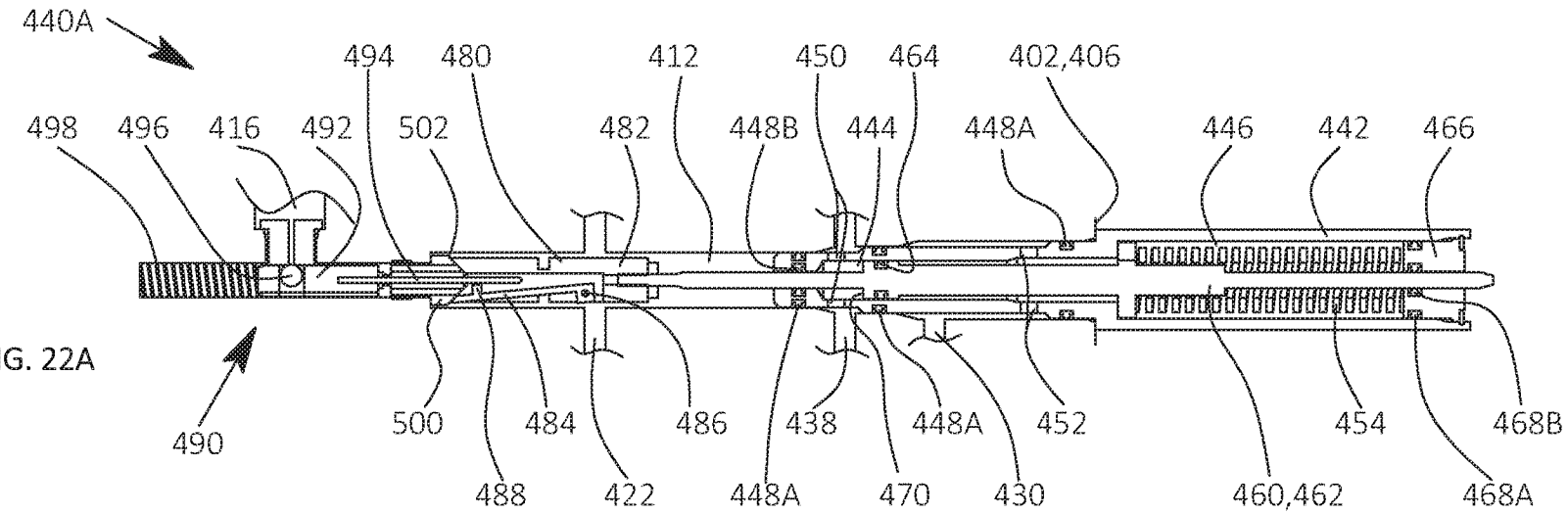
FIG. 22A is a section view of an embodiment of a valve assembly of the actuation assembly of FIG. 19 in accordance with principles disclosed herein.
Figure 22B:
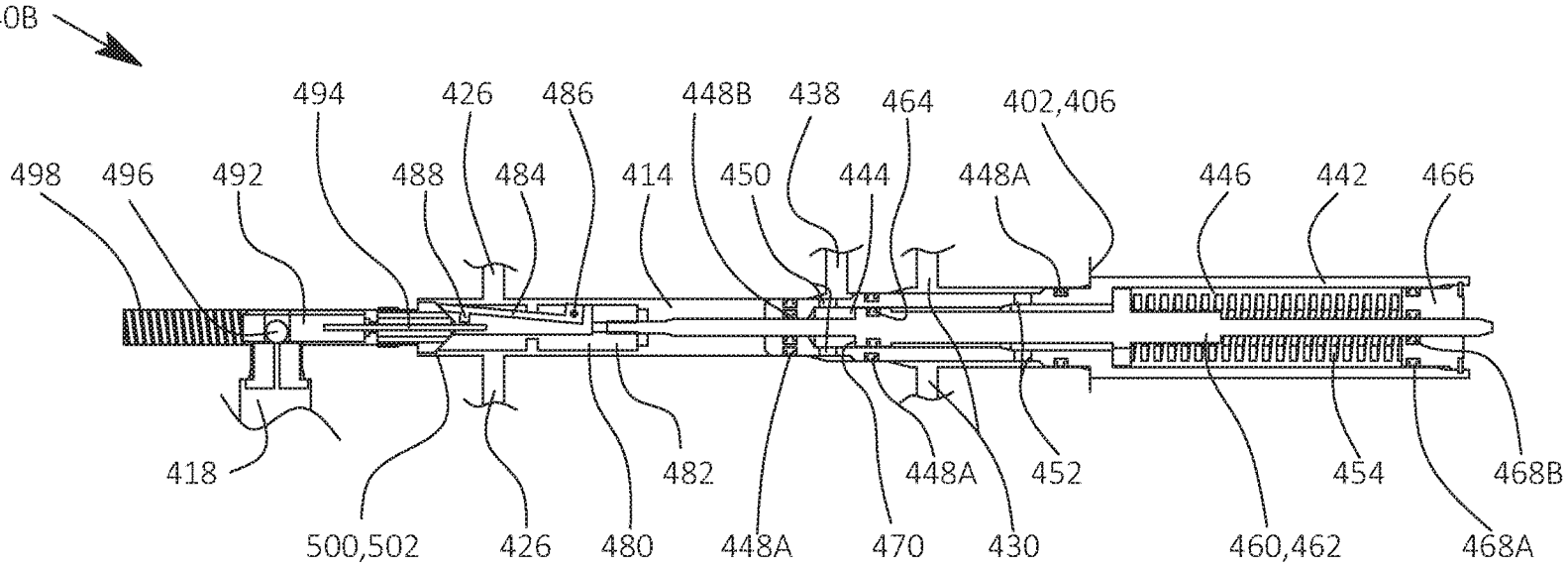
FIG. 22B is a section view of an embodiment of another valve assembly of the actuation assembly of FIG. 19 in accordance with principles disclosed herein.

As shown particularly in FIGS. 22A and 22B, in the embodiment of FIGS. 6A-22B, valve assemblies 440A and 440B each generally include a housing 442, a piston assembly 460, and a check valve assembly 490. Housing 442 of valve assembly 440A couples with the inner surface of first valve bore 412 proximal lower end 406 of valve body 402 while housing 442 of valve assembly 440B couples with the inner surface of second valve bore 414 proximal second end 406 of valve body 402. Housing 442 of each valve assembly 440A and 440B includes a first or upper chamber 444 and a second or lower chamber 446. Housing 442 of each valve assembly 440A and 440B additionally include annular seals 448A and 448B, which may comprise T-seals in some embodiments. Additionally, the piston assembly 460 of each valve assembly 440A and 440B includes a piston 462 slidably disposed in its corresponding housing 442, piston 462 including an annular seal 464 (such as a T-seal), disposed in an outer surface thereof. Additionally, each piston assembly 460 includes a piston retainer 466 coupled to a lower terminal end of housing 442, where piston retainer 466 includes an annular first or outer seal 468A that sealingly engages an inner surface of housing 442 and an annular second or inner seal 468B that sealingly engages an outer surface of piston 462. In some embodiments, housing 442 and piston retainer 466 may comprise a single, unitary component. Seals 448A of the housing 442 of valve assembly 440A sealingly engage the inner surface of first valve bore 412 of valve body 402 while seal 448B sealingly engages the outer surface of piston 462 and seal 464 of piston 462 sealingly engages the inner surface of housing 442. Similarly, seals 448A of the housing 442 of valve assembly 440B sealingly engage the inner surface of second valve bore 412 of valve body 402 while seal 448B sealingly engages the outer surface of piston 462 and seal 464 of piston 462 sealingly engages the inner surface of housing 442.

In this arrangement, fluid communication is provided between the upper chamber 444 of each valve assembly 440A and 440B and sixth radial passage 438 (and, in-turn, core passage 432) via a plurality of circumferentially spaced first or upper housing ports 450, while fluid communication is provided between the lower chamber 446 of each valve assembly 440A and 440B and fifth radial passage 430 (and, in-turn, upper actuation chamber 352A) via a plurality of circumferentially spaced second or lower housing ports 452. Conversely, fluid communication is restricted between the upper chamber 444 of valve assemblies 440A and 440B and fifth radial passage 430, and fluid communication is restricted between the lower chamber 446 of valve assemblies 440A and 440B and sixth radial port 438. Housing 442 of each valve assembly 440A and 440B includes a biasing member 454 received within upper chamber 444 for providing a biasing force against the corresponding piston assembly 460 in the direction of the upper end 404 of valve body 402. In certain embodiments, the biasing member 454 of the first valve assembly 440A provides a greater biasing force than the biasing member 454 of second valve assembly 440B.

In the embodiment of FIGS. 6A-22B, the piston assembly 460 of each valve assembly 440A and 440B generally includes piston 462 and a flapper assembly 480 coupled to an upper end of piston 462. Piston 462 of each valve assembly 440A and 440B includes an annular shoulder 470 disposed in the upper chamber 444 of the corresponding housing 442. In this arrangement, the annular shoulder 470 of piston 462 receives fluid pressure from bore 308 of core 300 via core passage 432 of valve body 402. As described above, bore 308 of core 300 is in fluid communication with the surrounding environment (i.e., bore 4B of well string 4) disposed above piston rings 260, and thus, fluid pressure from axially above obturating tool 200 in the string or wellbore in which it is deployed may be communicated to shoulder 470 of piston 462. In this arrangement, the pressure force applied to shoulder 470 of piston 462 by fluid pressure in upper chamber 444 resists the biasing force applied to piston 462 from biasing member 454. Thus, a sufficient or threshold pressure force, provided via a sufficient or threshold fluid pressure in upper chamber 444, applied to shoulder 470 of piston 462 may axially displace piston 462 in housing 442, thereby compressing biasing member 454.

In the embodiment of FIGS. 6A-22B, the flapper assembly 480 each valve assembly 440A and 440B includes a housing or carrier 482 coupled to an upper terminal end of piston 470, and a flapper 484 pivotably coupled to carrier 482 via a biased hinge 486, where the flapper 482 includes a radially extending engagement shoulder 488. The biased hinge 486 includes a biasing member configured to bias flapper 484 into engagement with an inner surface of carrier 482, or in other words, out of alignment with a central or longitudinal axis of the piston assembly 460. The check valve assembly 490 of first valve assembly 440A is slidably disposed in the first valve bore 412 of valve body 402 while the check valve assembly 490 of the second valve assembly 440B is slidably disposed in the second valve bore 414.

In the embodiment of FIGS. 6A-22B, the check valve assembly 490 of each valve assembly 440A and 440B includes a check valve housing 492 comprising a stem 494 extending axially upwards towards flapper assembly 480, and a ball or obturating member 496 disposed in the check valve housing 492. In addition, the check valve assembly 490 of each valve assembly 440A and 440B includes a biasing member 498 for applying a biasing force against check valve housing 492 in the direction of the lower end 406 of valve body 402. Additionally, each valve assembly 440A and 440B includes an annular plug 500 coupled to valve body 402 and disposed axially between the flapper assembly 480 and check valve assembly 490. The lower end of each plug 500 includes a generally frustoconical surface 502 for engaging the terminal end of the corresponding flapper 482. In this arrangement, the biasing member 498 of the check valve assembly 490 of first valve assembly 440A biases check valve housing 492 into a lower position with ball 496 restricting fluid communication between first valve bore 412 and first radial passage 416. Similarly, the biasing member 498 of the check valve assembly 490 of second valve assembly 440B biases check valve housing 492 into a lower position with ball 496 restricting fluid communication between second valve bore 414 and second radial passage 418. In other words, valve assemblies 440A and 440B are each biased towards a closed position.

In the embodiment of FIGS. 6A-22B, each valve assembly 510A and 510B of actuation assembly 400 generally includes an elongate seal member or plug 512 and an extension rod 514 pivotally coupled to the plug 512 via a rotatable or ball joint 516 formed between a lower end of the plug 512 and an upper end of the extension rod 514. The plug 512 of each valve assembly 510A and 510B includes an annular seal 518 disposed in a frustoconical outer surface of plug 512. Plug 512 of valve assembly 510A is slidably disposed in third valve bore 420 of valve body 402 and seal 518 of valve assembly 510A is configured to sealingly engage sealing surface 420S of third valve bore 420 when valve assembly 510A is in a closed position to restrict fluid communication between third valve bore 420 and third radial passage 422. Plug 512 of valve assembly 510B is slidably disposed in fourth valve bore 424 of valve body 402 and seal 518 of valve assembly 510B is configured to sealingly engage sealing surface 424S of fourth valve bore 424 when valve assembly 510B is in a closed position to restrict fluid communication between fourth valve bore 424 and fourth radial passage 426.

The extension rod 514 of each valve assembly 510A and 510B includes a telescoping axial length adjuster 520 configured to adjust an axial length of the extension rod 514 via relative rotation between upper and lower ends of extension rod 514. Additionally, a biasing member 522 is disposed about an outer surface of extension rod 522 and axially located the lower end of extension rod 514, which comprises a ball connector 524. As shown particularly in FIG. 7D, the lower end of the extension rod 514 of each valve assembly 510A and 510B is slidably received in one of a plurality of passages 532 extending axially through a generally cylindrical first spring retainer 530 disposed in lower actuation chamber 352B. Particularly, passages 532 extend axially into first spring retainer 530 from a first or upper end thereof, where a second or lower end of first spring retainer 530 is directly adjacent the terminal lower end of bore 208 of housing 202. In the embodiment of FIGS. 6A-22B, a biasing member 534 is disposed within each passage 532 of first spring retainer 530. Particularly, a first biasing member 534 of first spring retainer 530 physically engages the ball connector 524 of the extension rod 514 of valve assembly 510A, biasing plug 512 of valve assembly 510A towards the sealing surface 420S of third valve bore 420. Similarly, a second biasing member 534 of first spring retainer 530 physically engages the ball connector 524 of the extension rod 514 of valve assembly 510B, biasing plug 512 of valve assembly 510B towards the sealing surface 424S of fourth valve bore 424.

The biasing member 522 of each valve assembly 510A and 510B is also received in a corresponding passage 532 of first spring retainer 530, where biasing members 522 are configured to cushion the impact of plugs 512 of valve assemblies 510A and 510B when plugs 512 contact sealing surfaces 420S and 424S, respectively, when valve assemblies 510A and 510B are each actuated into their closed positions. In the embodiment of FIGS. 6A-22B, actuation assembly 400 of obturating tool 200 additionally includes a second spring retainer 540 housed in lower actuation chamber 532B, and a biasing member 542 retained by second spring retainer 540 that is configured to apply a biasing force against valve body 402 (and, in-turn, core 300) in the axial direction of the upper end 204 of the housing 202 of obturating tool 200.

Figure 23:
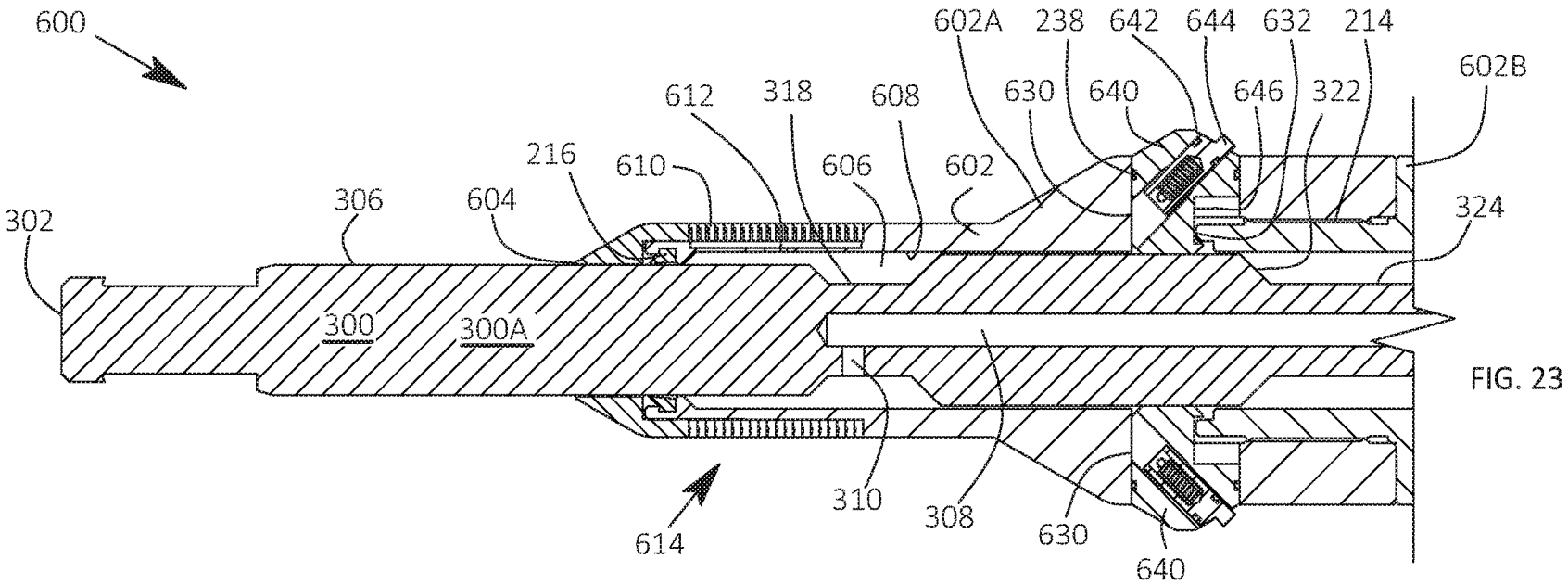
FIG. 23 is a section view of the uppermost end of another embodiment of a flow transported obturating tool for actuating the sliding sleeve valve shown in FIGS. 2A-5 in accordance with principles disclosed herein.
Figure 24:
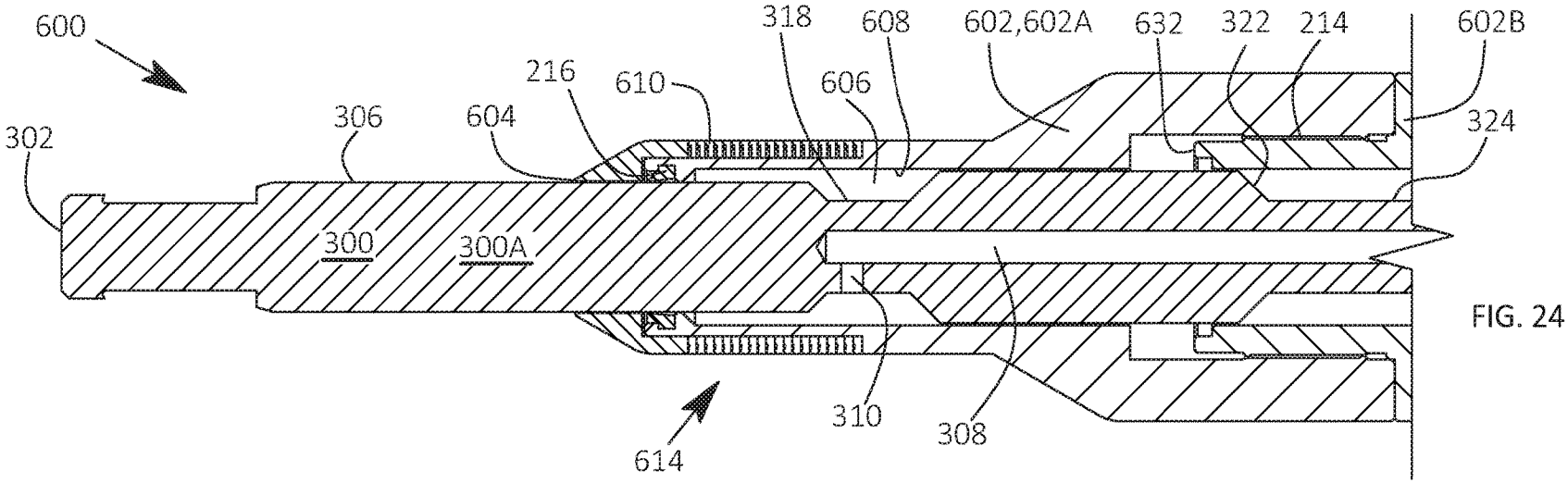
FIG. 24 is another section view of the uppermost end of the obturating tool shown in FIG. 23.
Figure 26:
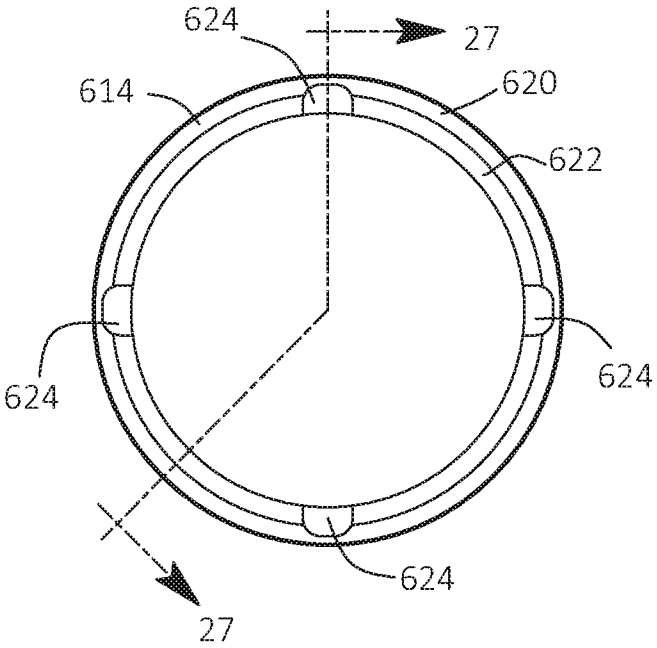
FIG. 26 is a front view of an embodiment of a washer of the obturating tool shown in FIG. 23 in accordance with principles disclosed herein.
Figure 25:
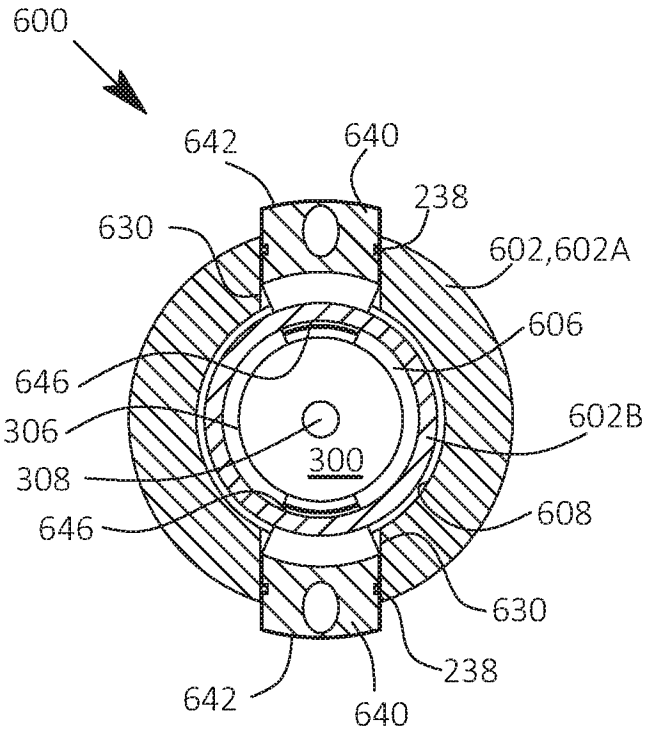
FIG. 25 is a section view along lines 25-25 of the obturating tool shown in FIG. 23.
Figure 28:
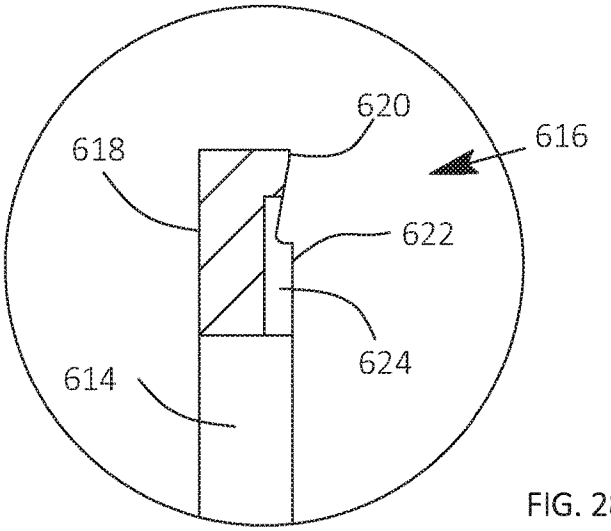
FIG. 28 is a zoomed-in view of the washer shown in FIG. 27.
Figure 27:
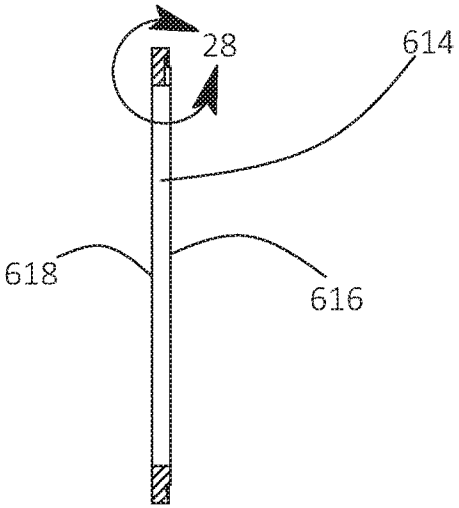
FIG. 27 is a section view along lines 27-27 of the washer shown in FIG. 26.
Figure 29:
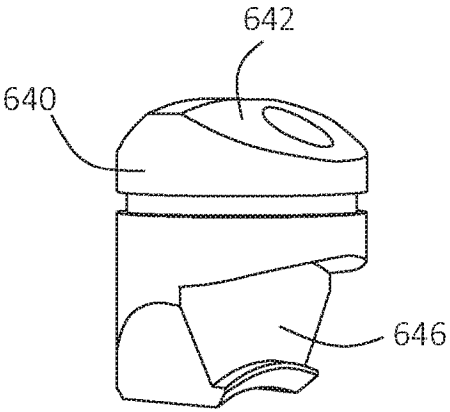
FIG. 29 is a perspective view of an embodiment of a compound key of the obturating tool shown in FIG. 23 in accordance with principles disclosed herein.

Referring to FIGS. 23-29, another embodiment of an untethered, flow transported obturating tool 600 of well system 1 is shown in FIGS. 23-29, where obturating tool 600 is configured to actuate the sliding sleeve valve 10 shown in FIGS. 2A-5 between the upper-closed, open, and lower-closed positions. For clarity, FIG. 23 shows a first side cross-sectional view of obturating tool 600 while FIG. 24 shows a second side cross-sectional view of obturating tool 600 that is rotated 90° from the view shown in FIG. 23. Obturating tool 600 can be disposed in the bore 4B of well string 4 at the surface of wellbore 3 and pumped downwards through wellbore 3 towards the heel of wellbore 3, where obturating tool 600 can selectively actuate one or more sliding sleeve valves 10 moving from the heel of wellbore 3 to the toe of wellbore 3. Obturating tool 600 includes features in common with the obturating tool 200 shown in FIGS. 6A-22B, and shared features are labeled similarly.

In the embodiment of FIGS. 23-29, obturating tool 600 includes a cylindrical housing 602, similar to housing 202 of obturating tool 200 discussed above, and core 300 slidably disposed therein. Similar to the configuration of housing 202 of obturating tool 200, housing 602 comprises a plurality of releasably coupled sections, including a first or upper section 602A and a second or intermediate section 602B coupled thereto. Housing 602 has a first or upper end 604, and a central bore or passage 606 defined by a generally cylindrical inner surface 608. Housing 602 of obturating tool 600 includes a filter 610 and a radial port 612 configured to permit fluid communication between bore 606 of housing 602 and the surrounding environment. Unlike upper filter 218 of the obturating tool 200 discussed above, filter 610 of obturating tool 600 comprises a plurality of annular, axially stacked washers 614. As shown particularly in FIGS. 26-28, each washer 614 of filter 610 has a first end 616 and a second end 618, where first end 616 includes a radially outer annular sealing surface 620 and a radially inner annular recessed surface 622. In the stacked arrangement shown in FIGS. 23 and 24, the sealing surface 620 of each washer 614 of filter 610 sealingly engages the second end 618 of an adjacently disposed washer 614.

In the embodiment of FIGS. 23-29, the first end 616 of each washer 614 includes a plurality of circumferentially spaced notches 624 formed therein. Notches 624 are configured to provide an axially extending gap between each notch 624 and the second end 618 of an adjacently disposed washer 614 when washers 614 are disposed in the stacked arrangement shown in FIGS. 23 and 24. In this configuration, the axial gaps formed by notches 624 of washers 614 facilitate fluid communication across filter 610. Additionally, the axial gaps formed between each adjacently disposed pair of washers 614 via notches 624 may be sized to permit particulates of a predetermined size through filter 610. In some embodiments, a bevel may be formed in the radially inner end of the recessed surface 622 of each washer 614 to further facilitate fluid flow through filter 610.

Housing 602 of obturating tool 600 plurality of circumferentially spaced slots 630, similar in configuration as upper slots 222 of the housing 202 of obturating tool 200. Slots 630 of housing 602 each receive a corresponding compound key or engagement member 640 therein. Compound keys 640 each include an arcuate upper shoulder 642 and a retractable pin or lower shoulder 644. Compound keys 640 are similar in configuration as compound keys 230 of obturating tool 200. However, unlike compound keys 230 described above, each compound key 640 includes an arcuate slot 646 extending into a lower end thereof. Slot 646 of each compound key 640 is configured to receive an axially extending lip 632 that forms the upper end of intermediate section 602B of housing 602. With lip 632 of intermediate section 602B received in the slot 646 of each compound key 640, keys 640 are permitted to radially translate between radially inner and outer positions while remaining restrained or coupled with housing 602. Thus, the interaction of lip 632 and slot 646 acts to retain compound keys 640 with housing 602 without using the retainers 240 of obturating tool 200.

Figure 30A:
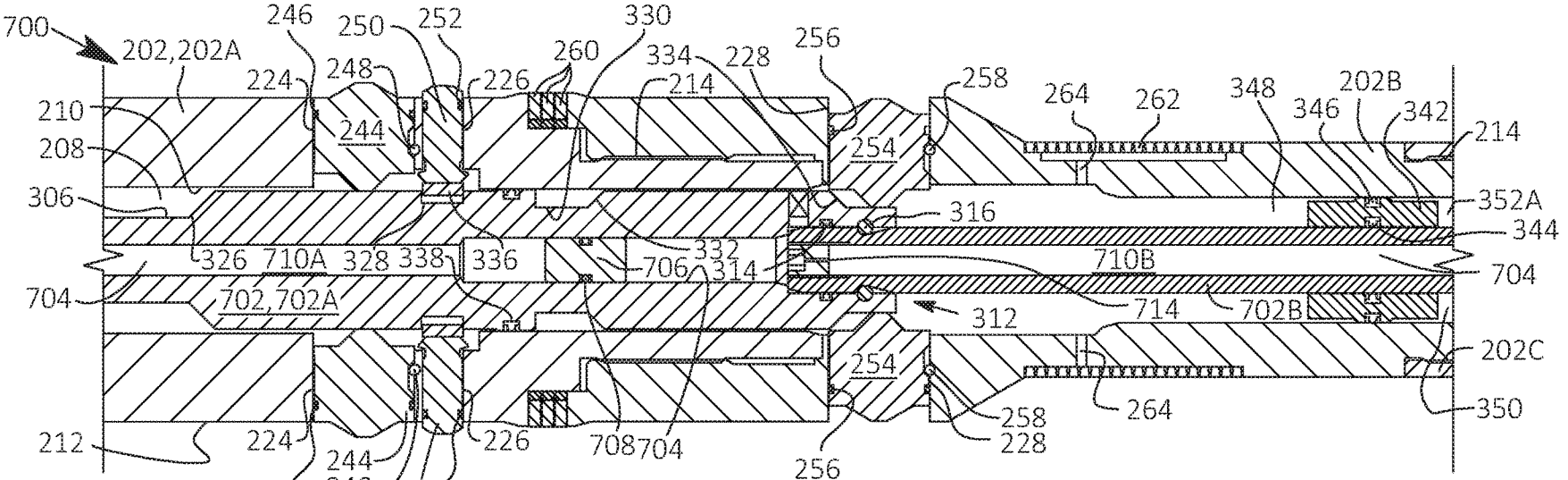
FIG. 30A is a section view of the uppermost end of another embodiment of a flow transported obturating tool for actuating the sliding sleeve valve shown in FIGS. 2A-5 in accordance with principles disclosed herein.
Figure 30B:
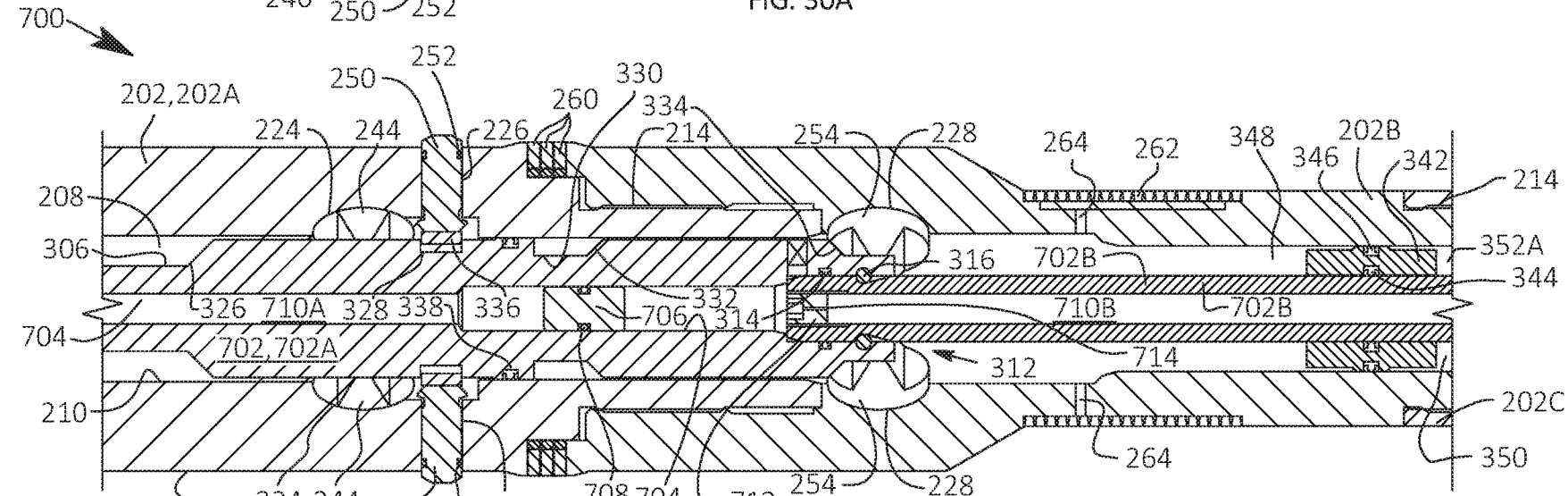
FIG. 30B is another section view of the uppermost end of the obturating tool shown in FIG. 30A.

Referring to FIGS. 30A and 30B, another embodiment of an untethered, flow transported obturating tool 700 of well system 1 is shown in FIGS. 30A and 30B, where obturating tool 700 is configured to actuate the sliding sleeve valve 10 shown in FIGS. 2A-5 between the upper-closed, open, and lower-closed positions. For clarity, FIG. 30A shows a first side cross-sectional view of obturating tool 700 while FIG. 30B shows a second side cross-sectional view of obturating tool 700 that is rotated 90° from the view shown in FIG. 30A. Obturating tool 700 can be disposed in the bore 4B of well string 4 at the surface of wellbore 3 and pumped downwards through wellbore 3 towards the heel of wellbore 3, where obturating tool 700 can selectively actuate one or more sliding sleeve valves 10 moving from the heel of wellbore 3 to the toe of wellbore 3. Obturating tool 700 includes features in common with the obturating tool 200 shown in FIGS. 6A-22B, and shared features are labeled similarly.

In the embodiment of FIGS. 30A and 30B, obturating tool 700 includes housing 202 and a core 702, which is similar in configuration with core 300 of the obturating tool 200 described above. However, unlike core 300 of obturating tool 200, core 702 includes a floating piston 706 slidably disposed in a central bore or passage 704 of core 702. Piston 706 includes an annular seal 708 in sealing engagement with an inner surface of bore 704, dividing bore 704 into a first or upper chamber 710A extending between an upper end of bore 704 and piston 706, and a second or lower chamber 710B extending between piston 708 and the core passage 432 of the valve body 402 of actuation assembly 400. In this configuration, lower chamber 710B is fluidically sealed from upper chamber 710A while fluid pressure may be communicated between chambers 710A and 710B via floating piston 706. Thus, piston 706 permits the transmission of fluid pressure to core passage 432 of valve body 402 from fluid disposed above obturating tool 700 while protecting components of actuation assembly 400 in fluid communication with core passage 432 from particulates disposed in the fluid contained in upper chamber 710A.

In the embodiment of FIGS. 30A and 30B, core 702 additionally includes a fluid damper 712 coupled to the inner surface of lower chamber 710B, where fluid damper 712 comprises a central port or passage 714 extending therethrough. Passage 714 of fluid damper 712 has a relatively small diameter and is configured to provide a restriction to fluid flow through lower chamber 710B, such as in the event of axial displacement of piston 706 through bore 704 of core 702. In some embodiments, fluid damper 712 comprises a set screw; however, in other embodiments, fluid damper 712 may comprise other damping mechanisms known in the art. In the configuration shown in FIGS. 30A and 30B, the fluid restriction provided by passage 714 of fluid damper 712 acts to damp pressure pulsations (e.g., water hammer, etc.) through the lower chamber 710B formed in core 702.

Figure 31:
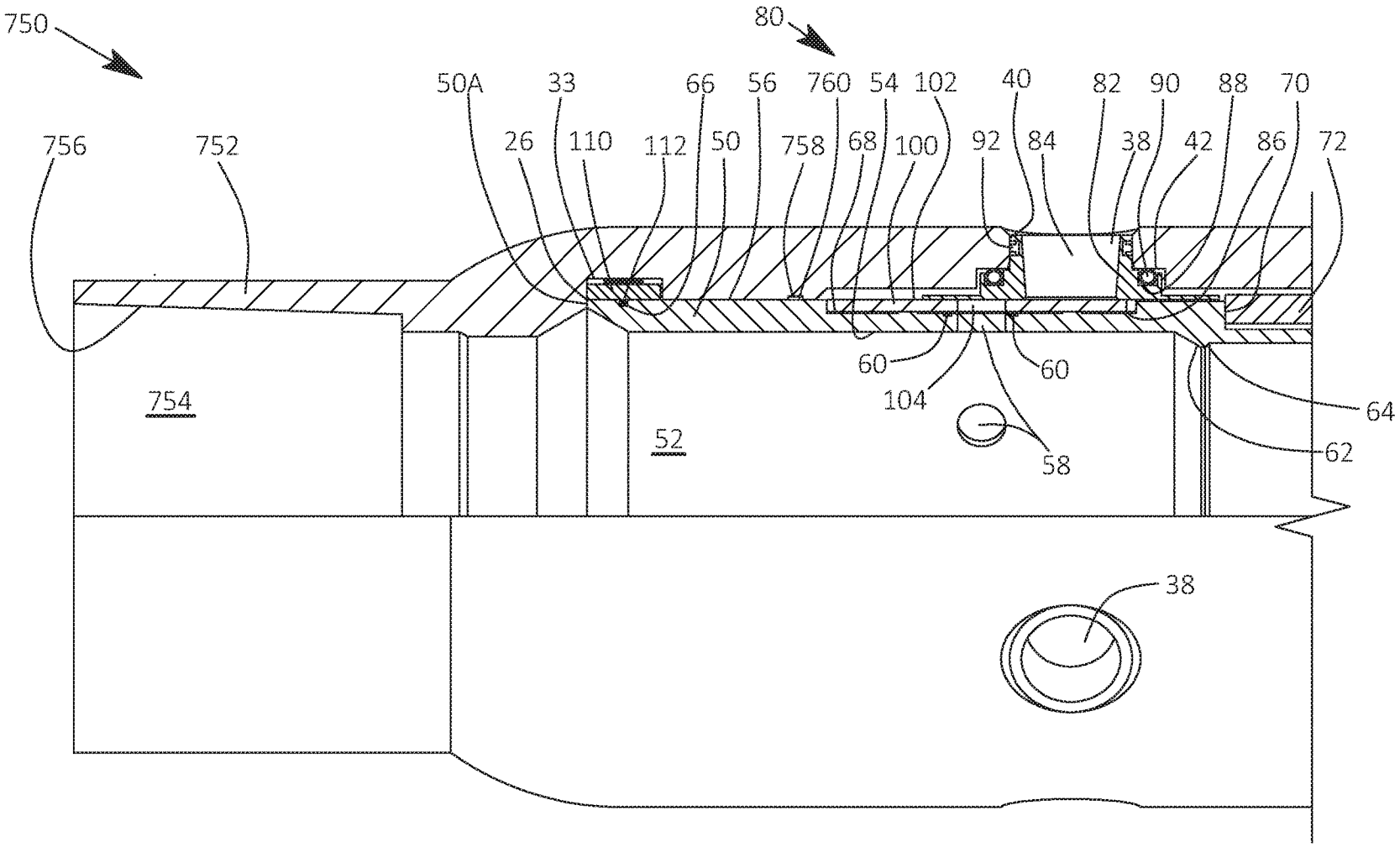
FIG. 31 is a section view of the uppermost end of another embodiment of a sliding sleeve valve in accordance with principles disclosed herein.

Referring to FIG. 31, another embodiment of a sliding sleeve valve 750 for use with well system 1 of FIG. 1 is shown in FIG. 31. Sliding sleeve valve 750 includes features in common with sliding sleeve valve 10 shown in FIGS. 2A-5, and shared features are labeled similarly. As with sliding sleeve valve 10 described above, sliding sleeve valve 750 includes a first or upper-closed position, a second or open position, and a third or lower-closed position, and is actuatable between the upper-closed, open, and lower-closed positions via an obturating tool, such as obturating tools 200, 600, and 700 described above. Sliding sleeve valve 750 generally includes a housing 752 and carrier member 50, where housing 752 has a central bore or passage 754 defined by a generally cylindrical inner surface 756.

Unlike sliding sleeve valve 10, the sliding sleeve valve 750 shown in FIG. 31 includes an annular groove 758 formed in the inner surface 756 of housing 752 that receives a radially inwards biased friction ring 760 therein. Friction ring 760 is configured to provide a resistive or friction force against the outer surface 56 of carrier member 50. The friction applied to carrier member 50 from friction ring 760 is configured to prevent carrier member 50 from being inadvertently displaced in bore 754 of housing 752. In other words, friction ring 760, through the application of friction resisting relative movement between carrier member 50 and housing 752, is configured to prevent sliding sleeve valve 750 from inadvertently actuating between the upper-closed, open, and lower-closed positions. In some embodiments, friction ring 760 comprises a galling resistant material, such as Beryllium Cooper.

In the embodiment of FIG. 31, friction ring 760 may be configured to provide a predetermined frictional force to carrier member 50 to resist movement of carrier member 50 within bore 754 of housing 752. In this arrangement, friction ring 760 may be designed such that a predetermined axial force must be applied to carrier member 50 in order to displace carrier member 50 and thereby actuate sliding sleeve valve 750 between the upper-closed, open, and lower-closed positions. In some embodiments, the amount of frictional force applied to carrier member 50 by friction ring 760 may be controlled via the material properties of friction ring 760 and the degree to which friction ring 760 is radially biased inwards towards the outer surface 56 of carrier member 50.

Referring to FIGS. 1-22B, having described the structural features of embodiments of sliding sleeve valves 10 and 750, and obturating tools 200, 600, and 700, the operation of said embodiments will now be described herein. Particularly, the operation of sliding sleeve valve 10 shown in FIGS. 2-5 and obturating tool 200 shown in FIGS. 6A-22B are described herein; however, the operation of sliding sleeve valve 750 and obturating tools 600 and 700 is similar to the operation of sliding sleeve valve 10 and obturating tool 200 described below.

FIGS. 6A-22B illustrate obturating tool 200 in the run-in position as obturating tool 200 is pumped through the wellbore 3 shown in FIG. 1. In this position, compound keys 230, intermediate keys 244, and bore sensors 250 are each in a radially outwards position while lower keys 254 are each in a radially retracted position. Additionally, as shown particularly in FIG. 19, the pair of first valve assemblies 440A and 440B of actuation assembly 400 are both in a closed position while the pair of second valve assemblies 510A and 510B are both in an open position when obturating tool 200 is in the run-in position. In this arrangement, fluid communication between upper actuation chamber 352A and lower actuation chamber 352B is permitted via fourth valve bore 424 and upper chamber passage 428.

Figure 32A:
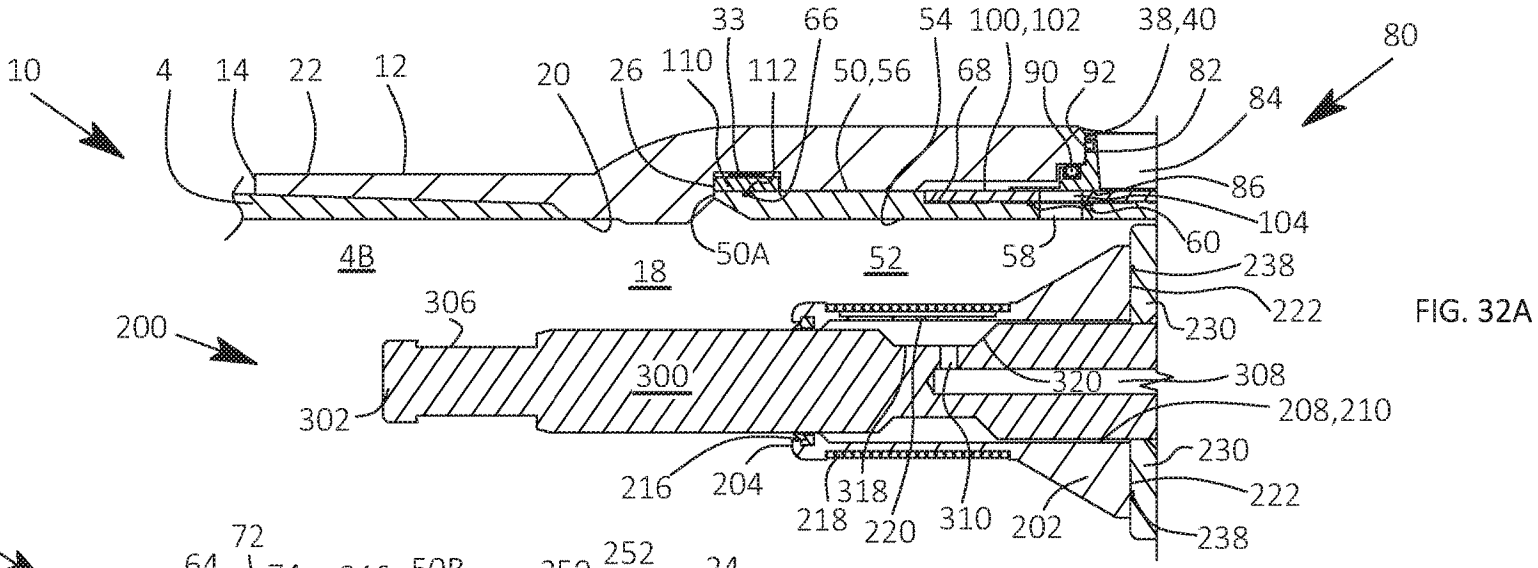
FIG. 32A is a section view of the uppermost end of the obturating tool of FIG. 6A shown in a first position.
Figure 32B:
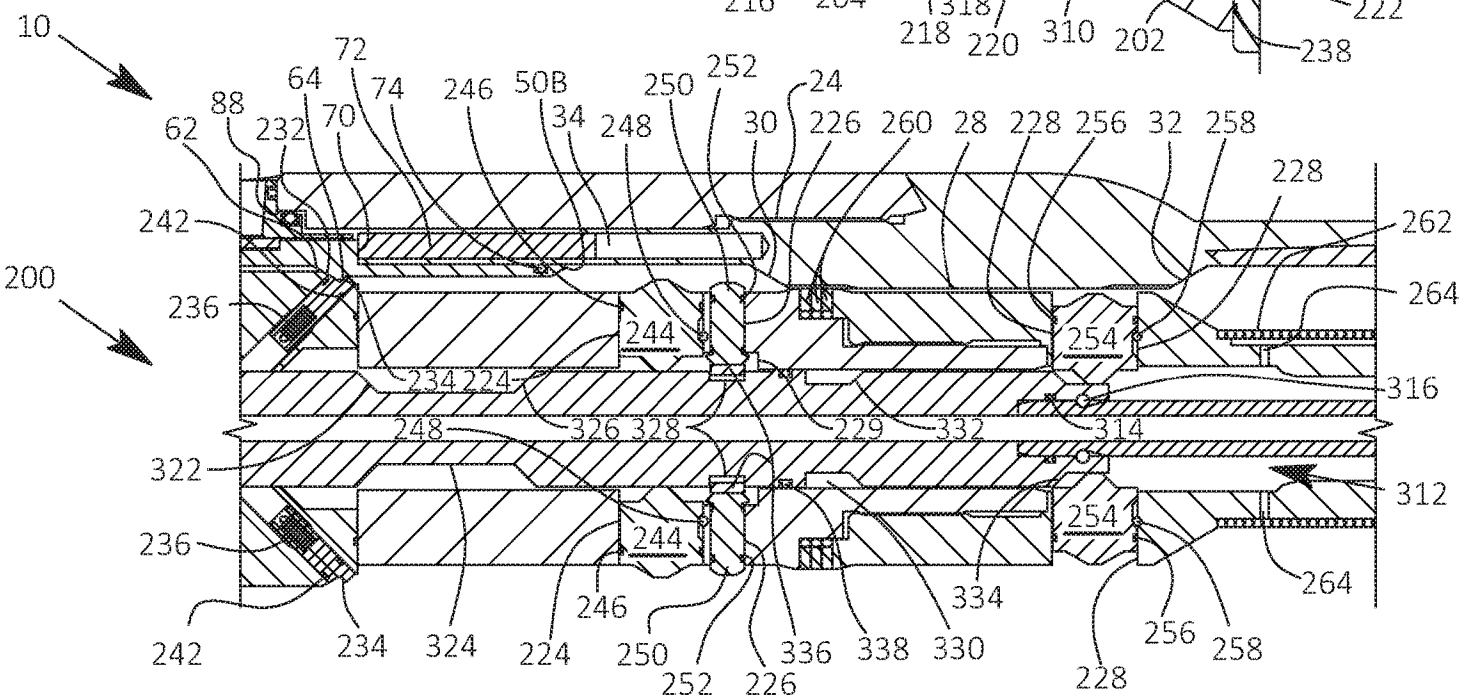
FIG. 32B is another section view of the uppermost end of the obturating tool of FIG. 6A shown in the first position.

As obturating tool 200 is pumped through bore 4B of well string 4, obturating tool 200 will enter the bore 18 of an uppermost sliding sleeve valve 10 of the well system 1. Referring to FIGS. 32A and 32B, as obturating tool 200 enters the bore 18 of the uppermost sliding sleeve valve 10 of well system 1, the upper shoulder 232 of each compound key 230 engages the upper shoulder 62 of the carrier member 50 of sliding sleeve valve while lower shoulder 234 is permitted to pass through upper shoulder 62 via retracting within its associated slot, and then, after passing through upper shoulder 62, subsequently engage lower shoulder 64 to lock carrier member 50 with housing 202 of obturating tool 200. In the position shown in FIGS. 32A and 32B, bore sensors 252 and C-ring 336 are each in a radially outwards position, restricting axial movement between core 300 and housing 202 via engagement between C-ring 336 and a shoulder 229 (shown in FIG. 32B) formed in the inner surface 210 of housing 202.

Figure 33A:
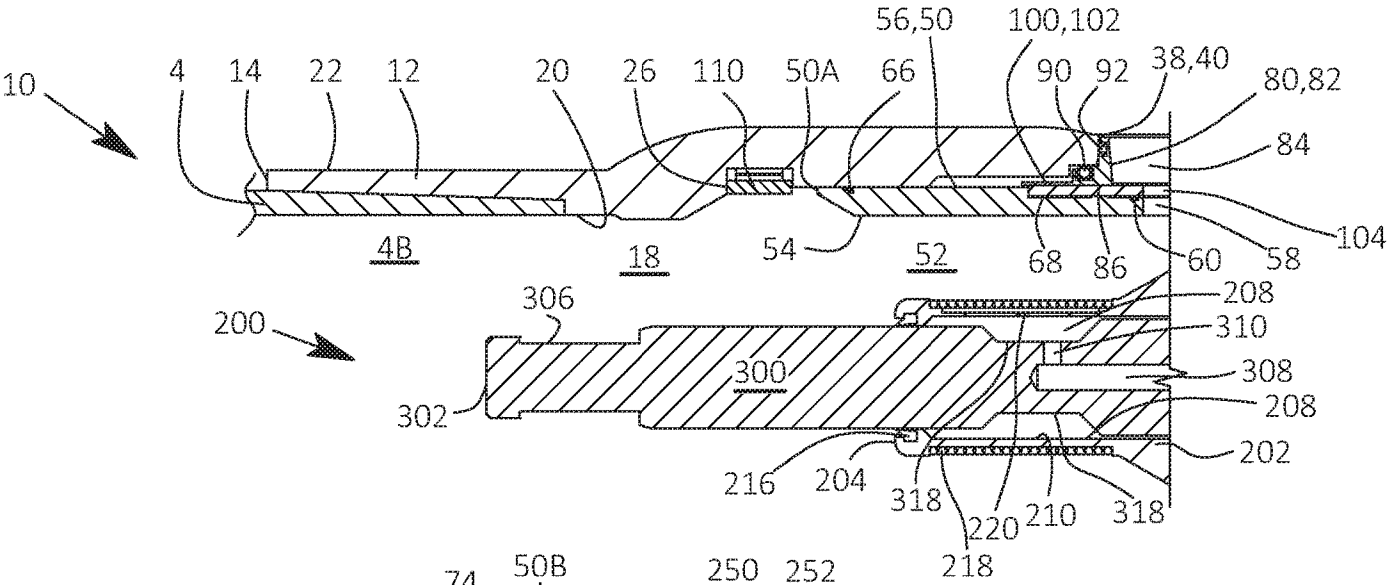
FIG. 33A is a section view of the uppermost end of the obturating tool of FIG. 6A shown in a second position.
Figure 33B:
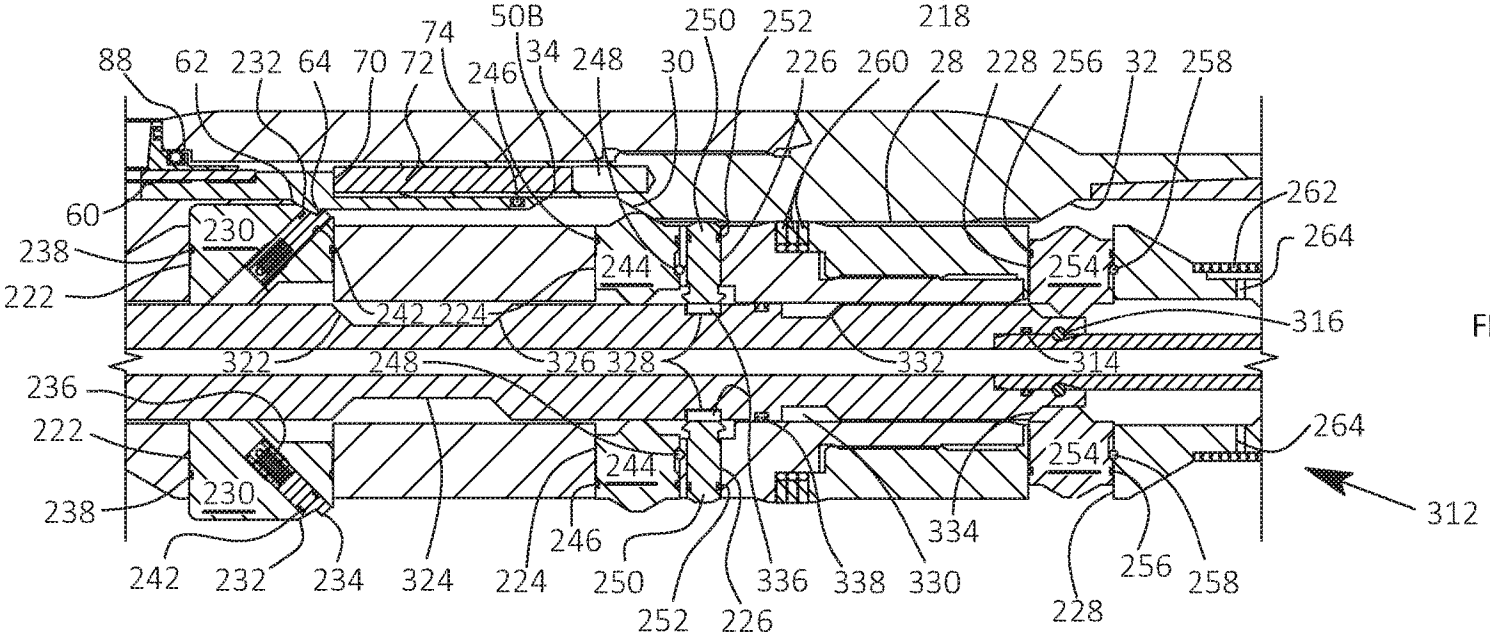
FIG. 33B is another section view of the uppermost end of the obturating tool of FIG. 6A shown in the second position.
Figure 34A:
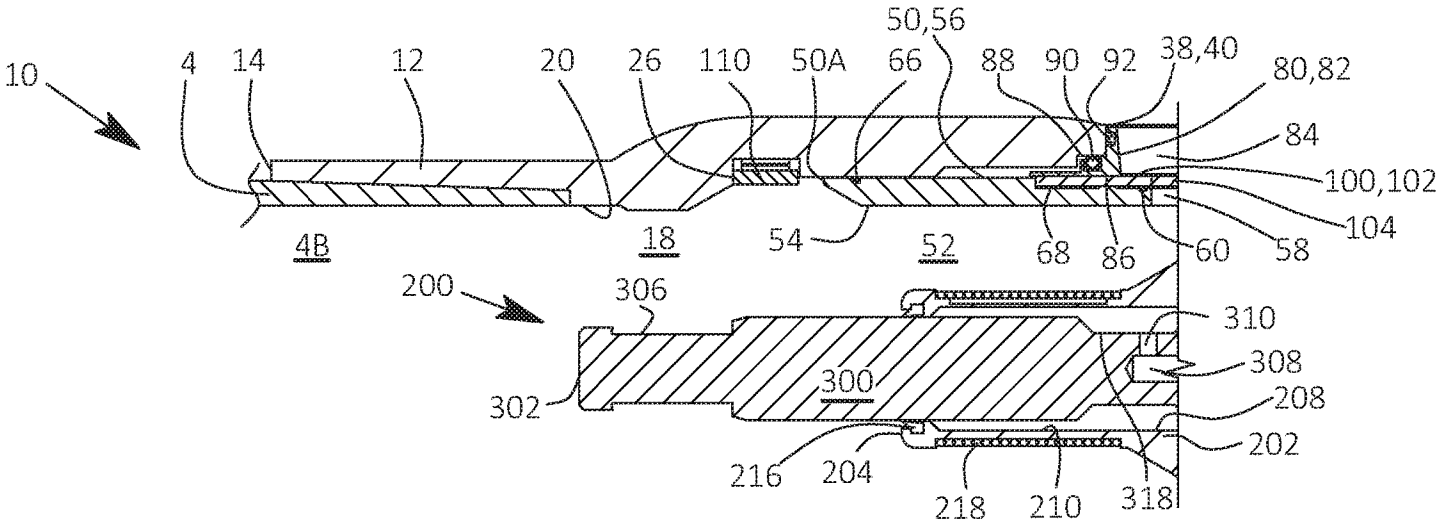
FIG. 34A is a section view of the uppermost end of the obturating tool of FIG. 6A shown in a third position.
Figure 34B:
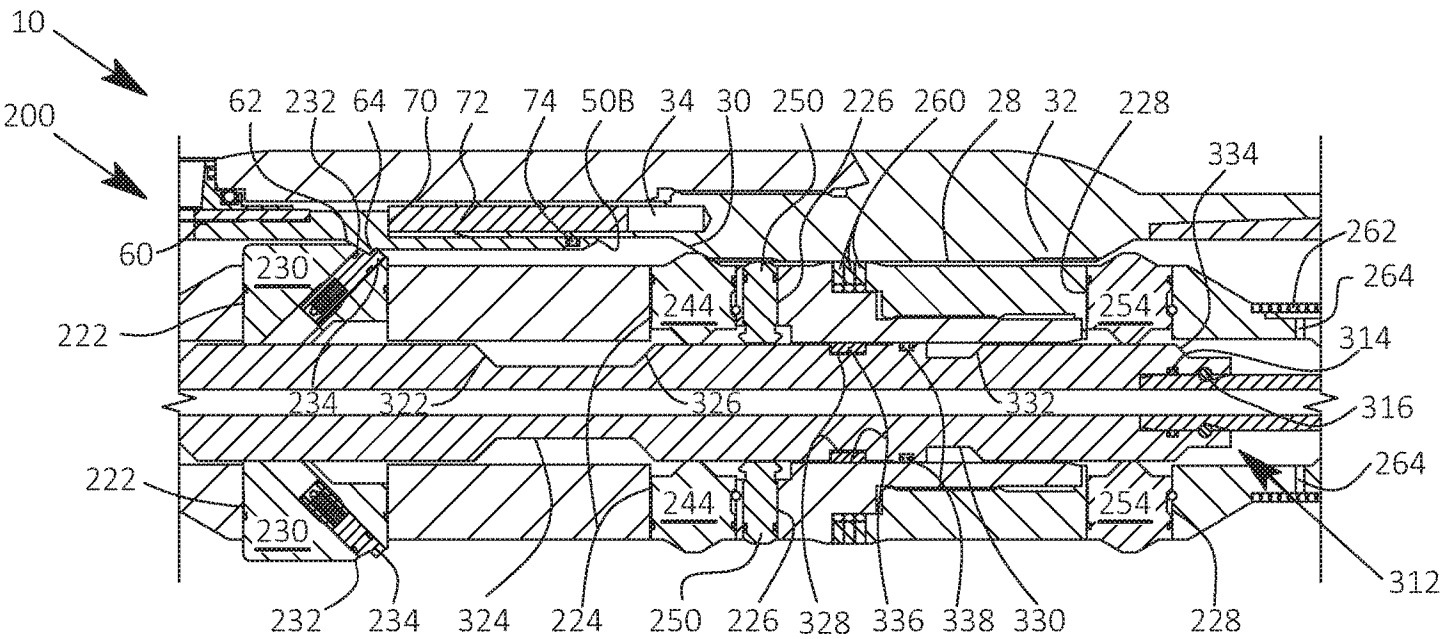
FIG. 34B is another section view of the uppermost end of the obturating tool of FIG. 6A shown in the third position.
Figure 35:
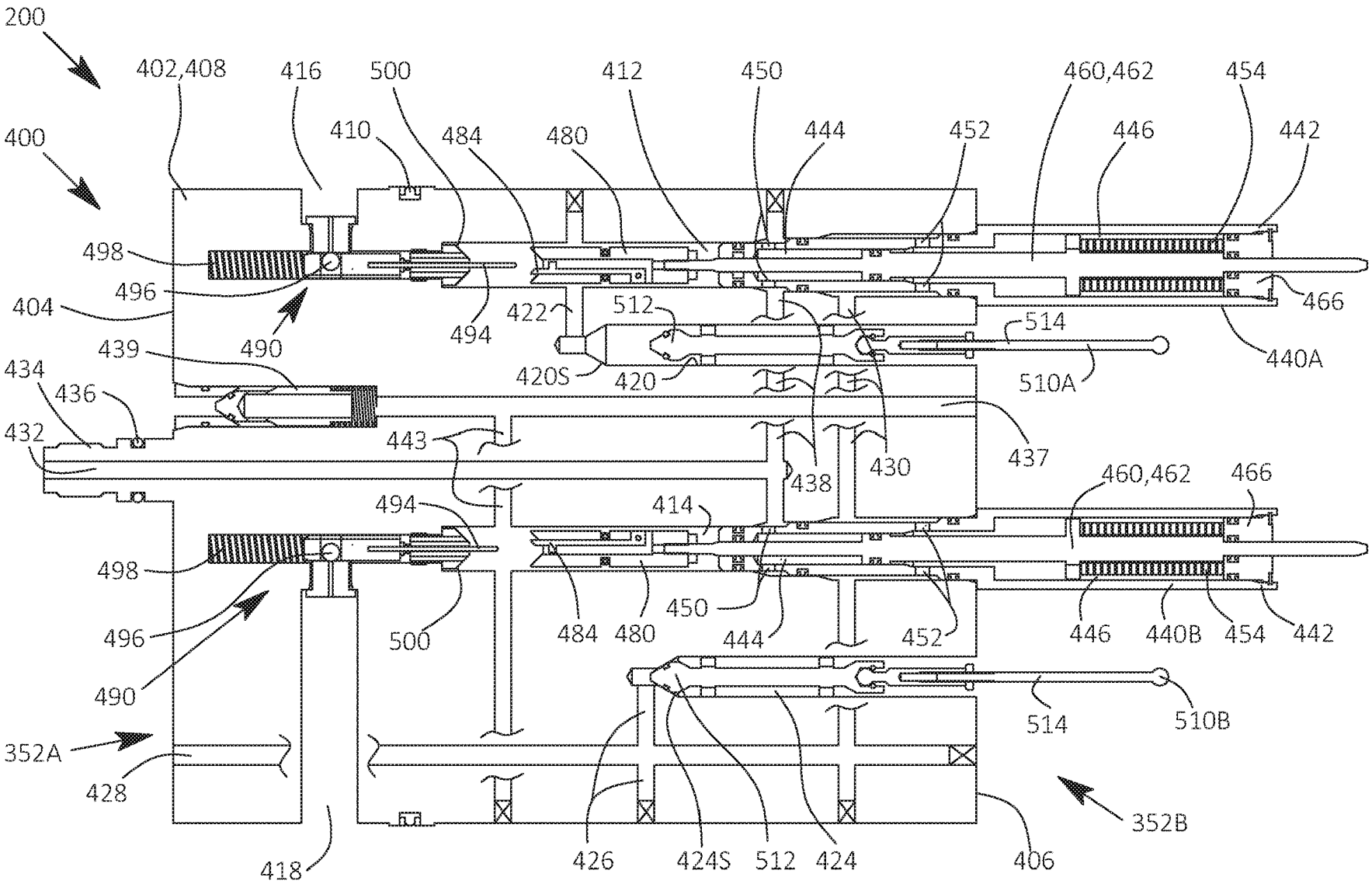
FIG. 35 is a top view of the actuation assembly of the obturating tool shown in FIGS. 34A and 34B.
Figure 37:
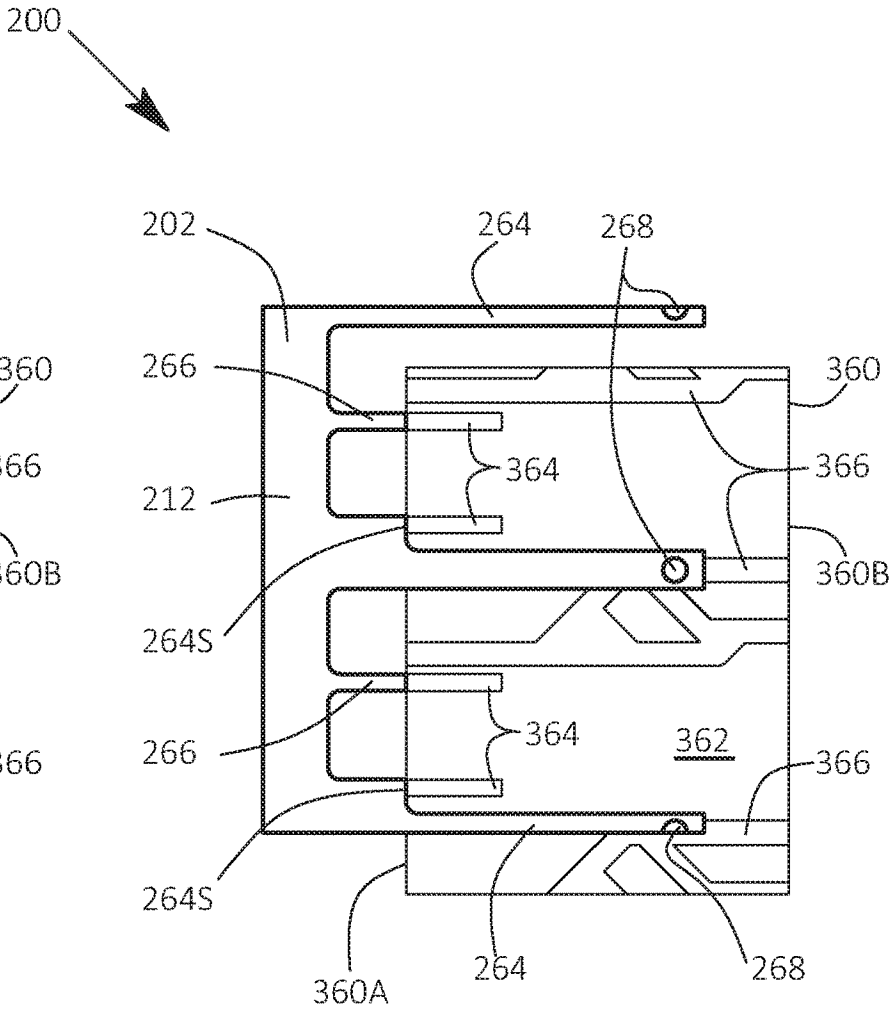
FIG. 37 is a top view of the indexer of the obturating tool of FIG. 6A shown in a fourth position.
Figure 36:
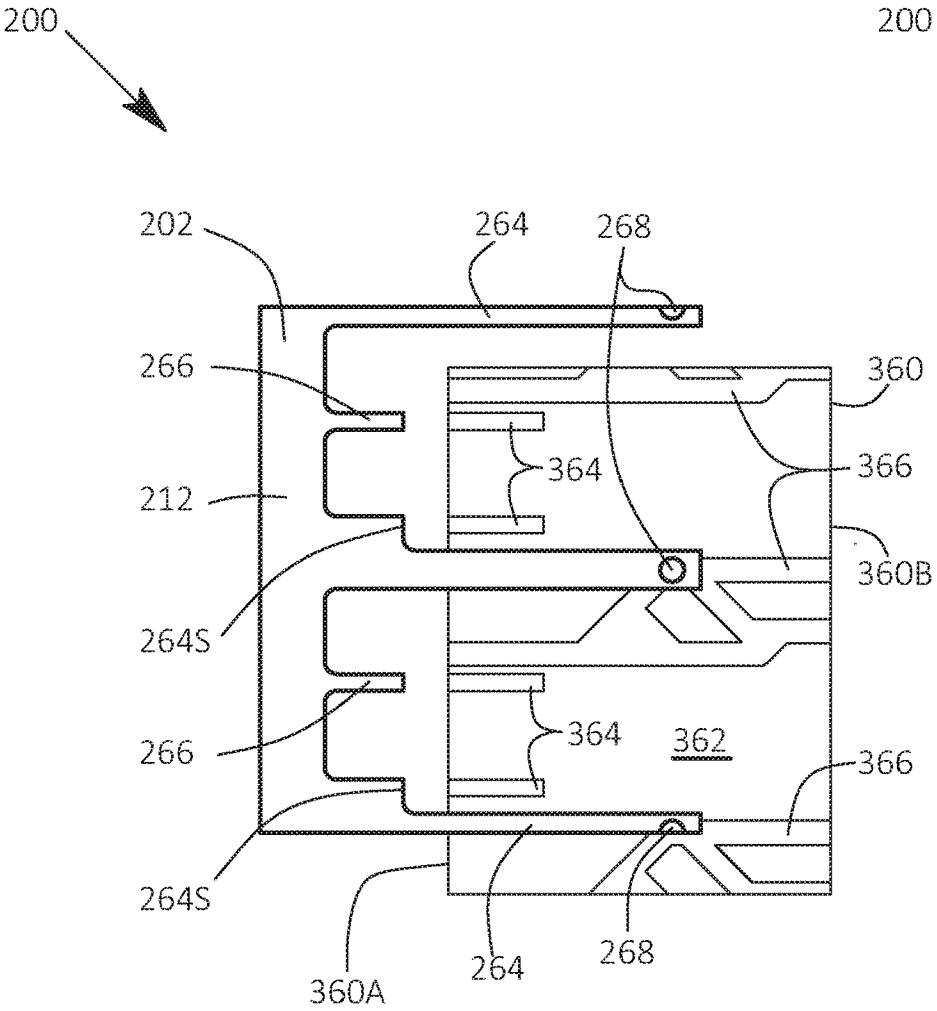
FIG. 36 is a top view of the indexer of the obturating tool shown in FIGS. 34A and 34B.

Referring to FIGS. 33A and 33B, as housing 202 of obturating tool 200 is axially locked to carrier member 50 of sliding sleeve valve 10, obturating tool 200 continues to travel axially through bore 18 of the housing 12 of sliding sleeve valve 10, thereby forcibly displacing or dragging carrier member 50 axially through bore 18. Particularly, the pressure force pumping obturating tool 200 through the bore 4B of well string 4 acts to overcome the resistive friction provided between the lower end 86 of each button 82 and the sealing surface 102 of a corresponding planar member 100 to forcibly displace carrier member 50 axially relative housing 12 of sliding sleeve valve 10. Additionally, the force applied to carrier member 50 from the housing 202 of obturating tool 200 is sufficient to shear the shear pin 112 of retainer ring 110, permitting relative axial movement between carrier member 50 and retainer ring 110.

Carrier member 50 and obturating tool 200 move axially through bore 18 of the housing 12 of sliding sleeve valve 10 until intermediate keys 244 physically engage the intermediate shoulder 30 of housing 12, thereby arresting the downward axial motion of both obturating tool 200 and carrier member 50 through bore 18. In this position, sliding sleeve valve has been actuated from the upper-closed position shown in FIGS. 2A-5 to the open position shown in FIGS. 33A and 33B, where fluid communication is established between bore 52 of carrier member 50 and bores 84 of buttons 82. Thus, engagement between intermediate keys 244 and intermediate shoulder 30 acts to locate axially locate carrier member 50 within bore 18 of housing 12 such that sliding sleeve valve 10 is disposed in the open position. Additionally, in the position shown in FIGS. 33A and 33B, piston rings 260 of housing 202 sealingly engage the seal bore 28 of housing 12, thereby restricting fluid communication between the portion of bore 18 at the upper end 14 of housing 12 and the portion of bore 18 at the lower end 16 of housing 12. In other words, fluid flow into bore 18 from the upper end 14 of housing 12 must flow out of sliding sleeve valve 10 to the surrounding environment (i.e., annulus 3A of wellbore 3) via the bores 84 of buttons 82. Further, in the position shown in FIGS. 33A and 33B, bore sensors 250 have also entered seal bore 28, and have been actuated via contact with seal bore 28 into the radially inwards position, forcing C-ring 336 into the radially inwards position.

With C-ring 336 disposed in the radially inwards position, core 300 of obturating tool 200 is axially unlocked from housing 202, and thus, is permitted to move axially relative housing 202. Further, in the position shown in FIGS. 33A and 33B, with carrier member 50 axially displaced from its position in FIGS. 32A and 32B, retainer ring 110 is permitted to displace radially into a radially inwards position in bore 18 of housing 12. In the radially inwards position, retainer ring 110 prevents carrier member 50 from returning to its original position shown in FIGS. 32A and 32B, and thus, retainer ring 110 restricts sliding sleeve valve 10 from returning to the upper-closed position once it has been actuated to the open position shown in FIGS. 33A and 33B.

Referring to FIGS. 34A-36, following the actuation of sliding sleeve valve 10 to the open position, housing 202 of obturating tool 200 may be axially locked to housing 12 of sliding sleeve valve 10. Particularly, hydraulic pressure in bore 4B of well string 4 above obturating tool 200 may be increased to thereby displace core 300 axially through bore 208 of housing 202 against the biasing force provided against core 300 by biasing member 542. As shown particularly in FIG. 34B, the axial displacement of core 300 actuates lower keys 254 into the radially outward position via contact between lower keys 254 and lower shoulder 334 of core 300. In this position, lower keys 254 are disposed directly adjacent lower shoulder 32 of housing 12, thereby restricting housing 202 of obturating tool 200 from travelling axially upwards through bore 18 of housing 12 towards upper end 14. Thus, with intermediate keys 244 and lower keys 254 each in the radially outwards position, housing 202 of obturating tool 200 is axially locked with housing 12 of sliding sleeve valve 10.

Once housing 202 of obturating tool 200 is axially locked with sliding sleeve valve 10, hydraulic pressure in the portion of bore 4B of well string 4 located above obturating tool 200 may be increased to hydraulically fracture the area of subterranean formation 6 (shown in FIG. 1) disposed adjacent sliding sleeve valve 10. Increased hydraulic pressure in bore 4B of well string 4 acts against the upper end 302 of core 300, thereby displacing core 300 further downwards through bore 208 of the housing 202 of obturating tool 200. In response to the relative axial movement between core 300 and housing 202, indexer pins 268 are displaced through the grooves 366 formed in indexer 360 until they occupy the positions shown in FIG. 36. Additionally, as indexer pins 268 move through grooves 368, pins 268 engage shoulders 368 of grooves 366, forcing core 300 to rotate relative housing 202.

Core 300 continues to travel axially through bore 208 of housing 202 until the plug 512 of valve assembly 510B seals against the sealing surface 424S of fourth valve bore 424, disposing valve assembly 510B in the closed position. With valve assembly 510B disposed in the closed position, fluid flow from lower actuation chamber 352B to upper actuation chamber 352A is restricted, forming a hydraulic lock in lower actuation chamber 352B that prevents further downward travel of core 300 through bore 208 of housing 202. With core 300 locked from further downward movement through bore 208 of housing 202, fluid pressure within bore 4B of well string 4 may be increased to a fracturing pressure and the portion of formation 6 adjacent sliding sleeve valve 10 may be hydraulically fractured.

Referring to FIGS. 34A-37, hydraulic fracturing pressure may be inadvertently lost during the hydraulic fracturing operation taking place when sliding sleeve valve 10 and obturating tool 200 are in the position shown in FIGS. 34A-36. For instance, surface pumps of well system 1 that provide fluid pressure to the inlet of the bore 4B of well string 4 may malfunction or otherwise lose pressure. In such an event, obturating tool 200 is configured to prevent from becoming stuck, jammed, or otherwise lose operational capabilities. Particularly, loss of fluid pressure against the upper end 302 of core 300 allows biasing member 542 of obturating tool 200 to displace core 300 axially upwards through bore 208 of housing 202. However, substantial upward axial movement of core 300 within bore 208 of housing 202 is restricted via physical engagement or contact between short fingers 266 and the shoulders 264S of long fingers 264 of housing 202 and the ridges 364 of the indexer 360 coupled to core 300. As shown particularly in FIG. 37, ridges 364 are angularly aligned with short fingers 266 and shoulders 264S, and thus, upward movement of core 300 relative housing 202 brings ridges 364 into contact with short fingers 266 and shoulders 264S, restricting any further upward movement of core 300. Following the interruption of hydraulic fracturing, fracturing pressure may again be applied to bore 4B of well string 4, which restores obturating tool 200 to the position shown in FIGS. 34A-36.

Figure 38:
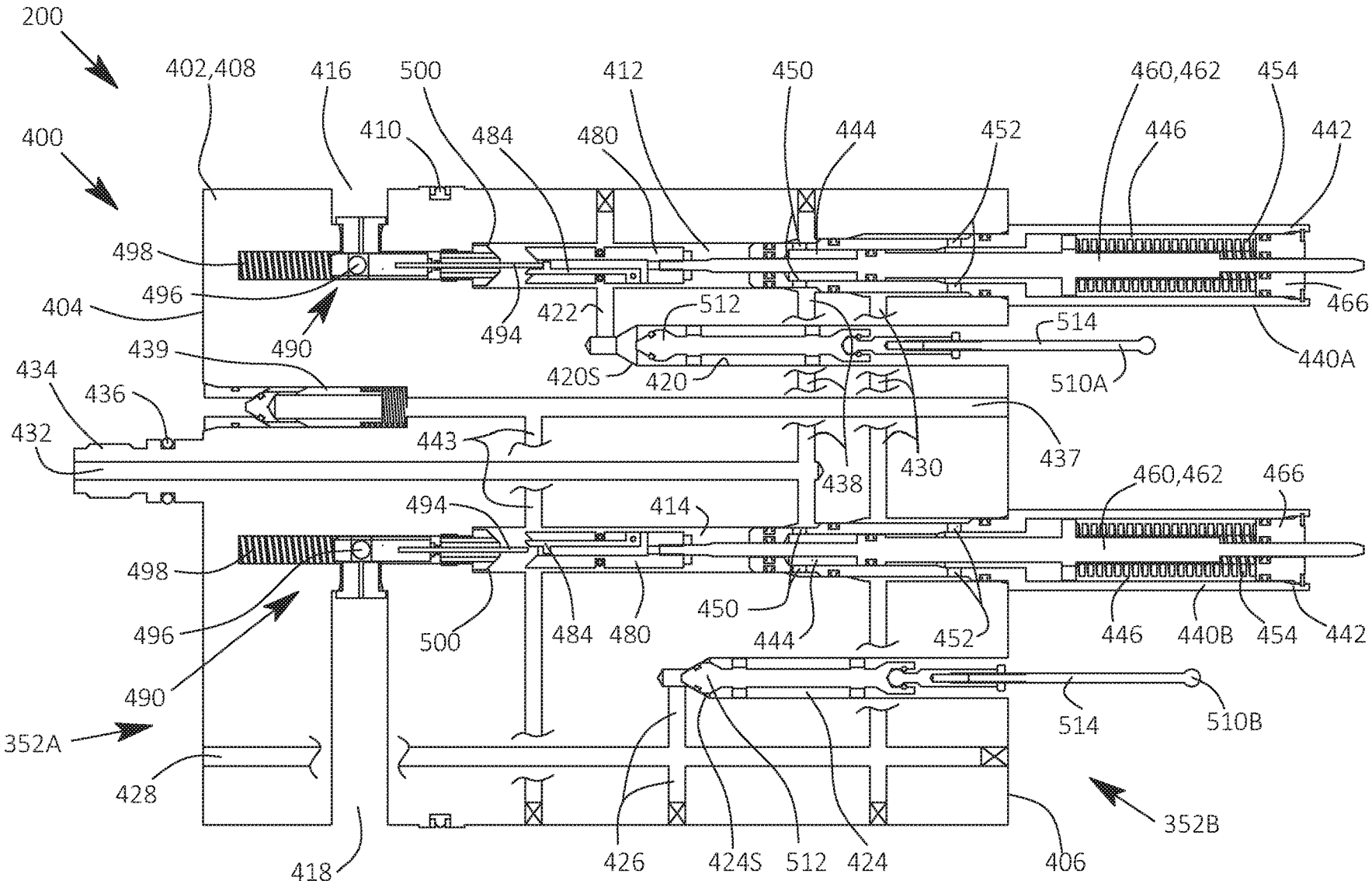
FIG. 38 is a top view of the actuation assembly of the obturating tool of FIG. 6A shown in a fifth position.
Figure 39:
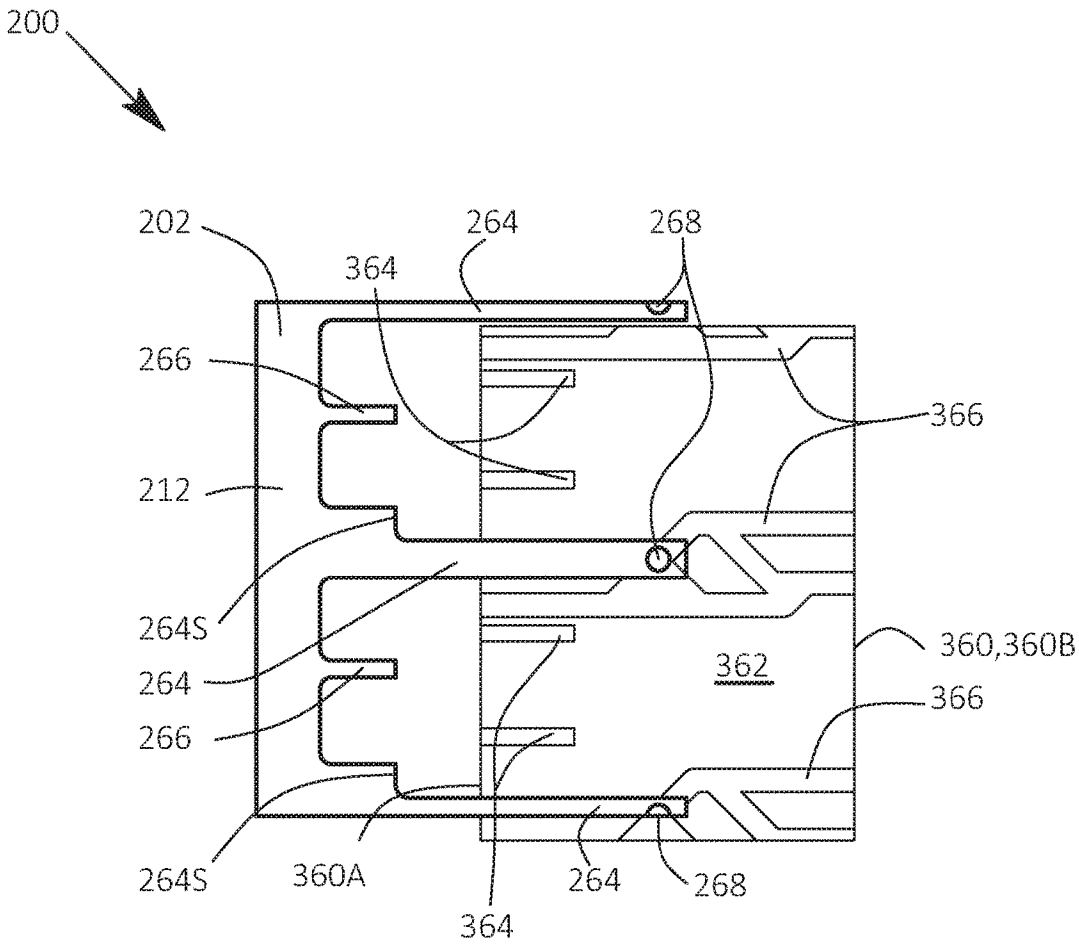
FIG. 39 is a top view of the indexer of the obturating tool of FIG. 6A shown in the fifth position.

Referring to FIGS. 38 and 39, once the portion of subterranean formation 6 disposed adjacent sliding sleeve valve 10 is sufficiently fractured, obturating tool 200 may be operated to actuate sliding sleeve valve 10 from the open position shown in FIGS. 34A-36 to the lower-closed position. Particularly, fluid pressure in the portion of bore 4B of well string 4 located above obturating tool 200 may be reduced. The reduction in fluid pressure within bore 4B of well string 4 is communicated to the upper chamber 444 of each valve assembly 440A and 440B via core passage 432 and sixth radial passage 438 formed in valve body 402. The reduction in fluid pressure in upper chamber 444 reduces, in-turn, the pressure force acting against shoulder 470 of the piston 462 of each valve assembly 440A and 440B, causing the biasing member 454 of each valve assembly 440A and 440B to axially displace each piston 462 axially towards its respective check valve assembly 490. In the embodiment of FIGS. 38 and 39, the stem 494 of valve assembly 440A is greater in axial length than the stem 494 of valve assembly 440B, and thus, flapper 484 of valve assembly 440A contacts its corresponding stem 494 before the flapper 484 of valve assembly 440B contacts its corresponding stem 494. In this configuration, reduction in fluid pressure in the upper chamber 444 of valve assembly 440A causes flapper 484 to engage stem 494 and axially displace obturating member 496 out of sealing contact with first radial passage 416. In the position shown in FIGS. 38 and 39, with obturating member 496 of valve assembly 440A out of sealing contact with first radial passage 416, fluid previously trapped in lower actuation chamber 352B is permitted to flow into upper actuation chamber 352A via third valve bore 420, third radial passage 422, first valve bore 412, and first radial passage 416.

Referring to FIGS. 40A-42, with fluid communication reestablished between actuation chambers 352A and 352B with the opening of valve assembly 440A, core 300 is permitted again to travel axially downwards through bore 208 of housing 202. Particularly, although hydraulic pressure in bore 4B of well string 4 above obturating tool 200 has been reduced, a pressure differential across piston rings 260 remains, causing core 300 to travel axially downwards through bore 208 of housing 202 in response to the fluid pressure applied to upper end 302. Core 300 continues to travel downwards through bore 208 of housing 202 until plug 512 of valve assembly 510A seals against the sealing surface 420S of third valve bore 420, thereby restricting fluid flow between actuation chambers 352A and 352B and reestablishing a hydraulic lock in lower actuation chamber 352B. As shown particularly in FIG. 42, relative axial movement between core 300 and housing 202 results in relative rotation therebetween guided by indexer 360.

Figure 40A:
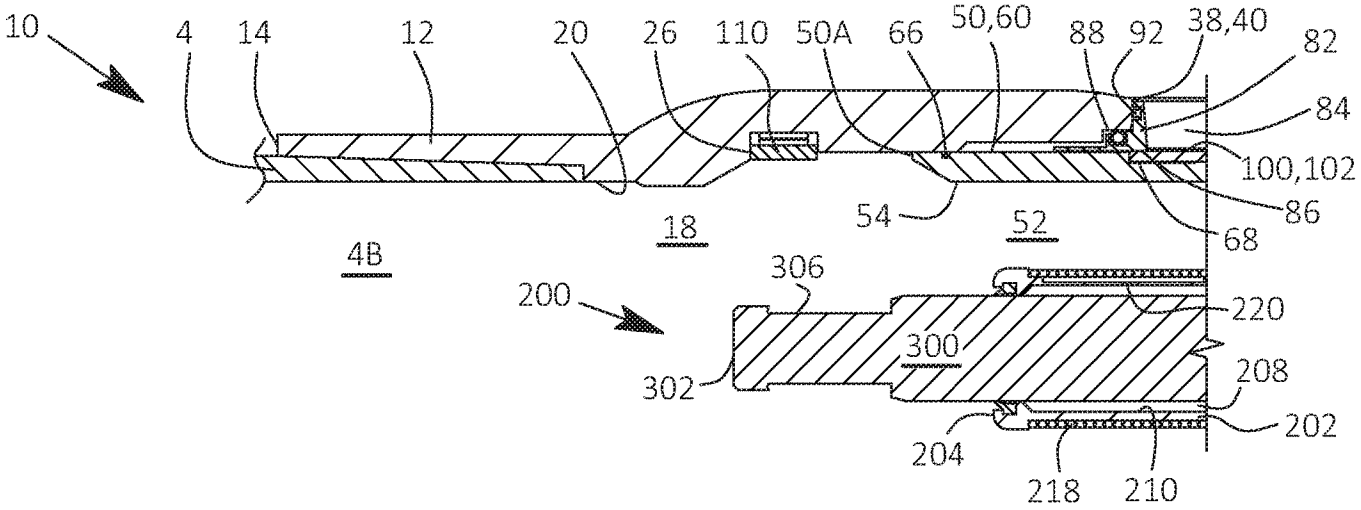
FIG. 40A is a section view of the uppermost end of the obturating tool of FIG. 6A shown in a sixth position.
Figure 40B:
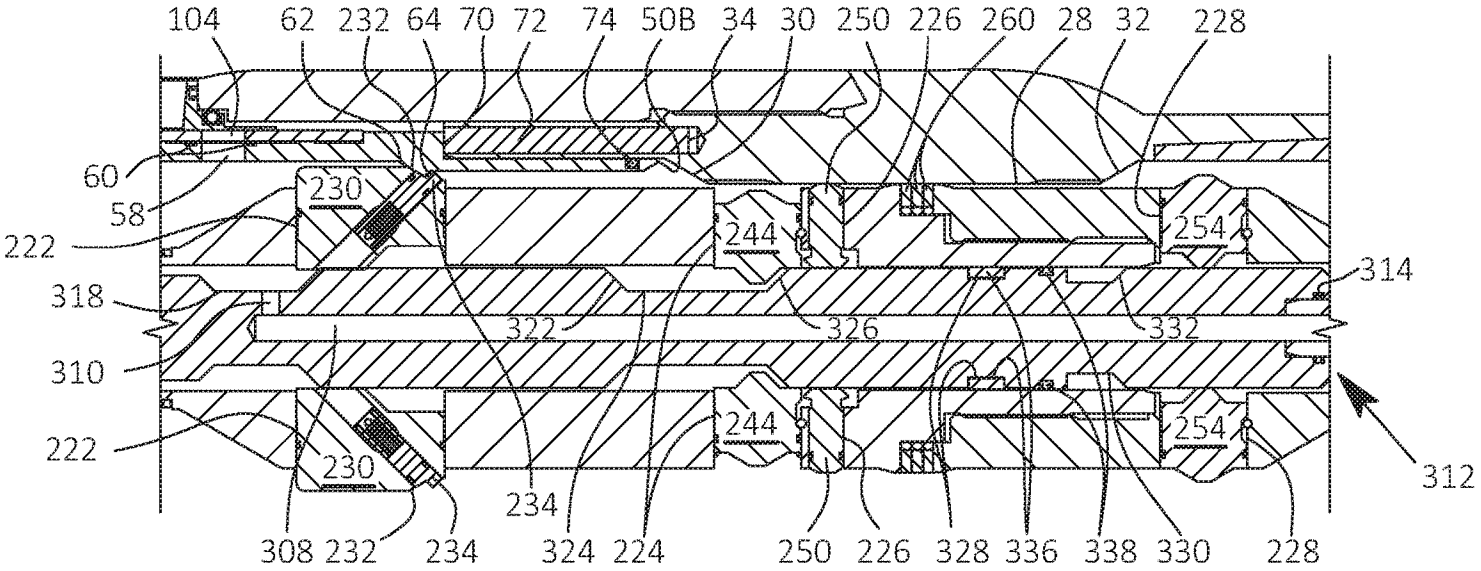
FIG. 40B is another section view of the uppermost end of the obturating tool of FIG. 6A shown in the sixth position.
Figure 41:
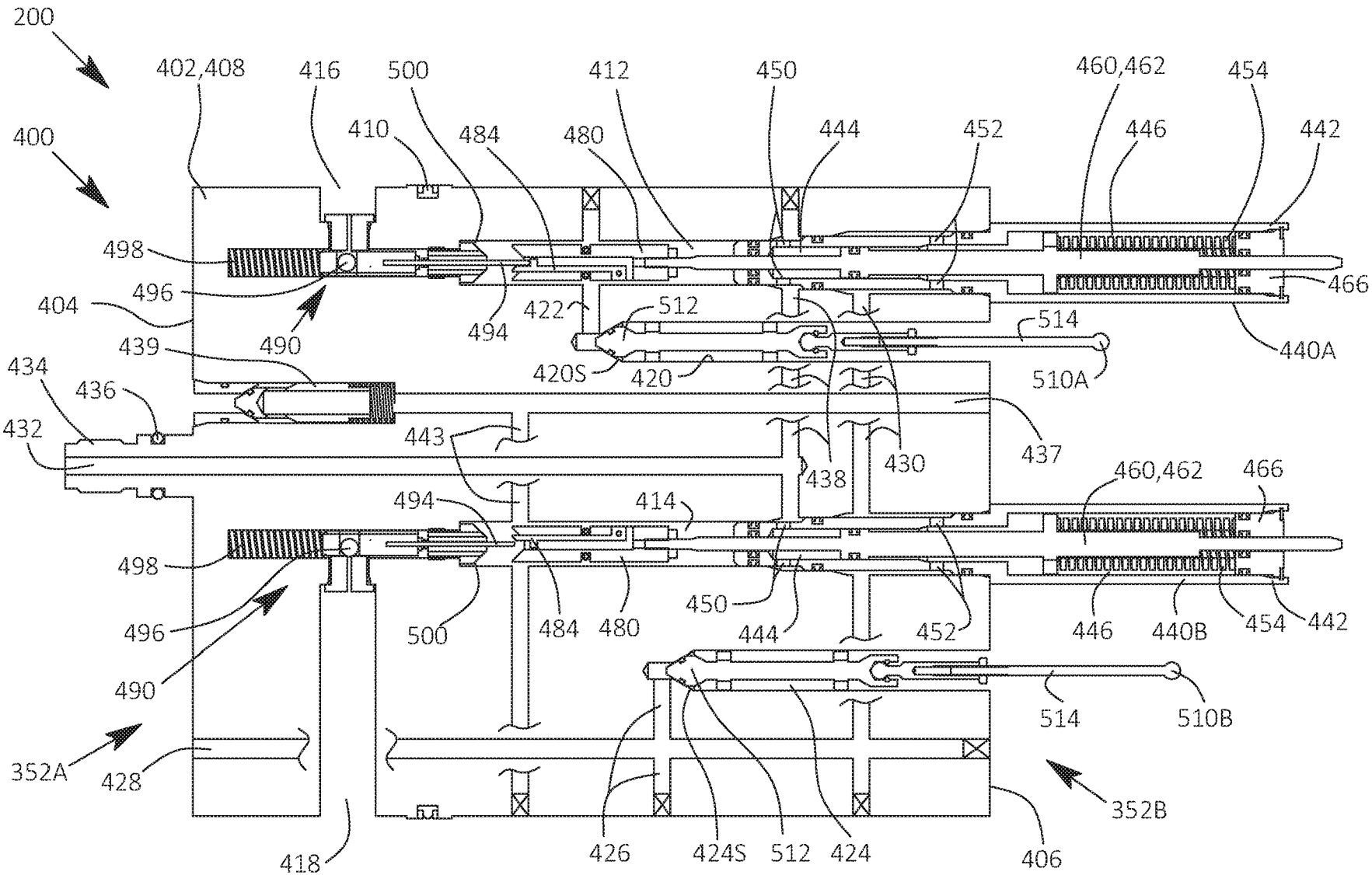
FIG. 41 is a top view of the actuation assembly of the obturating tool of FIG. 6A shown in the sixth position.
Figure 42:
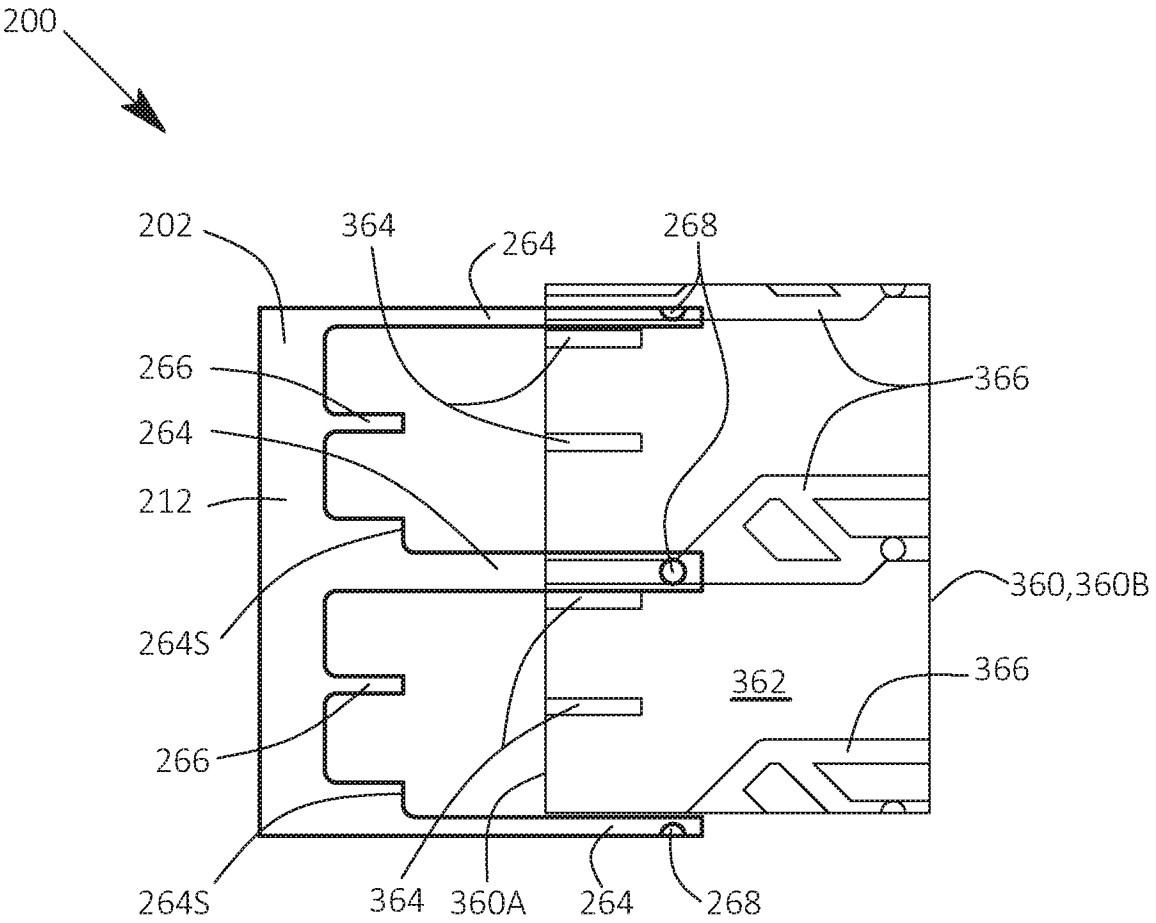
FIG. 42 is a top view of the indexer of the obturating tool of FIG. 6A shown in the sixth position.

In this position, as shown in FIGS. 40A and 40B, intermediate keys 244 are permitted to actuate into the radially inwards position received in intermediate groove 324 of core 300, thereby unlocking obturating tool 200 from the housing 12 of sliding sleeve valve 10. With obturating tool 200 unlocked from housing 12, the pressure differential remaining across piston rings 260 acts to shift obturating tool 200 and carrier member 50 (locked to tool 200 via compound keys 230) downwards in bore 18 of housing 12 until the lower end 50B of carrier member 50 engages intermediate shoulder 30 of housing 12, disposing sliding sleeve valve 10 in the lower-closed position. In the lower-closed position shown in FIGS. 40A and 40B, the sealing surface 102 of each planar member 100 sealingly engages the lower end 86 of each corresponding button 82, thereby restricting fluid communication between bores 84 of buttons 82 and bore 52 of carrier member 50.

Referring to FIGS. 40A-45, with sliding sleeve valve 10 disposed in the lower-closed position, obturating tool 200 may be released from valve 10 such that obturating tool 200 may be flow transported through bore 4B of well string 4 to the next sliding sleeve valve 10 positioned downhole from the valve 10 shown in FIGS. 40A and 40B. Particularly, to release obturating tool 200 from the carrier member 50 of sliding sleeve valve 10, core 300 must be displaced axially further downwards into bore 208 of housing 202. In the embodiment of FIGS. 40A-44, core 300 is permitted to travel further axially downwards into bore 208 by further reducing the hydraulic pressure acting against the upper end 302 of core 300.

Figure 43:
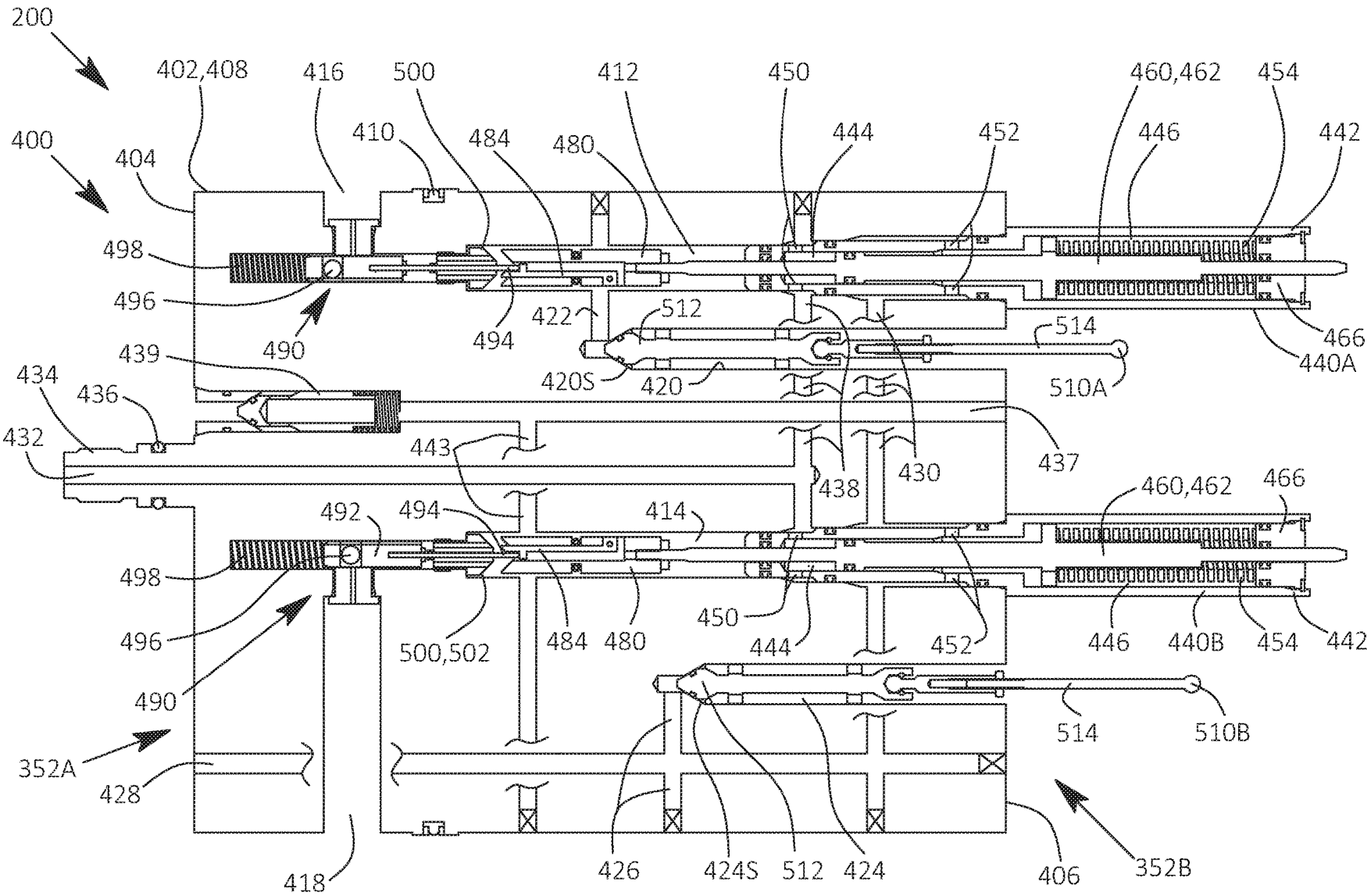
FIG. 43 is a top view of the actuation assembly of the obturating tool of FIG. 6A shown in a seventh position.
Figure 44:
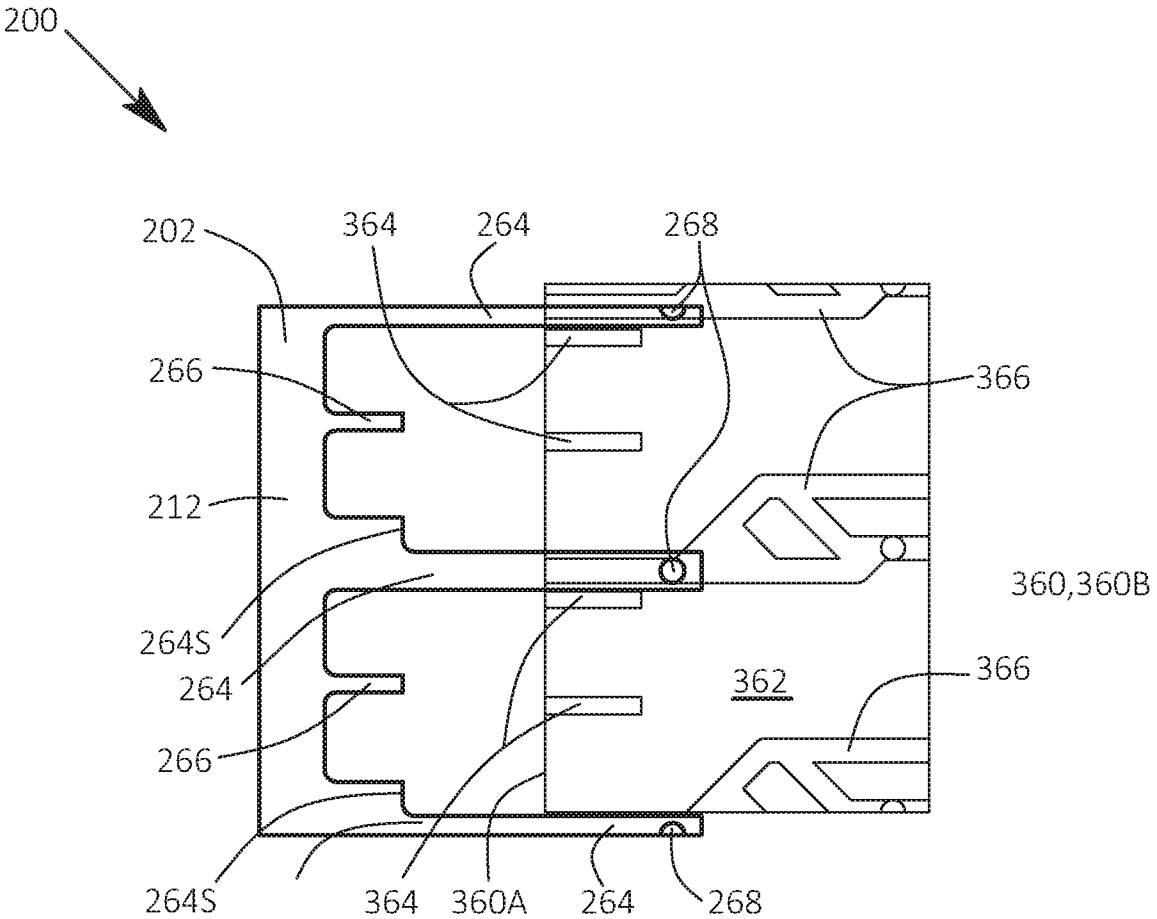
FIG. 44 is a top view of the indexer of the obturating tool of FIG. 6A shown in the seventh position.
Figure 45:
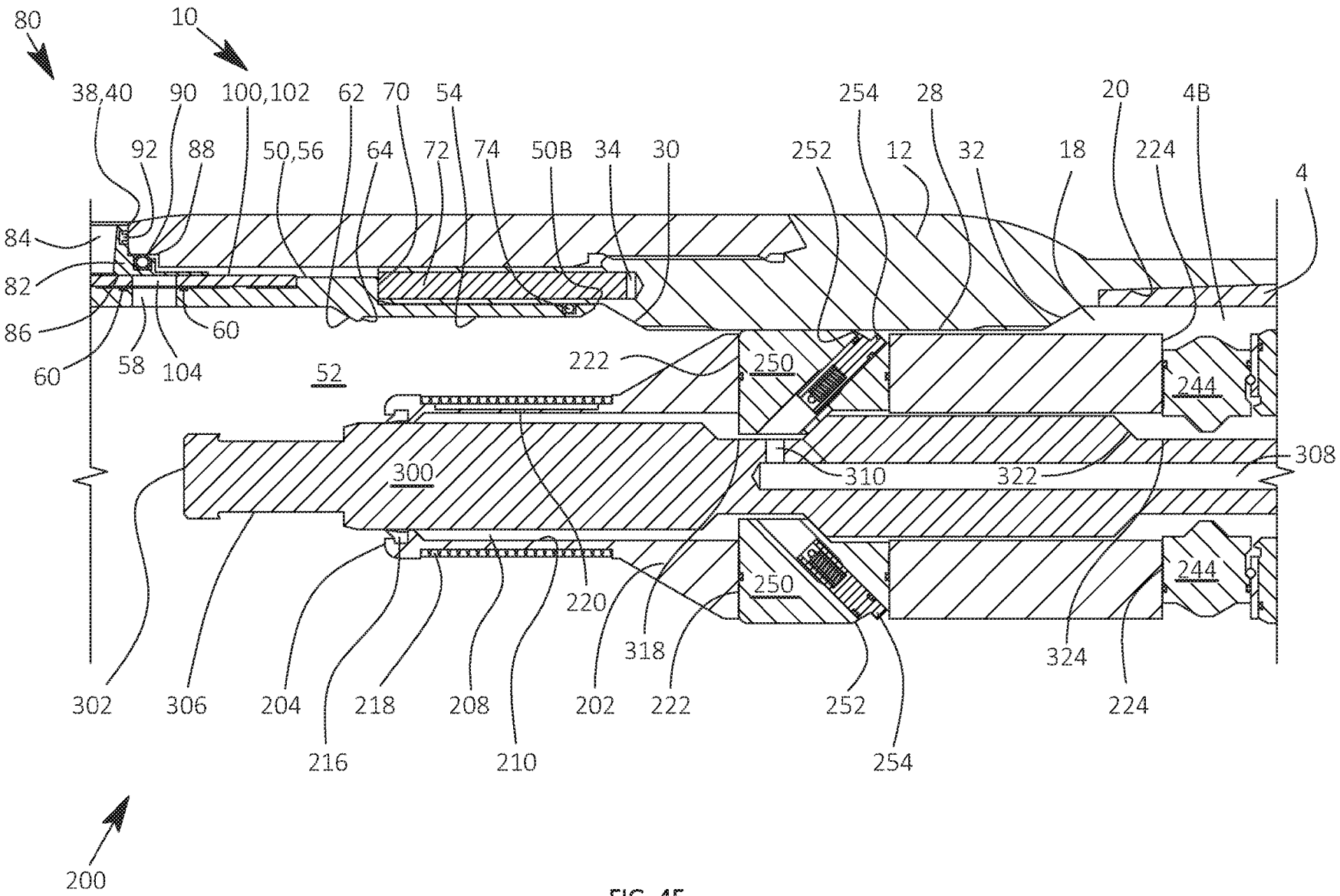
FIG. 45 is a section view of the uppermost end of the obturating tool of FIG. 6A shown in the seventh position.

As shown particularly in FIGS. 43 and 44, the further reduction in hydraulic pressure is communicated to upper chamber 444 of valve assembly 440A, which permits the biasing member 454 of valve assembly 440B to displace piston 462 axially upwards such that flapper 484 engages stem 494 and displaces obturating member 496 out of sealing engagement with second radial passage 418. With valve assembly 440B now in the open position, fluid previously trapped in lower actuation chamber 352B may be communicated to upper actuation chamber 352A via bypass passage 437, sixth radial passage 443, second valve bore 414, and second radial passage 418. As shown particularly in FIG. 45, following the opening of valve assembly 440B, core 300 is permitted to travel axially downwards through bore 208 of housing 212 until compound keys 250 are permitted to actuate into the radially inwards position received in upper groove 318 of core 300. In this position, compound keys 230 may pass through seal bore 28 of the housing 12 of sliding sleeve valve 10, thereby allowing obturating tool 200 to pass completely through the bore 18 of housing 12 as obturating tool 200 flows towards the next sliding sleeve valve 10 of well string 4. Once obturating tool 200 is released from sliding sleeve valve 10, fluid disposed in upper actuation chamber 352A is permitted to return to lower actuation chamber 352B via bypass passage 437 as core 300 returns to its original position shown in FIGS. 6A-22B.

Figure 46:
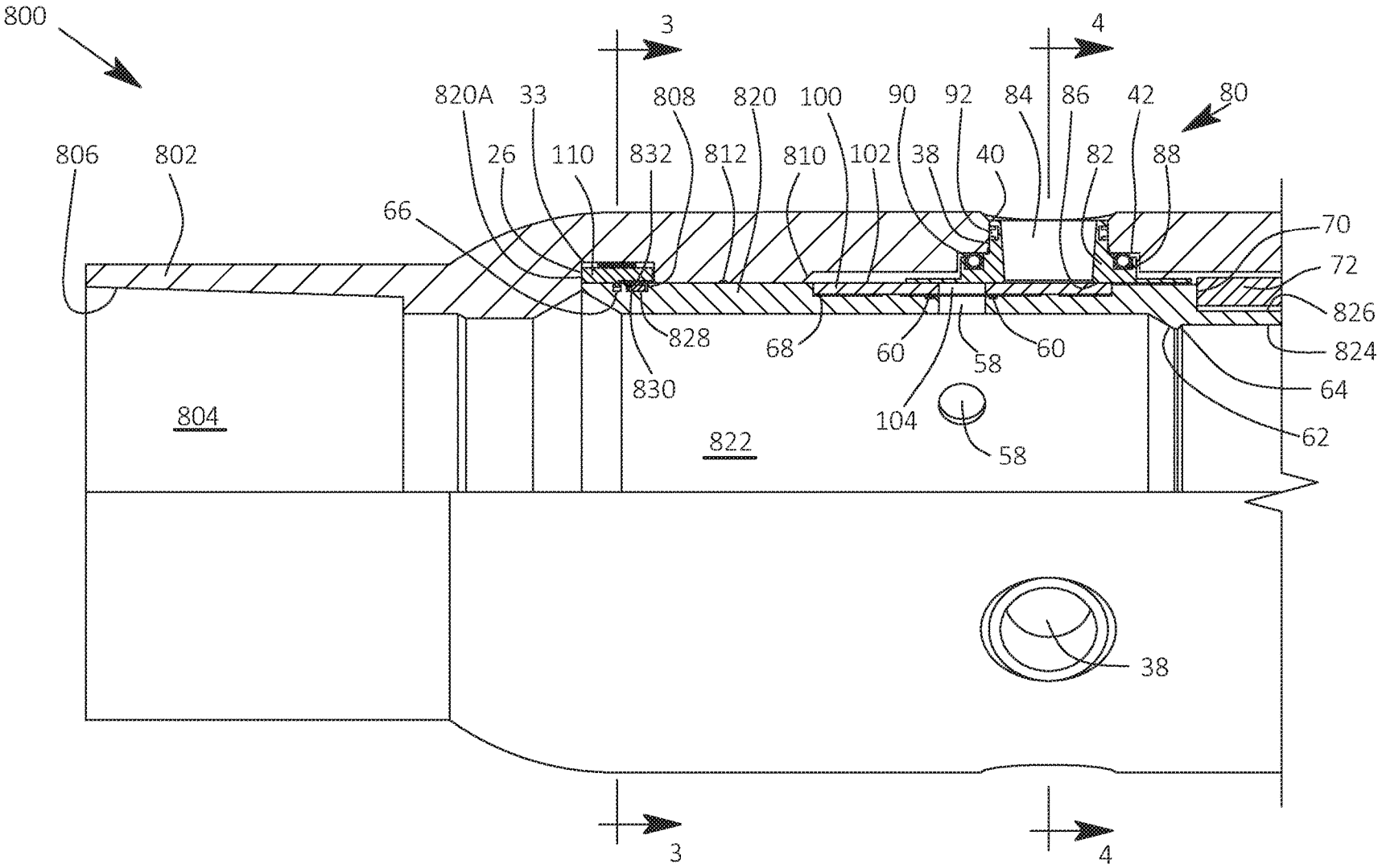
FIG. 46 is a section view of another embodiment of a sliding sleeve valve in accordance with principles disclosed herein.

Referring to FIG. 46, another embodiment of a sliding sleeve valve 800 for use with well system 1 of FIG. 1 is shown in FIG. 46. Sliding sleeve valve 800 includes features in common with sliding sleeve valve 750 shown in FIG. 31, and shared features are labeled similarly. As with sliding sleeve valve 750 described above, sliding sleeve valve 800 includes a first or upper-closed position, a second or open position, and a third or lower-closed position, and is actuatable between the upper-closed, open, and lower-closed positions via an obturating tool, such as obturating tools 200, 600, and 700 described above. Although retainer ring 110 is shown in the embodiment of FIG. 46, in other embodiments, sliding sleeve valve 800 may not include retainer ring 110. In this embodiment, sliding sleeve valve 800 generally includes a housing 802 and a carrier member 820, where housing 802 has a central bore or passage 804 defined by a generally cylindrical inner surface 806. The inner surface 806 of housing 802 includes a first or upper shoulder 808 that defines a lower end of groove 33, a second or lower annular shoulder 810, and an annular groove 812 located axially between shoulders 808 and 810.

Carrier member 820 of sliding sleeve valve 800 has a first or upper end 820A, a second or lower end, a central bore or passage 822 extending between upper end 820A and the lower end that is defined by a generally cylindrical inner surface 824, and a generally cylindrical outer surface extending between upper end 820A and the lower end. In this embodiment, outer surface 826 of carrier member 820 includes an annular groove 828 formed thereon that is disposed proximal upper end 820A. Groove 828 receives a locating ring 830 therein, where locating ring 830 includes a radially outwards extending annular shoulder or detent 832. In the upper-closed position of sliding sleeve valve 800 shown in FIG. 46, detent 832 of locating ring 830 engages the inner surface of retainer ring 110. In this embodiment, locating ring 830 comprises a C-ring having opposed ends that are disposed directly adjacent or in abutment with each other when locating ring 830 is disposed in a relaxed position where locating ring 830 is not elastically deformed by an external force. In some embodiments, locating ring 830 comprises a galling resistant material, such as Beryllium Cooper.

In this embodiment, when sliding sleeve valve 800 is actuated from the upper-closed position shown in FIG. 46 to the open position (not shown), detent 832 of locating ring 830 contacts the inner surface 806 of housing 802, thereby elastically deforming locating ring 830 to allow detent 832 to pass underneath upper shoulder 808 as carrier member 820 travels axially through bore 804 of housing 802. Carrier member 820 continues to travel through bore 804 until detent 832 axially aligns and is received in the groove 812 of housing 802, at which point the sliding sleeve valve 800 has entered the open position. In the open position of sliding sleeve valve 800, detent 832 is permitted to expand radially outwards into groove 812, thereby allowing locating ring 830 to return to its relaxed position prior to being elastically deformed during the transition of sliding sleeve valve 800 between the upper-closed and open positions. Additionally, in this embodiment, when sliding sleeve valve 800 is actuated from the open position shown to the lower-closed position, contact between detent 832 and the inner surface 806 of housing 802 again elastically deforms locating ring 830 to allow detent 832 to depart groove 812 as carrier member 820 travels axially through bore 804 of housing 802. Carrier member 820 continues to travel through bore 804 until detent 832 passes at least partially over lower shoulder 810 of housing 802, at which point the sliding sleeve valve 800 has entered the lower-closed position. In the lower-closed position, detent 832 is permitted to expand radially outwards against lower shoulder 810, thereby allowing locating ring 830 to return to its relaxed position.

Thus, like friction ring 760 of sliding sleeve valve 750 shown in FIG. 31, locating ring 830 provides a force that resists relative axial movement between carrier member 820 and housing 802 to thereby prevent carrier member 820 from being inadvertently displaced through bore 804 of housing 802. However, given that the ends of locating ring 830 are in abutment when locating ring 830 is in the relaxed position, in addition to overcoming friction between detent 832 and the inner surface 806 of housing 802, locating ring 830 must also be elastically deformed to allow carrier member 820 to travel axially relative to housing 802. In some embodiments, the material properties, physical dimensions, and/or geometry of locating ring 830 and detent 832 may be tailored to provide a predetermined resistive force that resists relative axial movement between carrier member 820 and housing 802. In this manner, locating ring 830 and detent 832 may be designed such that a predetermined axial force must be applied to carrier member 820 in order to actuate sliding sleeve valve 800 between the upper-closed, open, and lower-closed positions.

Figure 47:
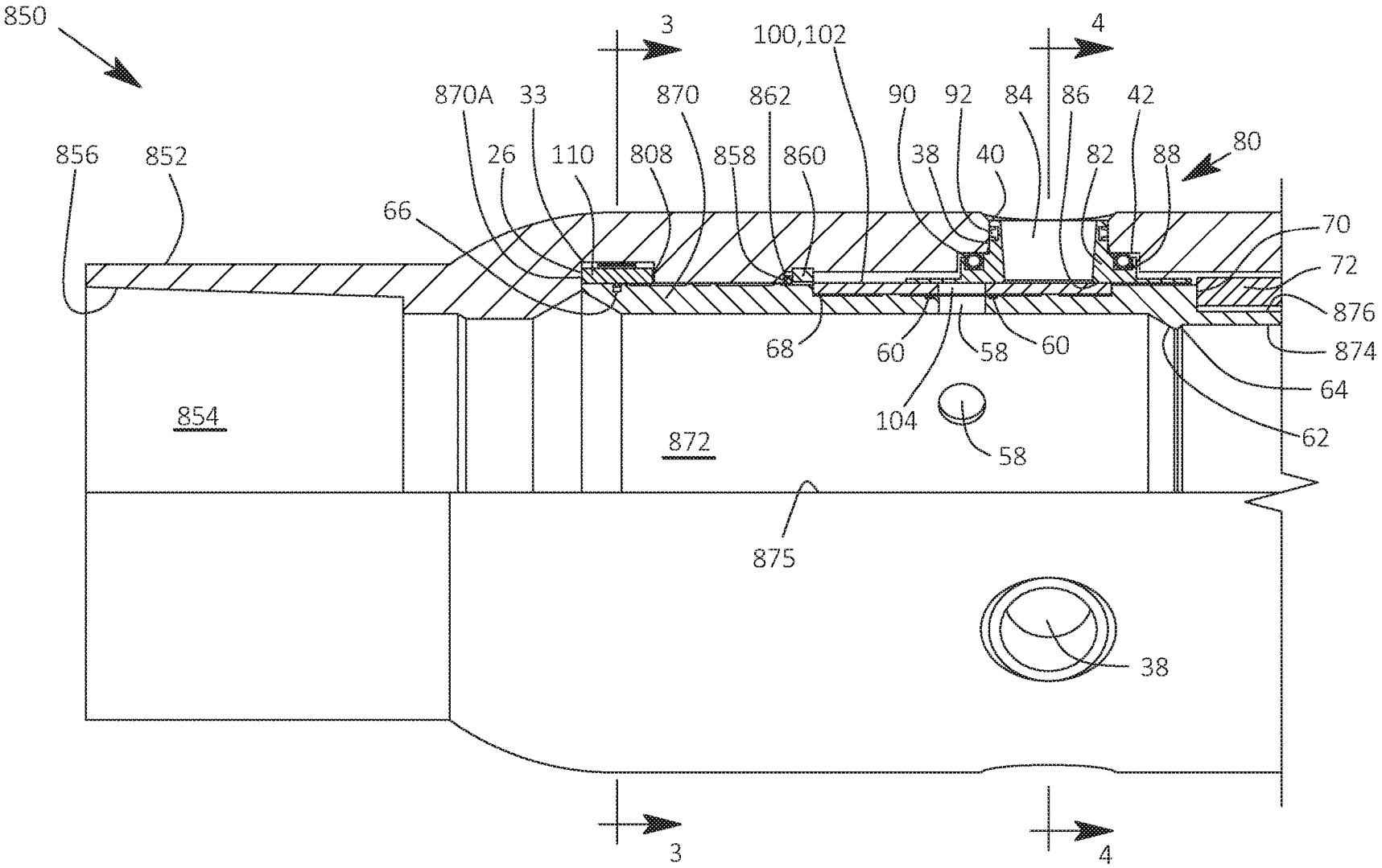
FIG. 47 is a section view of another embodiment of a sliding sleeve valve in accordance with principles disclosed herein.
Figure 48:
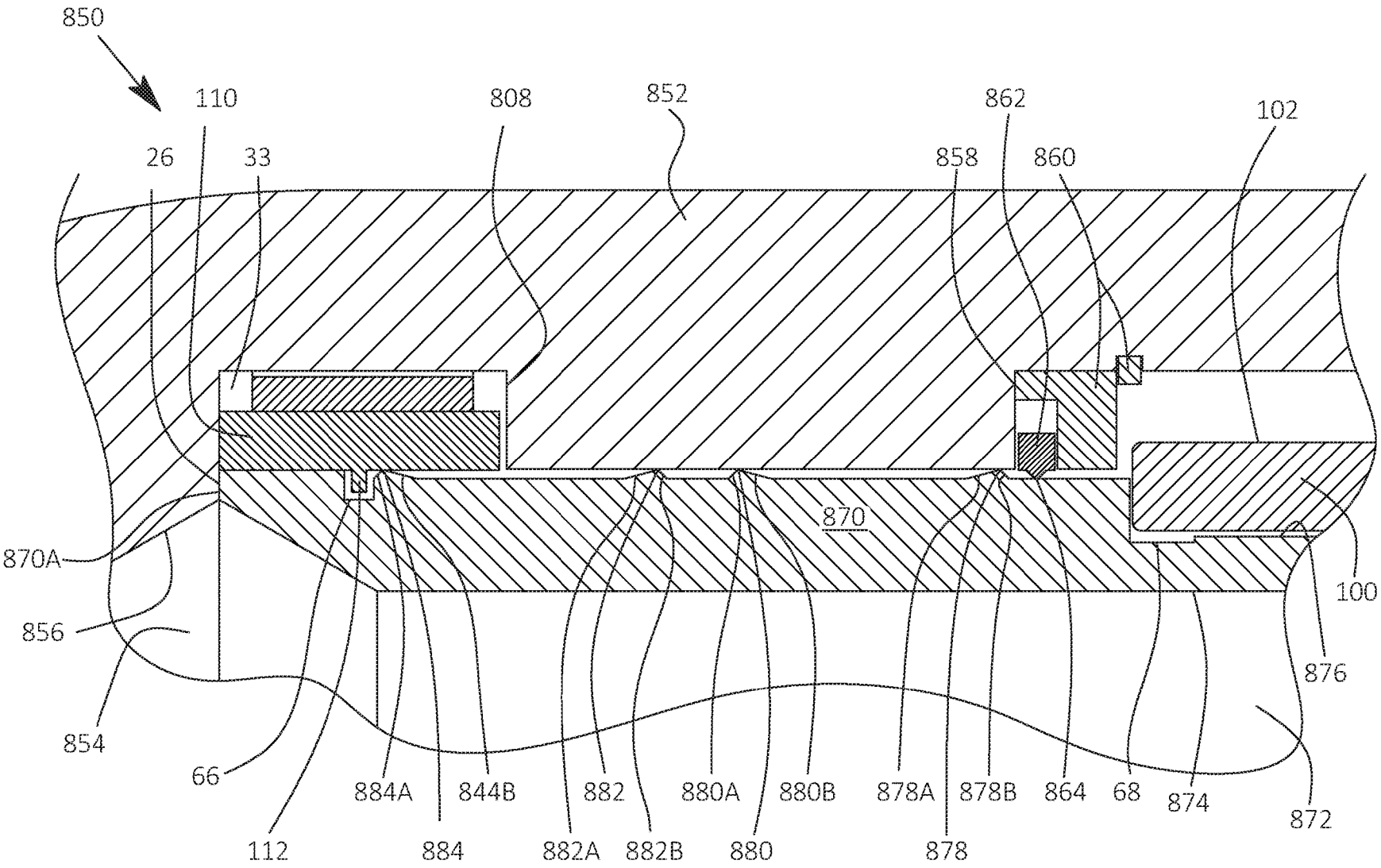
FIG. 48 is a zoomed-in section view of a detent of the sliding sleeve valve of FIG. 47.

Referring to FIGS. 47 and 48, another embodiment of a sliding sleeve valve 850 for use with well system 1 of FIG. 1 is shown in FIGS. 47 and 48. Sliding sleeve valve 850 includes features in common with sliding sleeve valve 800 shown in FIG. 46, and shared features are labeled similarly. As with sliding sleeve valve 800 described above, sliding sleeve valve 850 includes a first or upper-closed position, a second or open position, and a third or lower-closed position, and is actuatable between the upper-closed, open, and lower-closed positions via an obturating tool, such as obturating tools 200, 600, and 700 described above. Although retainer ring 110 is shown in the embodiment of FIGS. 47 and 48, in other embodiments, sliding sleeve valve 850 may not include retainer ring 110. In this embodiment, sliding sleeve valve 850 generally includes a housing 852 and a carrier member 870, where housing 852 has a central bore or passage 854 defined by a generally cylindrical inner surface 856. Inner surface 856 of housing 852 includes upper shoulder 808 and a lower shoulder 858 axially spaced from upper shoulder 808.

In this embodiment, a retention assembly 860 (including, e.g., a snap ring) retains a locating ring 862 against lower shoulder 858. Locating ring 862 includes a radially inwards extending annular shoulder or detent 864. Unlike locating ring 832 of the embodiment of sliding sleeve valve 800 shown in FIG. 46, which comprises a C-ring, locating ring 862 comprises a continuous ring or annular member. In other words, locating ring 862 extends continuously 360 degrees about the circumference of carrier member 870. Thus, in order to displace detent 864 outwards from a radially contracted position (corresponding to a relaxed position of locating ring 862) into a radially expanded position, locating ring 862 must be elastically deformed through tension via a radially outwards directed force applied against locating ring 862.

Carrier member 870 of sliding sleeve valve 850 has a longitudinal or central axis 875, a first or upper end 870A, a second or lower end, a central bore or passage 872 extending between upper end 870A and the lower end that is defined by a generally cylindrical inner surface 874, and a generally cylindrical outer surface extending between upper end 870A and the lower end. In this embodiment, the outer surface 876 of carrier member 870 includes a plurality of annular, radially outwards extending and axially spaced locators 878, 880, 882, and 884. As shown particularly in FIG. 48, locator 878 comprises a lower locator 878 and is axially positioned proximal detent 864 when sliding sleeve valve 850 is disposed in the upper-closed position. Locators 880 and 882 comprise intermediate locators 880 and 882, and are axially positioned between lower locator 878 and locator 884, which comprises an upper locator 884. Upper locator 884 is positioned directly adjacent groove 66 of carrier member 870, and intermediate locator 882 is positioned axially between upper locator 884 and intermediate locator 880. In this embodiment, each locator 878-882 is defined by a corresponding pair of annular, sloped or frustoconical shoulders: upper shoulder 878A and lower shoulder 878B for lower locator 878, upper shoulder 880A and lower shoulder 880B for intermediate locator 880, upper shoulder 882A and lower shoulder 882B for intermediate locator 882, and upper shoulder 884A and lower shoulder 884B for upper locator 884, respectively.

In this embodiment, when sliding sleeve valve 850 is actuated from the upper-closed position shown in FIGS. 47 and 48 to the open position (not shown), detent 864 of locating ring 862 contacts the lower shoulder 878B of lower locator 878, elastically deforming locating ring 862 to allow detent 864 to expand into the radially expanded position and pass over lower locator 878 as carrier member 870 travels axially through bore 854 of housing 852. As carrier member 870 continues to travel axially through bore 854, detent 864 is allowed to return to the radially contracted position as it descends upper shoulder 878A of lower locator 878, allowing locating ring 862 to relax back into its relaxed position. Additionally, as carrier member 850 nears the axial position in bore 854 corresponding to the open position of sliding sleeve valve 850, detent 864 contacts the lower shoulder 880B of intermediate locator 880, forcing detent 864 into the radially expanded position, again elastically deforming locating ring 862. As detent 864 descends the upper shoulder 880A of intermediate locator 880, detent 864 is again allowed to return to the radially contracted position, relaxing locating ring 862 and disposing sliding sleeve valve 850 in the open position with detent 864 located axially between intermediate locators 880 and 882.

In this embodiment, when sliding sleeve valve 850 is actuated from the open position shown to the lower-closed position, detent 864 contacts the lower shoulder 882B of intermediate locator 882, elastically deforming locating ring 862 to allow detent 864 to expand into the radially expanded position and pass over lower locator 878 as carrier member 870 travels axially further through bore 854 of housing 852. As carrier member 870 continues to travel axially through bore 854, detent 864 is allowed to return to the radially contracted position, relaxing locating ring 862, as detent 864 descends upper shoulder 882A of intermediate locator 882. Additionally, as carrier member 850 nears the axial position in bore 854 corresponding to the lower-closed position of sliding sleeve valve 850, detent 864 contacts the lower shoulder 884B of upper locator 884, forcing detent 864 into the radially expanded position, elastically deforming locating ring 862. As detent 864 descends the upper shoulder 884A of upper locator 884, detent 864 is allowed to return to the radially contracted position, relaxing locating ring 862 and disposing sliding sleeve valve 850 in the lower-closed position with detent 864 received in groove 66 of carrier member 850.

Thus, like locating ring 830 and detent 832 of the sliding sleeve valve 800 shown in FIG. 46, locating ring 862 provides a resistive force to resist relative axial movement between carrier member 870 and housing 802 and thereby prevent carrier member 870 from being inadvertently displaced through bore 854 of housing 852. However, unlike sliding sleeve valve 800, locating ring 862 does not continuously apply a resistive force for the majority of the axial length carrier member 870 travels through bore 854 of housing 852 as sliding sleeve valve 850 is actuated between the upper-closed, open, and lower-closed positions. For instance, when sliding sleeve valve 850 is actuated between the upper-closed and open positions, locating ring 862 only provides a resistive force when detent 864 travels over lower locator 878 and intermediate locator 880. In other words, locating ring 862 does not apply a resistive force (due to elastic deformation of locating ring 862) when detent 864 travels through the axial space formed between the upper shoulder 878A of lower locator 878 and the lower shoulder 880B of intermediate locator 880. Similarly, when sliding sleeve valve 850 is actuated between the open and lower-closed positions, locating ring 862 only provides a resistive force when detent 864 travels over intermediate locator 882 and upper locator 884. Thus, locating ring 862 does not apply a resistive force (due to elastic deformation of locating ring 862) when detent 864 travels through the axial space formed between the upper shoulder 882A of intermediate locator 882 and the lower shoulder 884B of upper locator 884.

In some applications, it may be advantageous to apply a resistive force for only a portion or minority of the axial length the carrier member 870 travels through the housing 852 as the sliding sleeve valve 850 actuates between the upper-closed, open, and lower-closed positions. For instance, in some applications such a configuration may achieve the benefit of preventing inadvertent actuation of sliding sleeve valve 850 between the upper-closed, open, and lower-closed positions while reducing the wear applied to components of sliding sleeve valve 850 and/or the amount of work or energy that must be expended on actuating sliding sleeve valve 850. However, in other applications, it may be beneficial to continuously apply a resistive force for the entire, or at least the majority of, the axial length along which the carrier member or sliding sleeve of the sliding sleeve valve (e.g., carrier members 820 and 870 of sliding sleeve valves 800 and 850, respectively) travels during the actuation of the sliding sleeve valve between its open and closed positions.

In this embodiment, the upper and lower frustoconical shoulders that define locators 878-884 are disposed or extend at varying angles relative to the central axis 875 of carrier member 870. Particularly: lower shoulder 878B of lower locator 878 is disposed at a greater angle from central axis 875 than upper shoulder 878A (e.g., the surface defining upper shoulder 878A is disposed more parallel with central axis 875 than the surface defining lower shoulder 878B), upper shoulder 880A of intermediate locator 880 is disposed at a greater angle from central axis 875 than lower shoulder 880B, lower shoulder 882B of intermediate locator 882 is disposed at a greater angle from central axis 875 than upper shoulder 882A, and upper shoulder 884A of upper locator 884 is disposed at a greater angle from central axis 875 than lower shoulder 884B. In some embodiments, shoulders 878B, 880A, 882B, and 884A are disposed at a first angle from central axis 875 while shoulders 878A, 880B, 882A, and 884B are disposed at a second angle from central axis 875 that is less than the first angle. In other embodiments, the first angle may be the same or similar as the second angle.

In some applications, the different angles from which the shoulders of locators 878-882 are disposed from central axis 875 reduces the amount of wear to sliding sleeve valve 850 during operation by allowing locating ring 862 to gradually return to its relaxed position. For example, at a given rate of relative axial movement between carrier member 870 and housing 802, an inner diameter of detent 864 must change more rapidly as detent 864 passes over lower shoulder 878B (forcing the diameter of detent 864 to expand and elastically deforming locating ring 862) of lower locator 878 than when detent 864 passes over upper shoulder 878A (allowing the diameter of detent 862 to contract, relaxing locating ring 862). The smaller angle of upper shoulder 878A from central axis 875 relative lower shoulder 878B allows for a more gradual reduction in the change of the diameter of detent 864, elastic deformation in locating ring 862, and the degree of resistive force applied by locating ring 862 than if upper shoulder 878A were disposed at the same angle as lower shoulder 878B. The gradual reduction in elastic deformation of locating ring 862 may reduce the potential of damaging locating ring 862 during operation and any shock to sliding sleeve valve 850 (or the tool used to actuate sliding sleeve valve 850) resulting from the reduction in resistive force applied by locating ring 862. Similarly, the reduced angle at which lower shoulder 880B of intermediate locator 880 is disposed from central axis 875 reduces the shock from the increase in resistive force applied by locating ring 862 as detent 864 travels over lower shoulder 880B. Additionally, the relatively larger angle of upper shoulder 880A of intermediate locator 880 assists in retaining sliding sleeve valve 850 in the open position by assisting to trap (along with lower shoulder 882B of intermediate locator 882) detent 864 of locating ring 862 between the intermediate locators 880 and 882.

Figure 49:
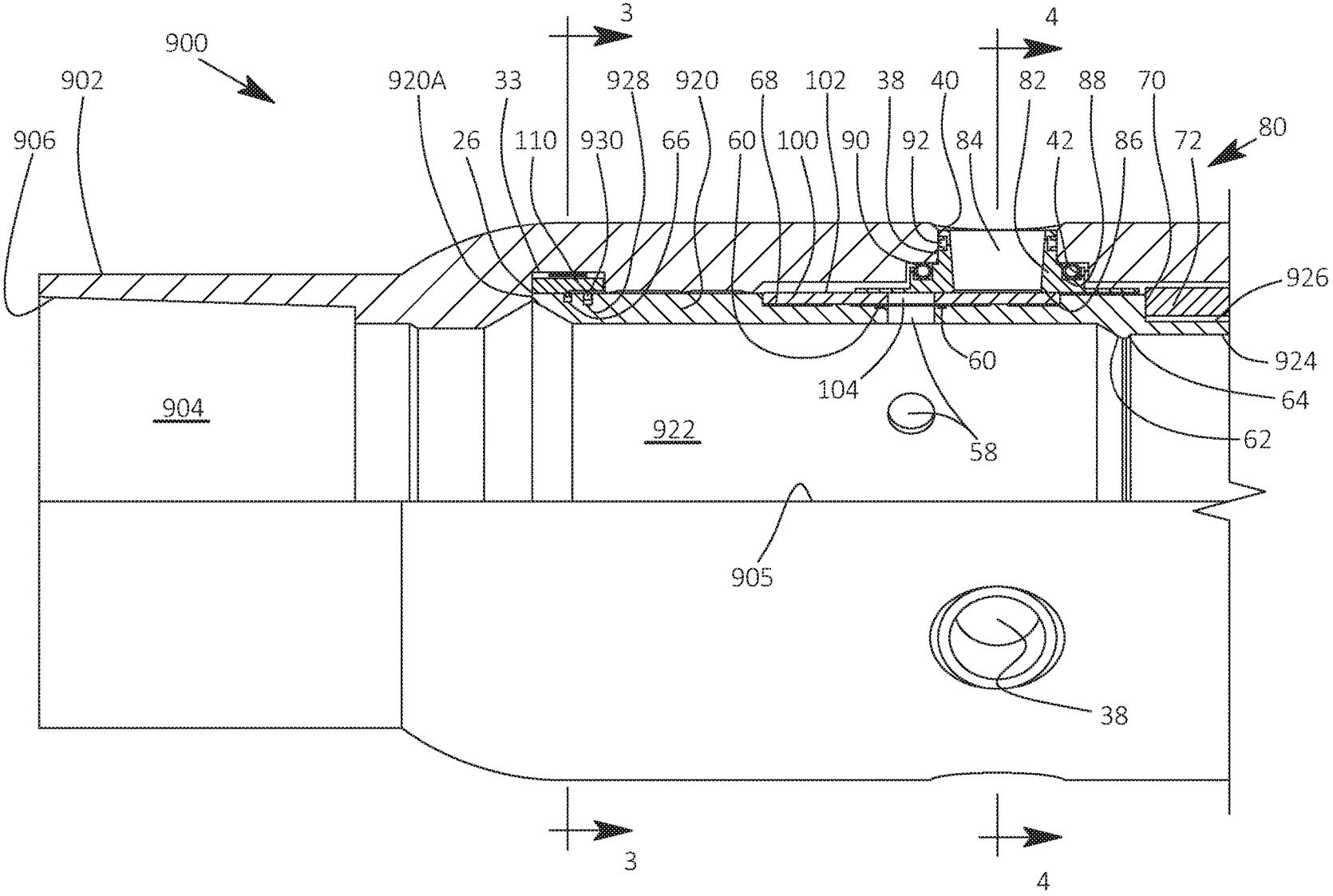
FIG. 49 is a section view of another embodiment of a sliding sleeve valve in accordance with principles disclosed herein.
Figure 50:
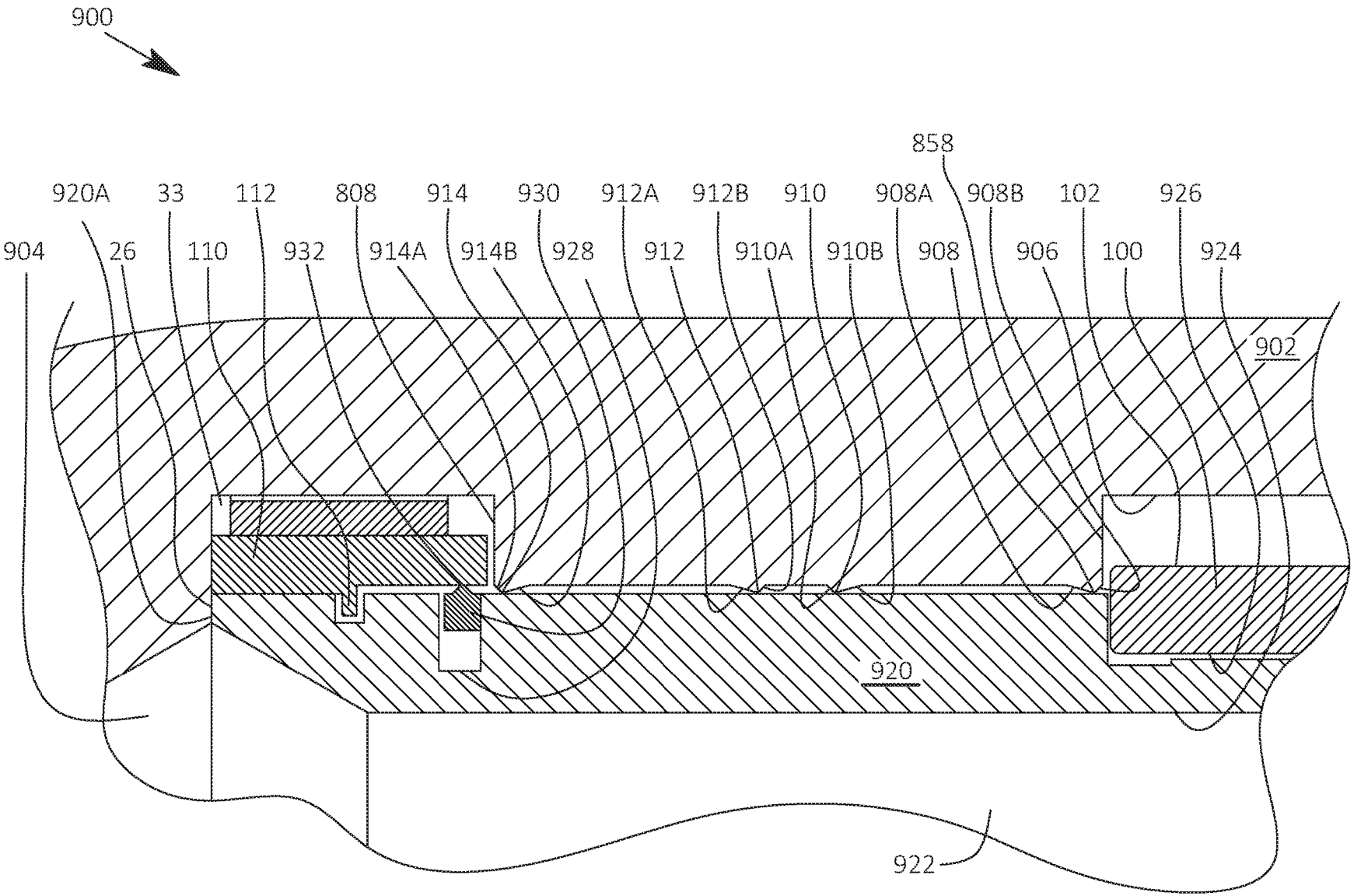
FIG. 50 is a zoomed-in section view of a detent of the sliding sleeve valve of FIG. 49.

Referring to FIGS. 49 and 50, another embodiment of a sliding sleeve valve 900 for use with well system 1 of FIG. 1 is shown in FIGS. 49 and 50. Sliding sleeve valve 900 includes features in common with sliding sleeve valve 850 shown in FIGS. 47 and 48, and shared features are labeled similarly. As with sliding sleeve valve 850 described above, sliding sleeve valve 900 includes a first or upper-closed position, a second or open position, and a third or lower-closed position, and is actuatable between the upper-closed, open, and lower-closed positions via an obturating tool, such as obturating tools 200, 600, and 700 described above. Although retainer ring 110 is shown in the embodiment of FIGS. 49 and 50, in other embodiments, sliding sleeve valve 900 may not include retainer ring 110. In this embodiment, sliding sleeve valve 900 generally includes a housing 902 and a carrier member 920, where housing 902 has a central or longitudinal axis 905, and a central bore or passage 904 defined by a generally cylindrical inner surface 906. Carrier member 920 of sliding sleeve valve 900 has a first or upper end 920A, a second or lower end, a central bore or passage 922 extending between upper end 920A and the lower end that is defined by a generally cylindrical inner surface 924, and a generally cylindrical outer surface extending between upper end 920A and the lower end.

Sliding sleeve valve 900 is similar in configuration as sliding sleeve valve 850, except that in this embodiment, the inner surface 906 of housing 902 includes a plurality of annular, radially inwards extending and axially spaced locators 908, 910, 912, and 914, while carrier member 920 includes an annular groove 928 that receives a locating ring 930 having an annular shoulder or detent 932 extending radially outwards therefrom. In this embodiment, locating ring 930 comprises a continuous ring extending 360 degrees about carrier member 920. As shown particularly in FIG. 50: locator 908 comprises a lower locator 908 and is position directly adjacent lower shoulder 858, locators 910 and 912 comprise intermediate locators 910 and 912, and are axially positioned between lower locator 908 and locator 914, which comprises an upper locator 914 that is positioned directly adjacent upper shoulder 808. Additionally, each locator 908-914 is defined by a corresponding pair of annular, sloped or frustoconical shoulders: upper shoulder 908A and lower shoulder 908B for lower locator 908, upper shoulder 910A and lower shoulder 910B for intermediate locator 910, upper shoulder 912A and lower shoulder 912B for intermediate locator 912, and upper shoulder 914A and lower shoulder 914B for upper locator 914, respectively. Further, in this embodiment, shoulders 908B, 910A, 912B, and 914A are disposed at a first angle from central axis 905 of housing 902 while shoulders 908A, 910B, 912A, and 914B are disposed at a second angle from central axis 905 that is less than the first angle. In other embodiments, the first angle may be the same or similar as the second angle.

Figure 51A:
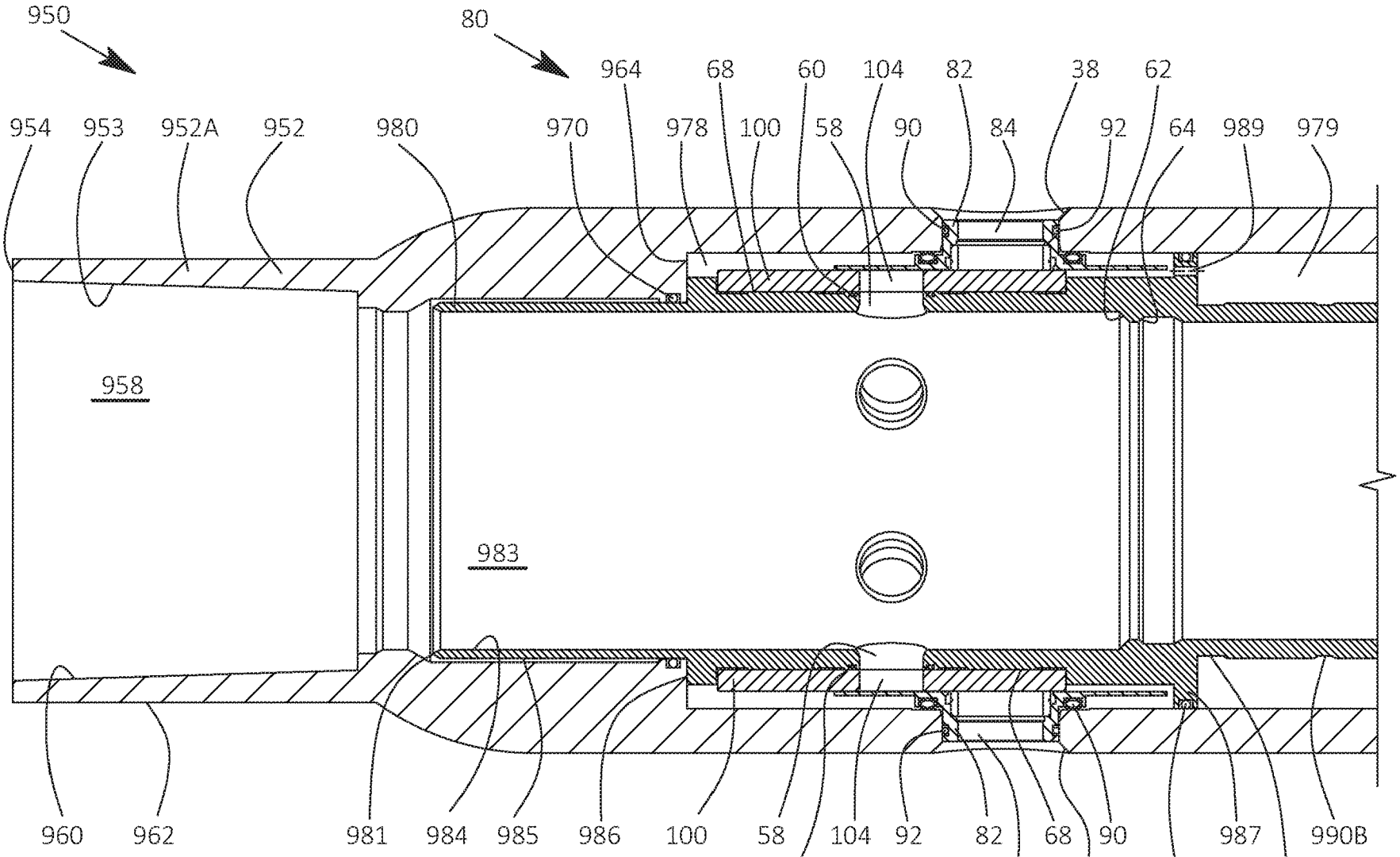
FIG. 51A is a section view of an uppermost end of another embodiment of a sliding sleeve valve in accordance with principles disclosed herein.
Figure 51B:
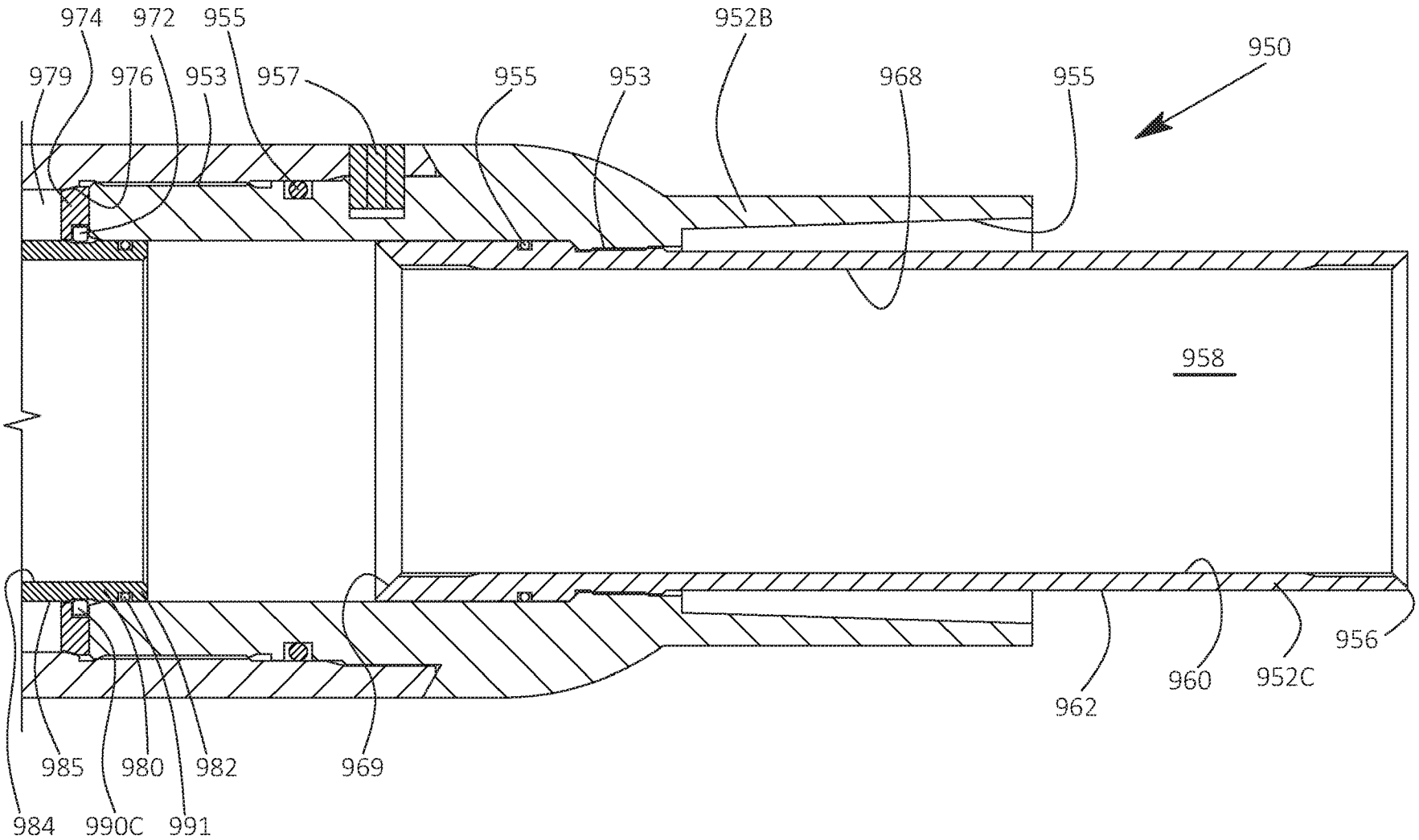
FIG. 51B is a section view of a lowermost end of the sliding sleeve valve shown in FIG. 51A.
Figure 52A:
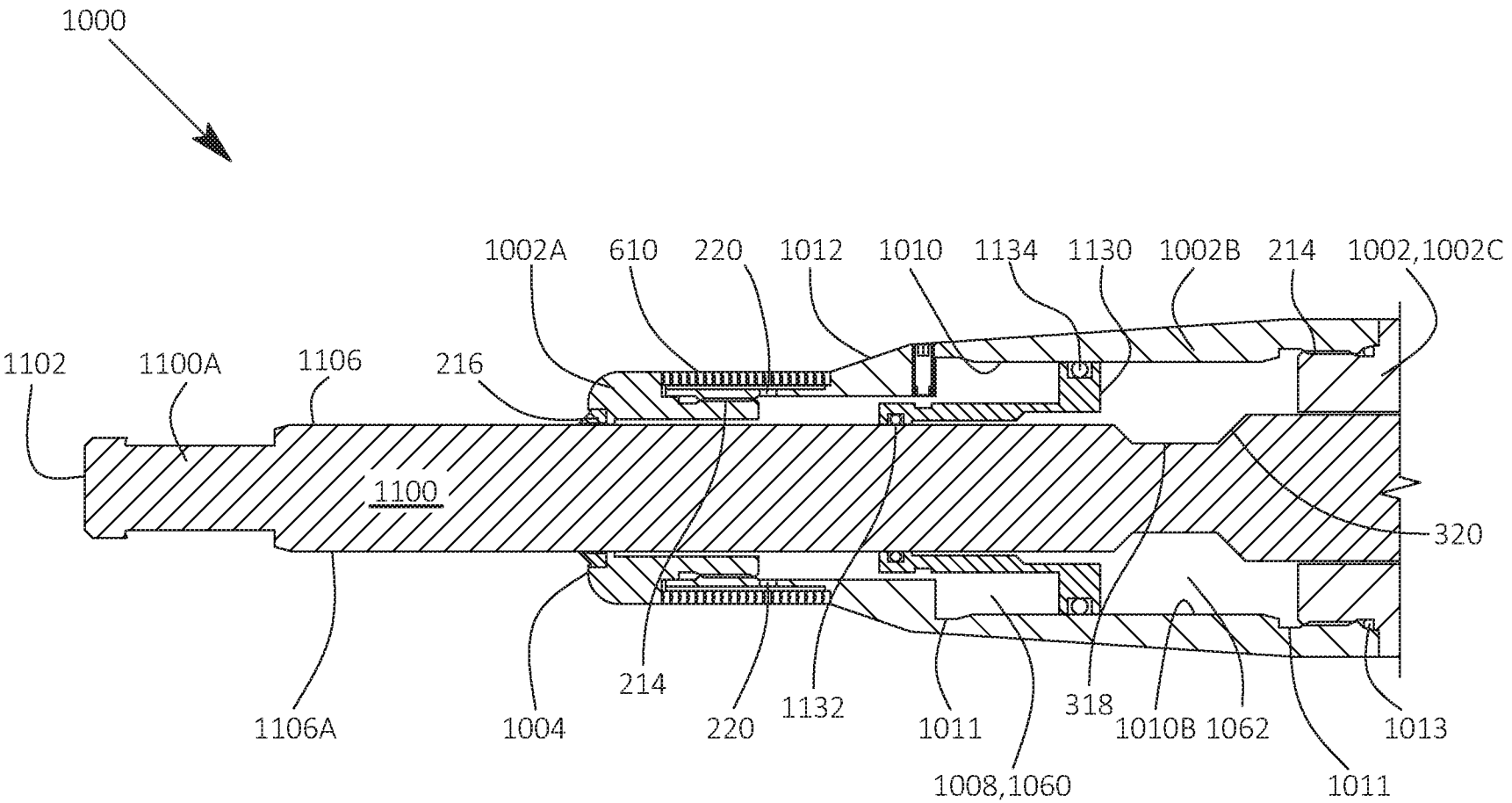
FIG. 52A is a section view along lines 52-52 of FIG. 63 of the uppermost end of an embodiment of a flow transported obturating tool for actuating a sliding sleeve valve in accordance with principles disclosed herein.
Figure 52B:
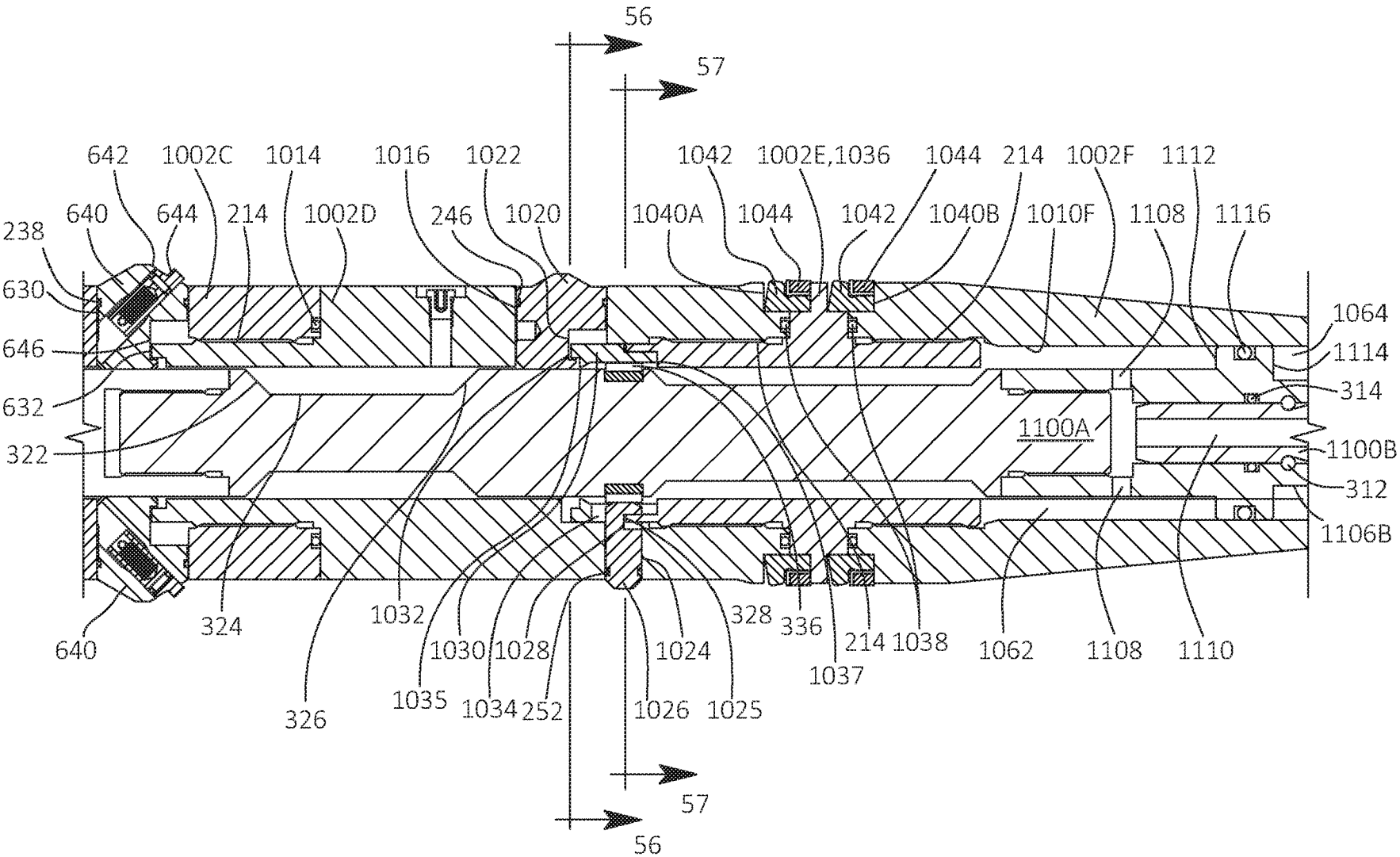
FIG. 52B is a section view along lines 52-52 of FIG. 63 of an intermediate section of the obturating tool shown in FIG. 51A.
Figure 52C:
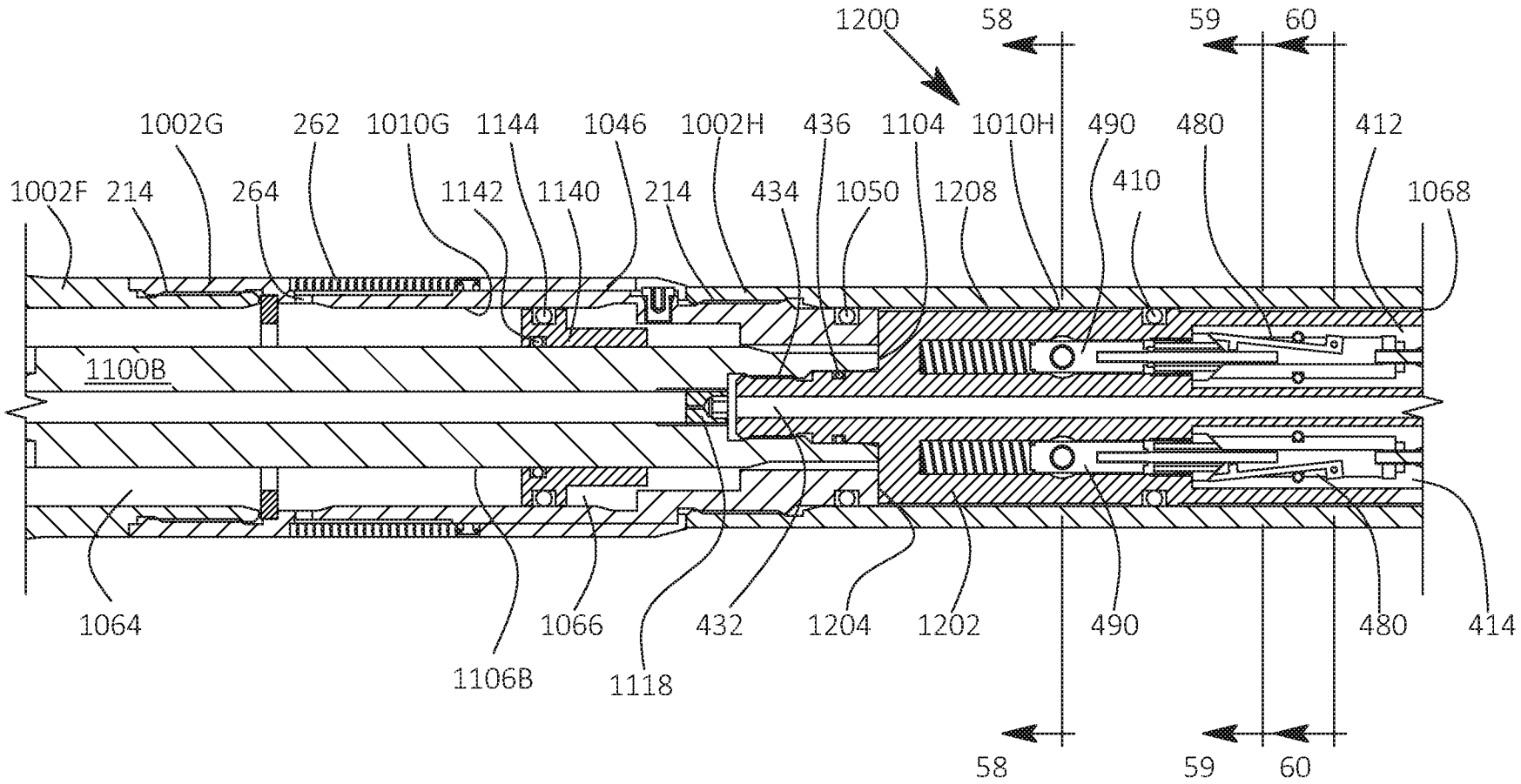
FIG. 52C is a section view along lines 52-52 of FIG. 63 of another intermediate section of the obturating tool shown in FIG. 52A.
Figure 52D:
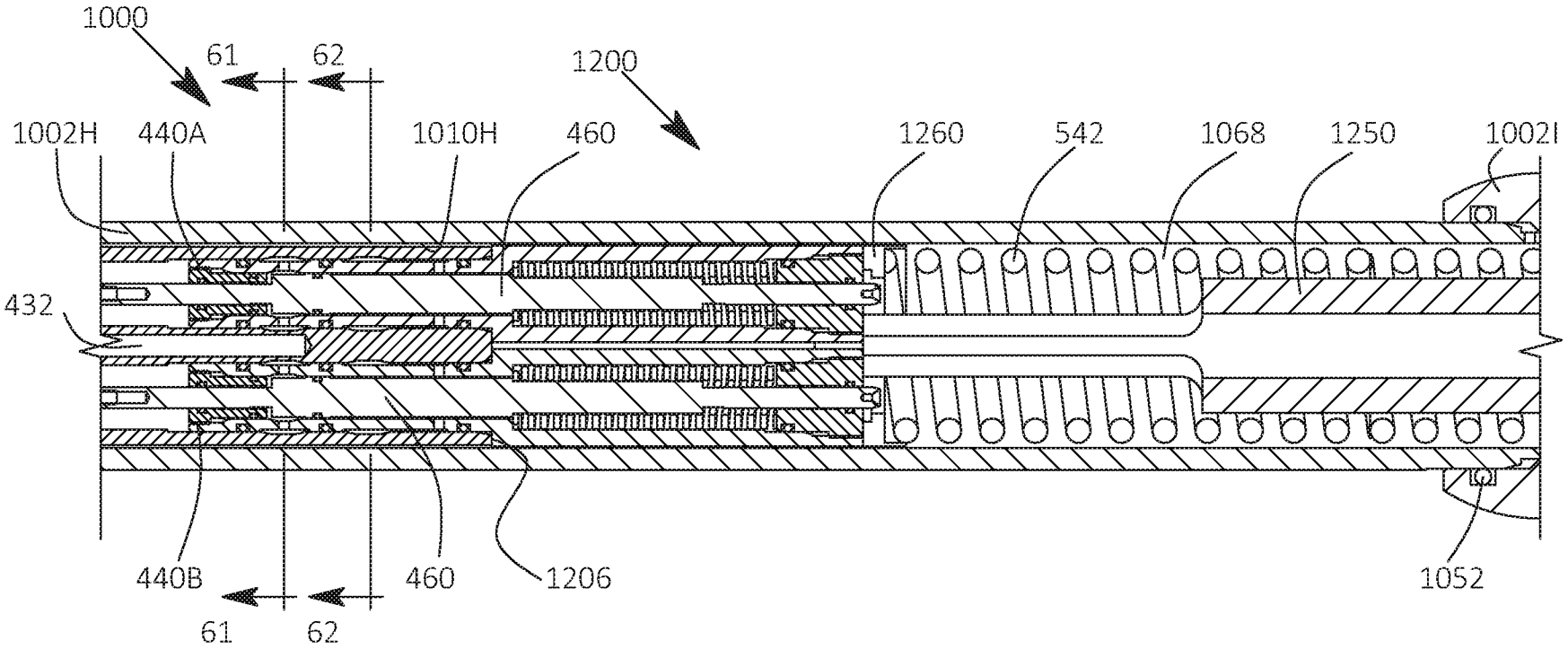
FIG. 52D is a section view along lines 52-52 of FIG. 63 of another intermediate section of the obturating tool shown in FIG. 52A.
Figure 52E:
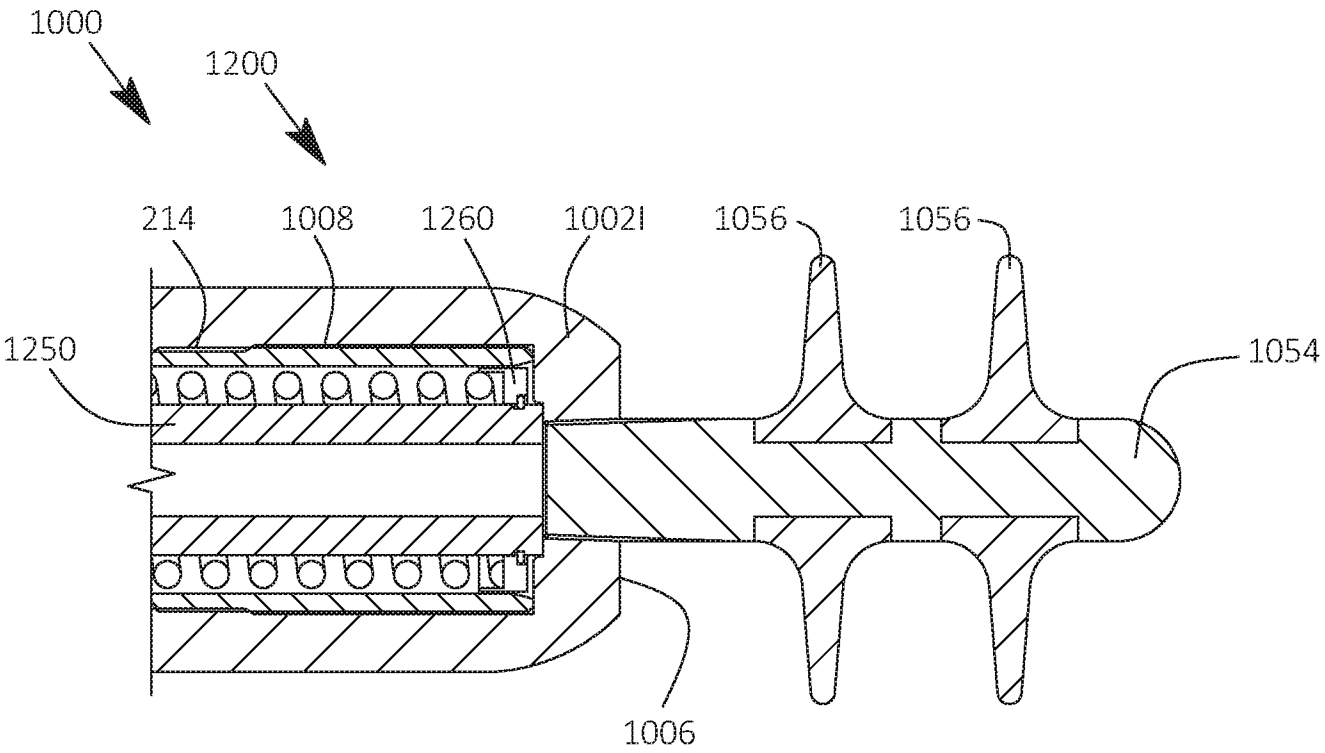
FIG. 52E is a section view along lines 52-52 of FIG. 63 of the lowermost end of the obturating tool shown in FIG. 52A.
Figure 53A:
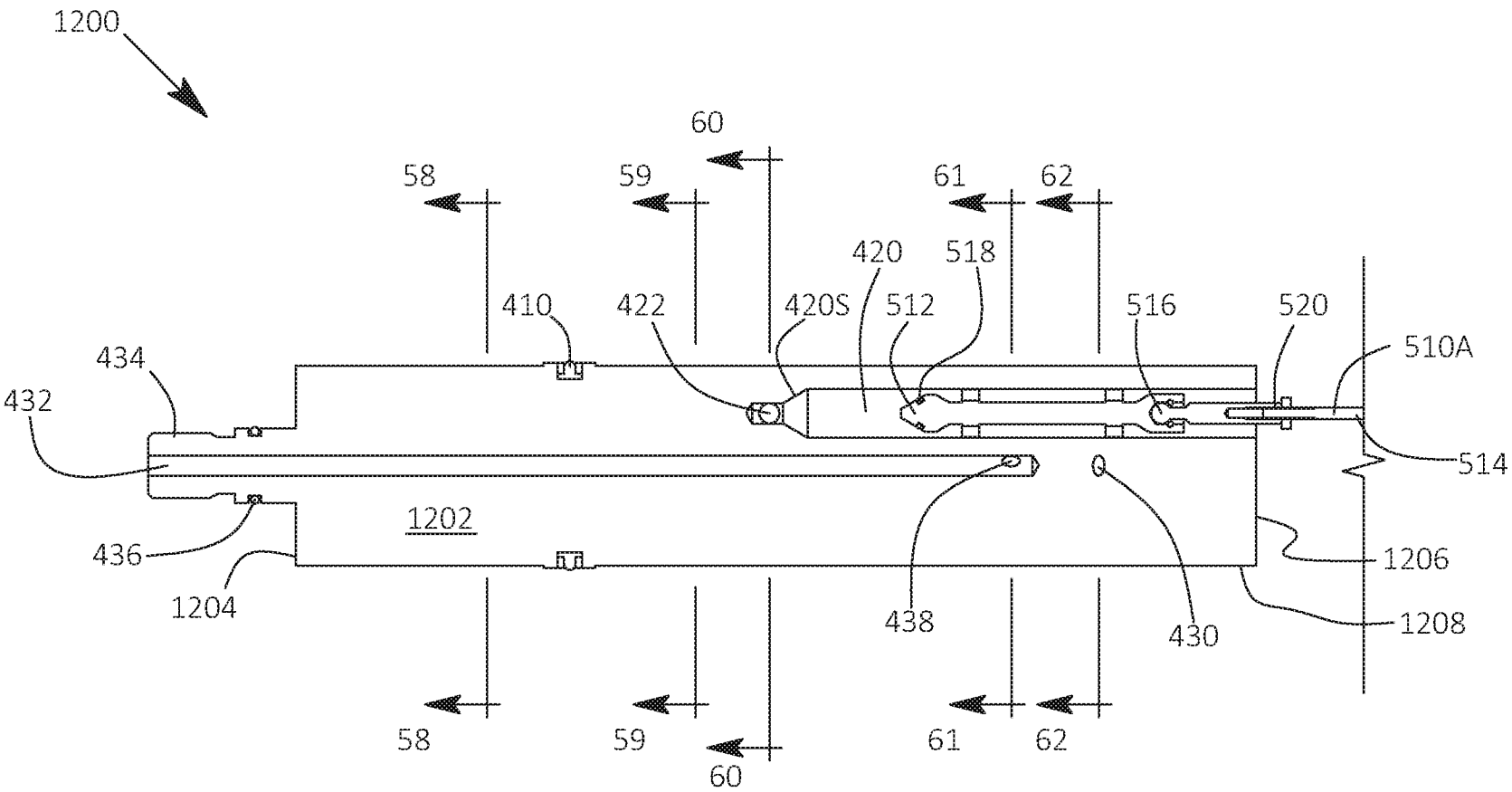
FIG. 53A is a section view along lines 53-53 of FIG. 63 of an uppermost end of an embodiment of an actuation assembly of the obturating tool of FIGS. 52A-52E in accordance with principles disclosed herein.
Figure 53B:
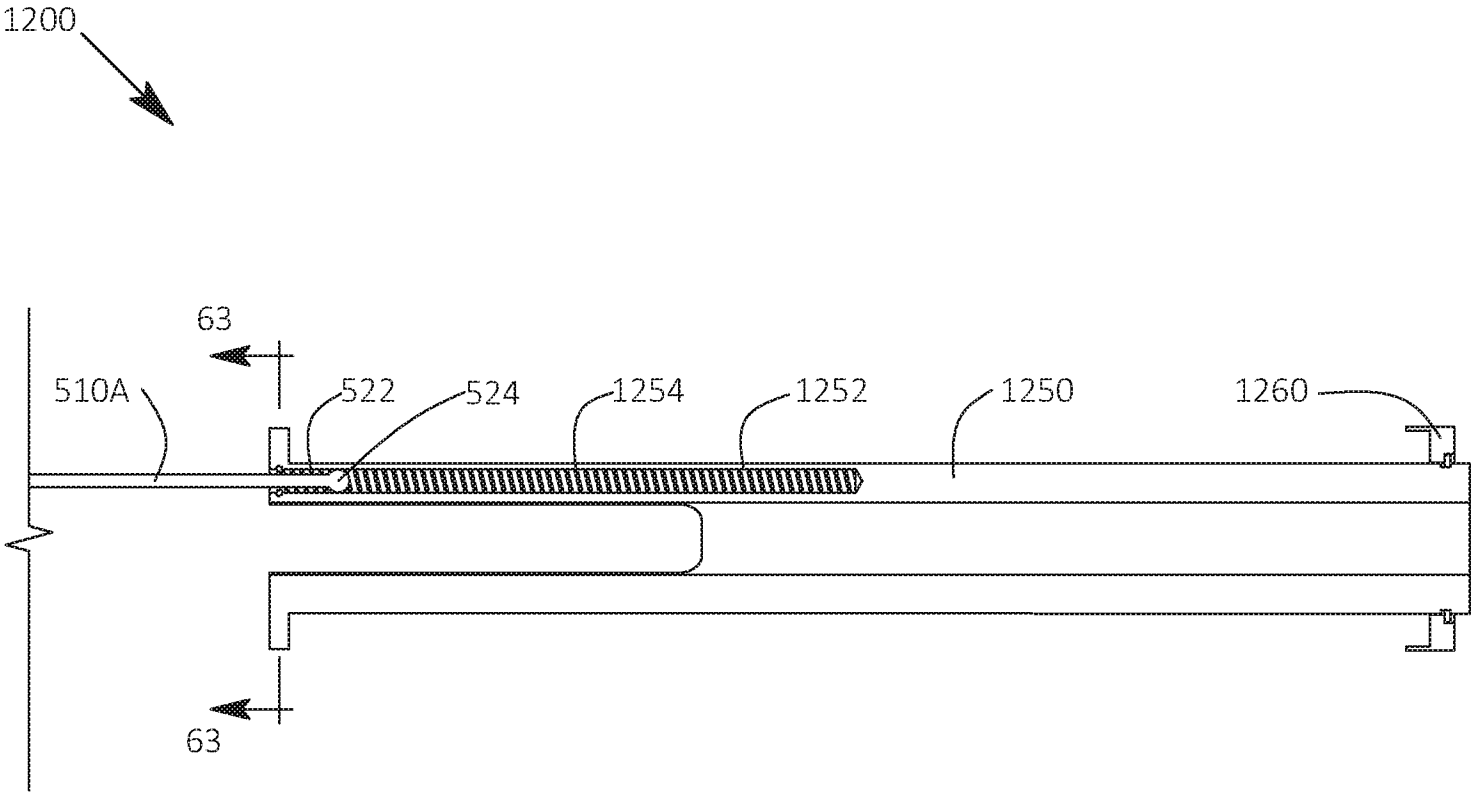
FIG. 53B is a section view along lines 53-53 of FIG. 63 of a lowermost end of the actuation assembly of FIG. 53A.
Figure 54:
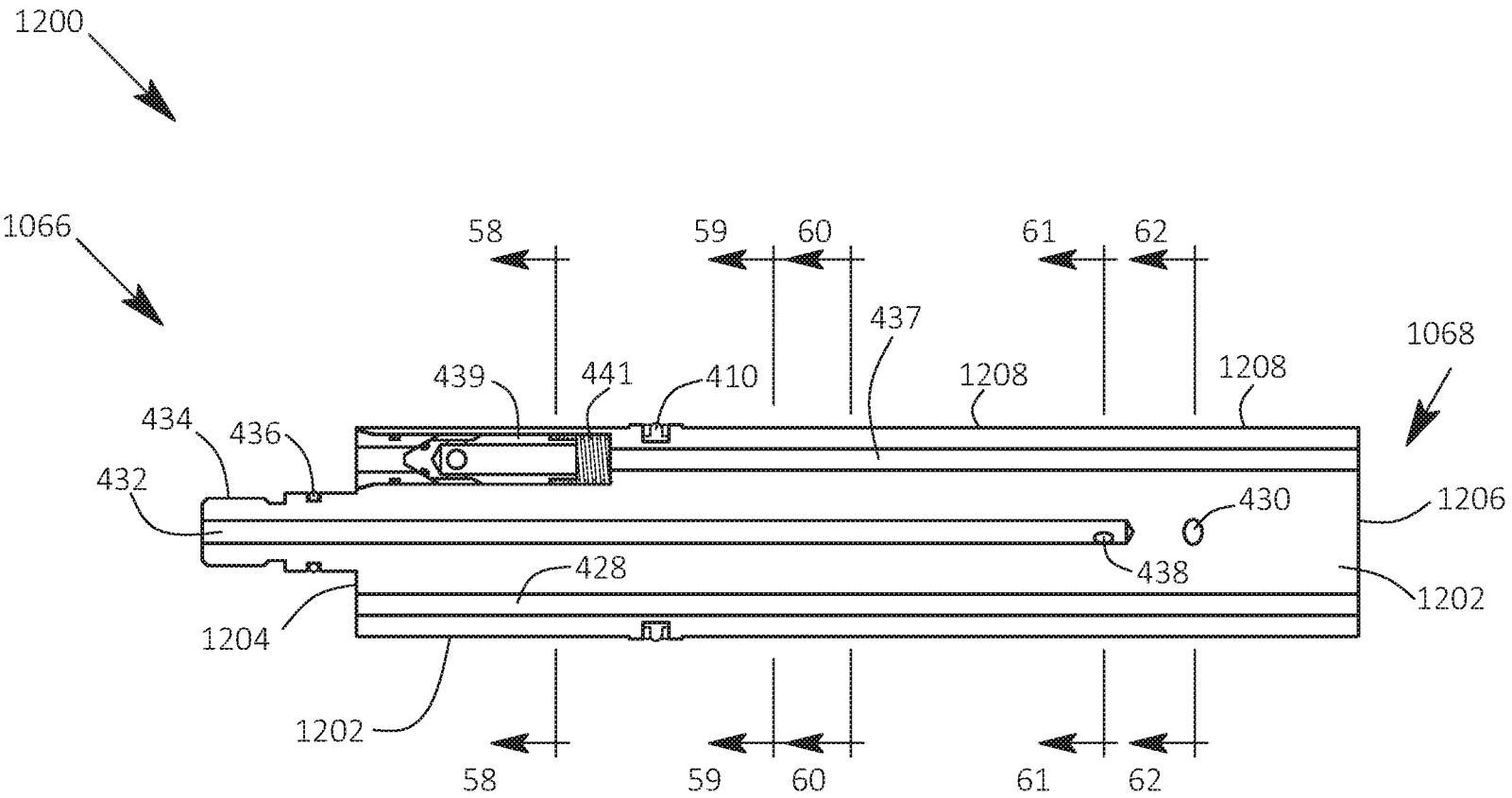
FIG. 54 is a section view along lines 54-54 of FIG. 63 of the actuation assembly of FIGS. 53A, 53B.
Figure 55:
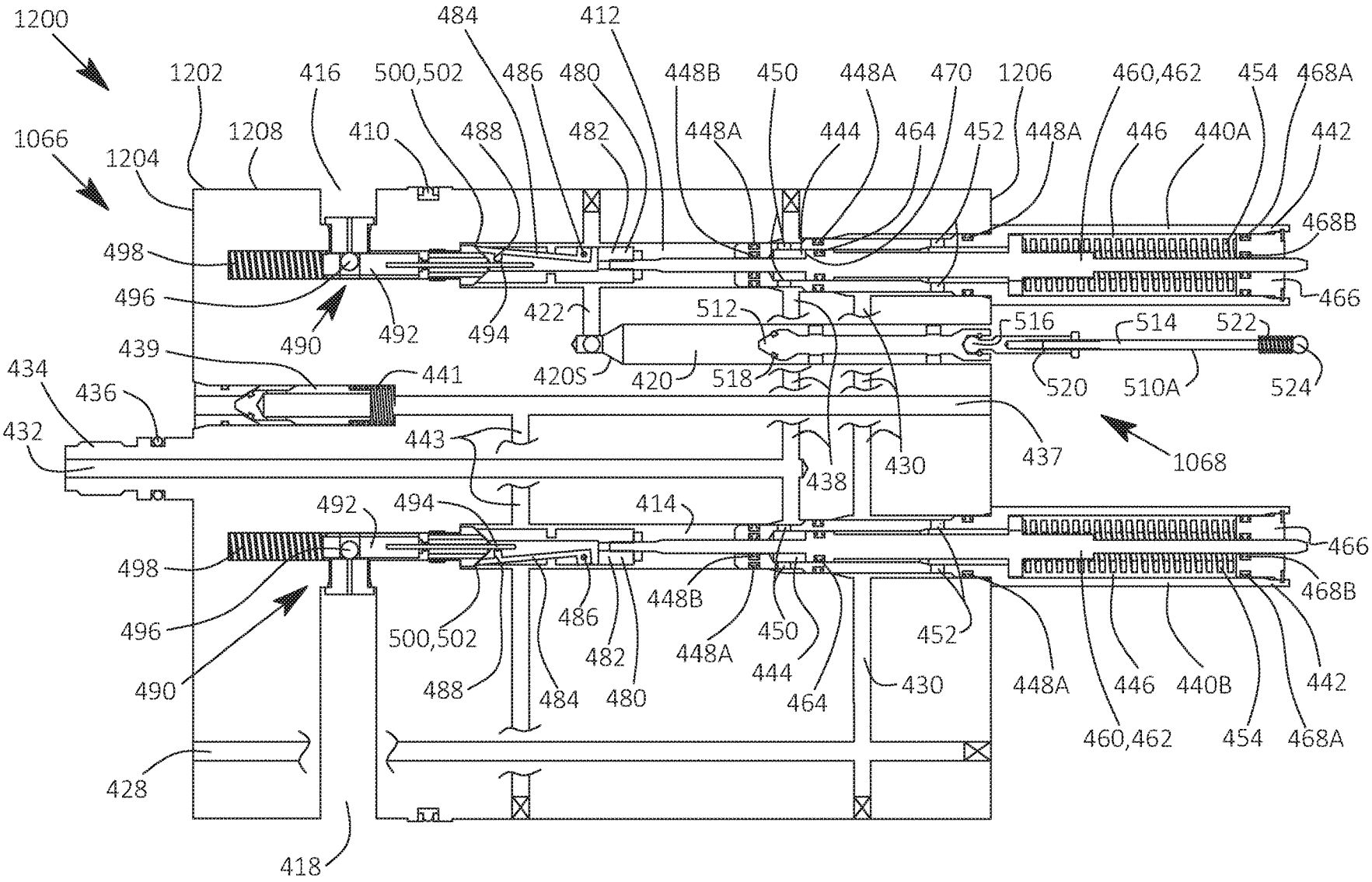
FIG. 55 is a top view of the actuation assembly of FIGS. 53A, 53B (shown as unrolled for clarity)
Figure 57:
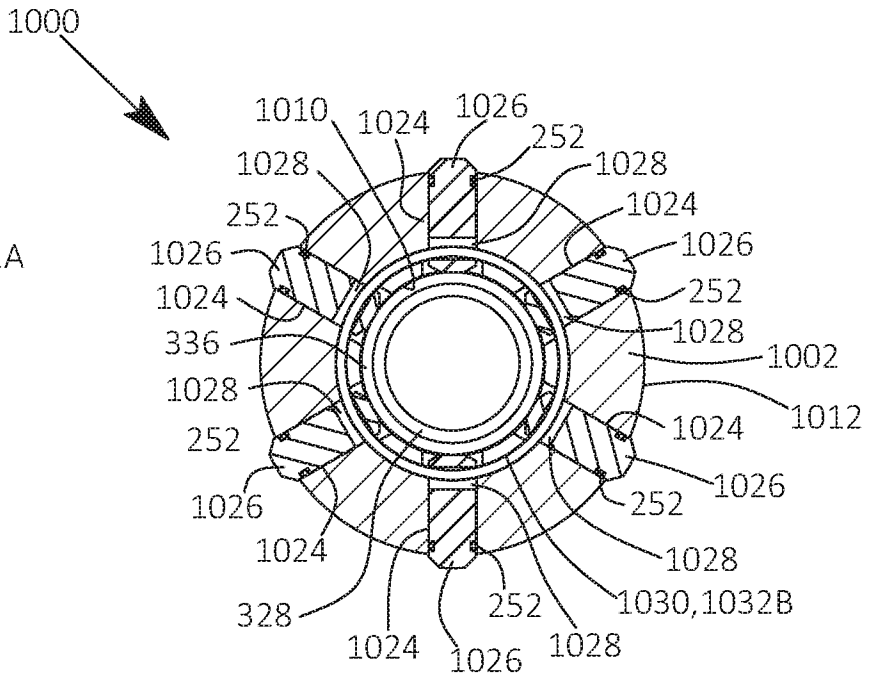
FIG. 57 is a section view along lines 57-57 of the obturating tool shown in FIG. 52B.
Figure 56:
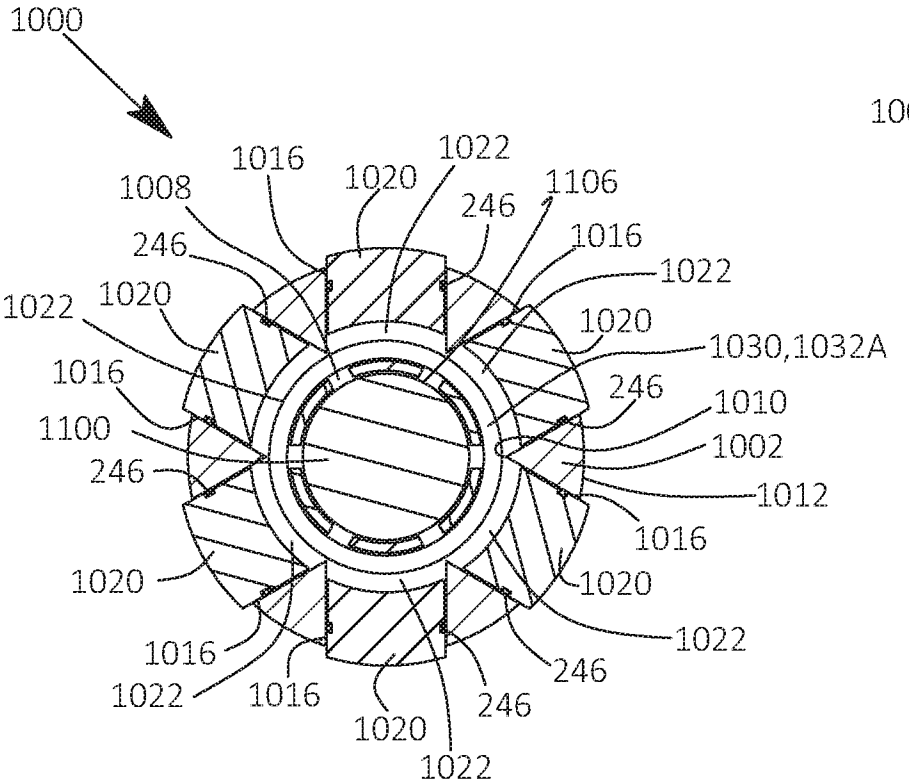
FIG. 56 is a section view along lines 56-56 of the obturating tool shown in FIG. 52B.
Figure 58:
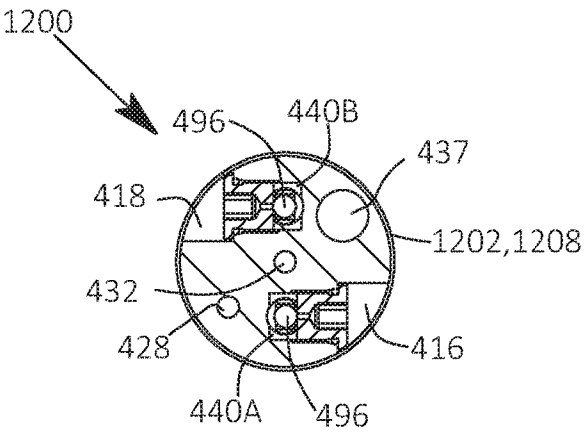
FIG. 58 is a section view along lines 58-58 of the obturating tool shown in FIG. 52C.
Figure 59:
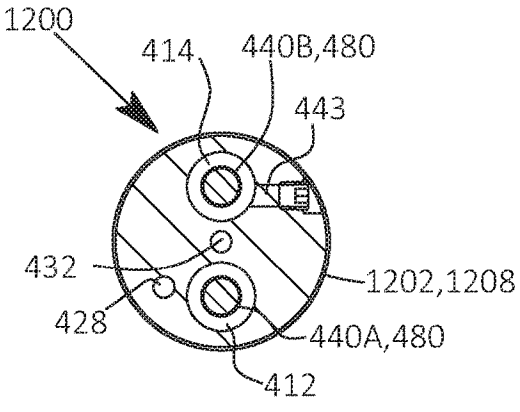
FIG. 59 is a section view along lines 59-59 of the obturating tool shown in FIG. 52C.
Figure 60:
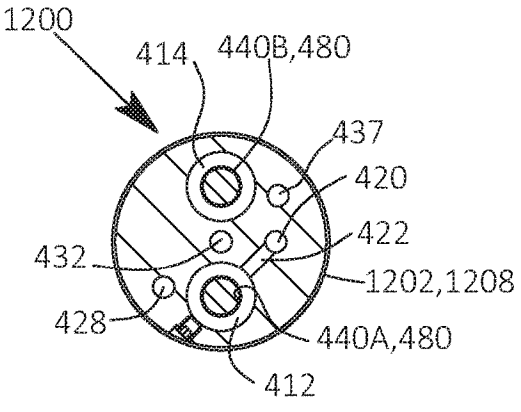
FIG. 60 is a section view along lines 60-60 of the obturating tool shown in FIG. 52C.
Figure 61:
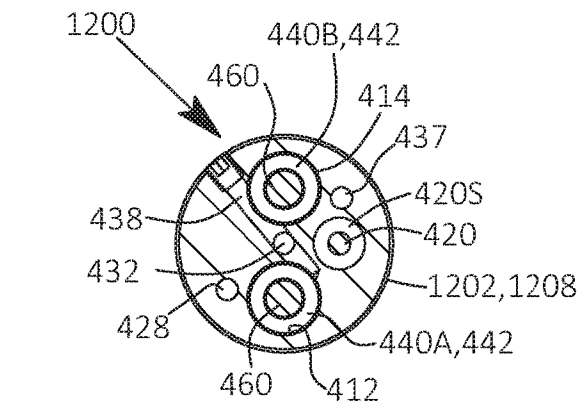
FIG. 61 is a section view along lines 61-61 of the obturating tool shown in FIG. 52C.
Figure 62:
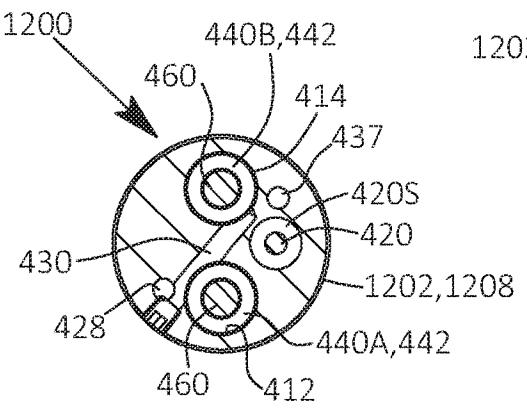
FIG. 62 is a section view along lines 62-62 of the obturating tool shown in FIG. 52C.
Figure 63:
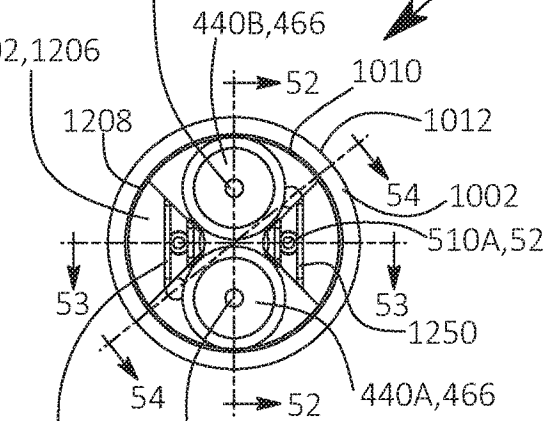
FIG. 63 is a section view along lines 63-63 of the obturating tool shown in FIG. 52C.

Referring to FIGS. 51A and 51B, another embodiment of a sliding sleeve valve 950 for use with well system 1 of FIG. 1 is shown in FIGS. 51A and 51B. Sliding sleeve valve 950 includes features in common with sliding sleeve valves 850 and 900 shown in FIGS. 47, 48 and FIGS. 49, 50, respectively, and shared features are labeled similarly. As with sliding sleeve valves 850 and 900 described above, sliding sleeve valve 950 includes a first or upper-closed position, a second or open position, and a third or lower-closed position, and is actuatable between the upper-closed, open, and lower-closed positions via an obturating tool, such as obturating tools 200, 600, and 700 described above. Sliding sleeve valve 950 has a central or longitudinal axis and includes a housing 952, a sliding sleeve or carrier member 980, and seal assembly 80. Tubular housing 952 includes a first or upper box end 954, a second or lower pin end 956, a central bore or passage 958 extending between first end 954 and second end 956 that is defined by a generally cylindrical inner surface 960, and a generally cylindrical outer surface 962 extending between ends 954 and 956.

In this embodiment, housing 952 is made up of a series of segments including a first or upper segment 952A, a second or intermediate segment 922B, and a third or lower segment 952C releasably coupled to upper segment 952A. Segments 952A-952C of housing 952 are releasably coupled via a plurality of releasable or threaded connector 953. The connections between segments 952A-952C of housing 952 are sealed via annular seals 955 disposed therebetween. Additionally, in this embodiment, relative rotation between upper segment 952A and intermediate segment 952B is restricted via a radially extending member or pin 957 positioned therebetween; however, in other embodiments, housing 952 may not include pin 957. In this embodiment, the inner surface 960 of the upper segment 952A of housing 952 includes a releasable or threaded connector 953 while the inner surface 960 of intermediate segment 952B includes a releasable or threaded connector 955. Threaded connectors 953 and 955 are configured to couple sliding sleeve valve 950 with well string 4.

The inner surface 960 of housing 952 includes an annular first or upper shoulder 964, and an annular second or lower shoulder 966. Additionally, inner surface 960 includes a seal bore 968 and an annular landing profile or "no-go" shoulder 969, where seal bore 968 extends axially between landing profile 969 and the lower end 956 of housing 952. In this embodiment, an annular seal 970 is positioned in an annular groove formed in inner surface 960 and positioned adjacently upward from upper shoulder 964. In this embodiment, a detent ring 972 is positioned radially between housing 952 and carrier 980, adjacent lower shoulder 966. Detent ring 972 is axially locked with housing 952 via a retainer ring 974 that is pinned between an upper end of the lower segment 952B of housing 952 and an annular shoulder 976 of upper segment 952A. Detent ring 972 comprises a solid, continuous ring that extends 360 degrees about carrier 980. In this embodiment, detent ring 972 comprises Beryllium copper; however, in other embodiments, detent ring 972 may comprise various materials.

The carrier 980 of sliding sleeve valve 950 has a first or upper end 981, a second or lower end 982, a central bore or passage 983 defined by a generally cylindrical inner surface 984 extending between ends 981, 982, and a generally cylindrical outer surface 985 extending between ends 981, 982. In this embodiment, the outer surface 985 of carrier 980 includes an annular, radially outwards extending shoulder 986 and a radially outwards extending flange 987. The flange 987 of carrier 985 includes an annular outer groove that receives an annular first or upper seal 988 that sealingly engages the inner surface 960 of housing 952. Flange 985 additionally includes at least one axial port 989 extending therethrough. In this embodiment, the outer surface 985 of carrier 980 also includes a plurality of axially spaced, annular grooves 990A, 990B, 990C, respectively, located between flange 987 and the lower end 982 of carrier 980, and an annular second or lower seal 990C located proximal lower end 982.

The seal 970 of housing 952 sealingly engages the outer surface 985 of carrier 980 while the lower seal 990C of carrier 980 sealingly engages the inner surface 960 of housing 952. In this configuration, a first or upper annular chamber 978 is formed in housing 952 between inner surface 960 and the outer surface 985 of carrier 980, where upper chamber 978 extends between seal 970 of housing 952 and upper seal 988 of carrier 980. Additionally, a second or lower annular chamber 979 is formed in housing 952 between inner surface 960 and the outer surface 985 of carrier 980, where lower chamber 979 extends between upper seal 988 and lower seal 991 of carrier 980. Fluid communication between chambers 978 and 979 is permitted only through axial passage 988, which acts as a fluid restriction or flow restrictor for damping relative axial movement between carrier 980 and housing 952. In other words, as carrier 980 travels axially relative to housing 952, fluid is forced through the flow restriction provided by axial passage 988, thereby damping or resisting the relative motion between carrier 980 and housing 952.

Figure 2A:
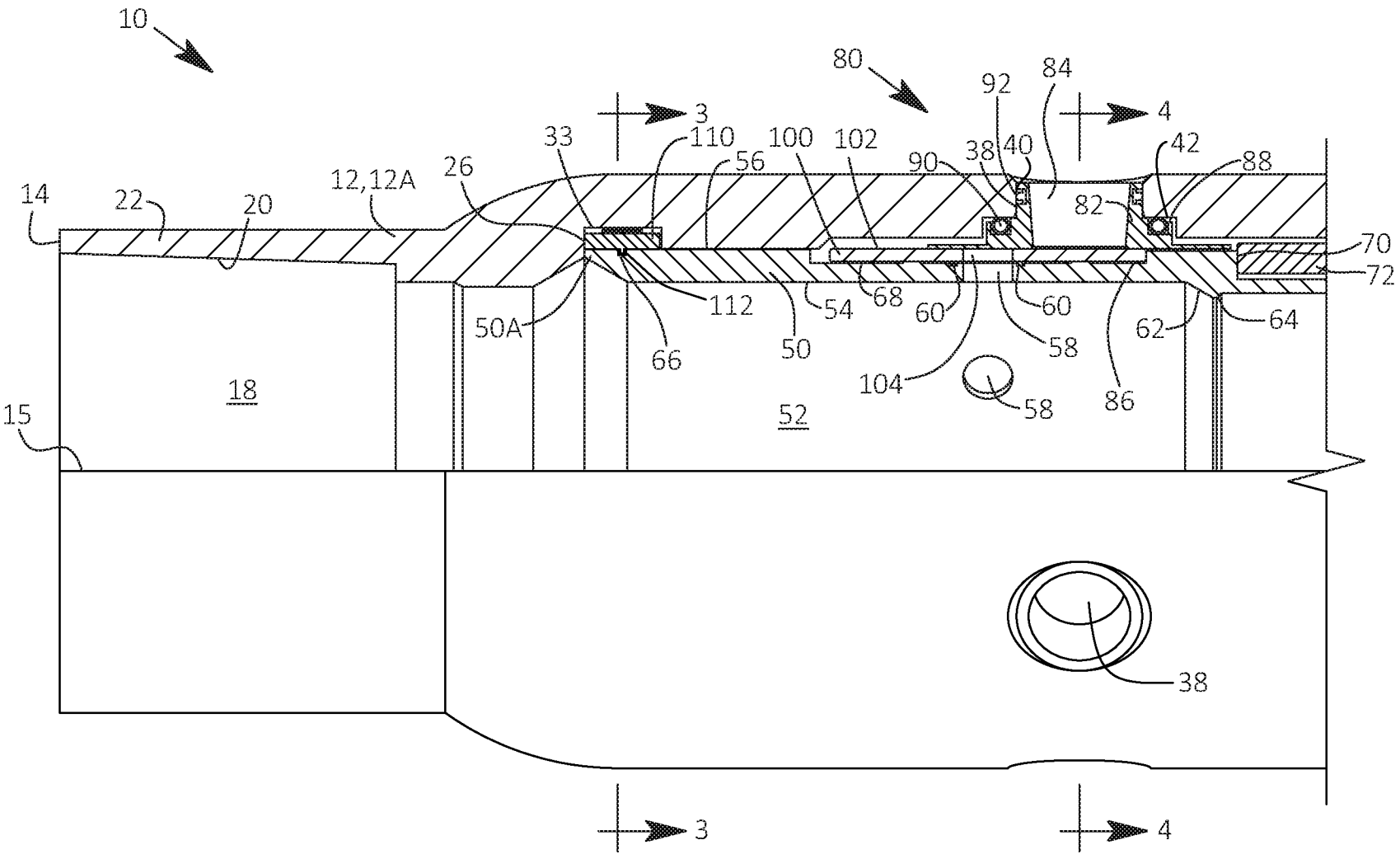
FIG. 2A is a section view of the uppermost end of an embodiment of a sliding sleeve valve in accordance with principles disclosed herein.
Figure 2B:
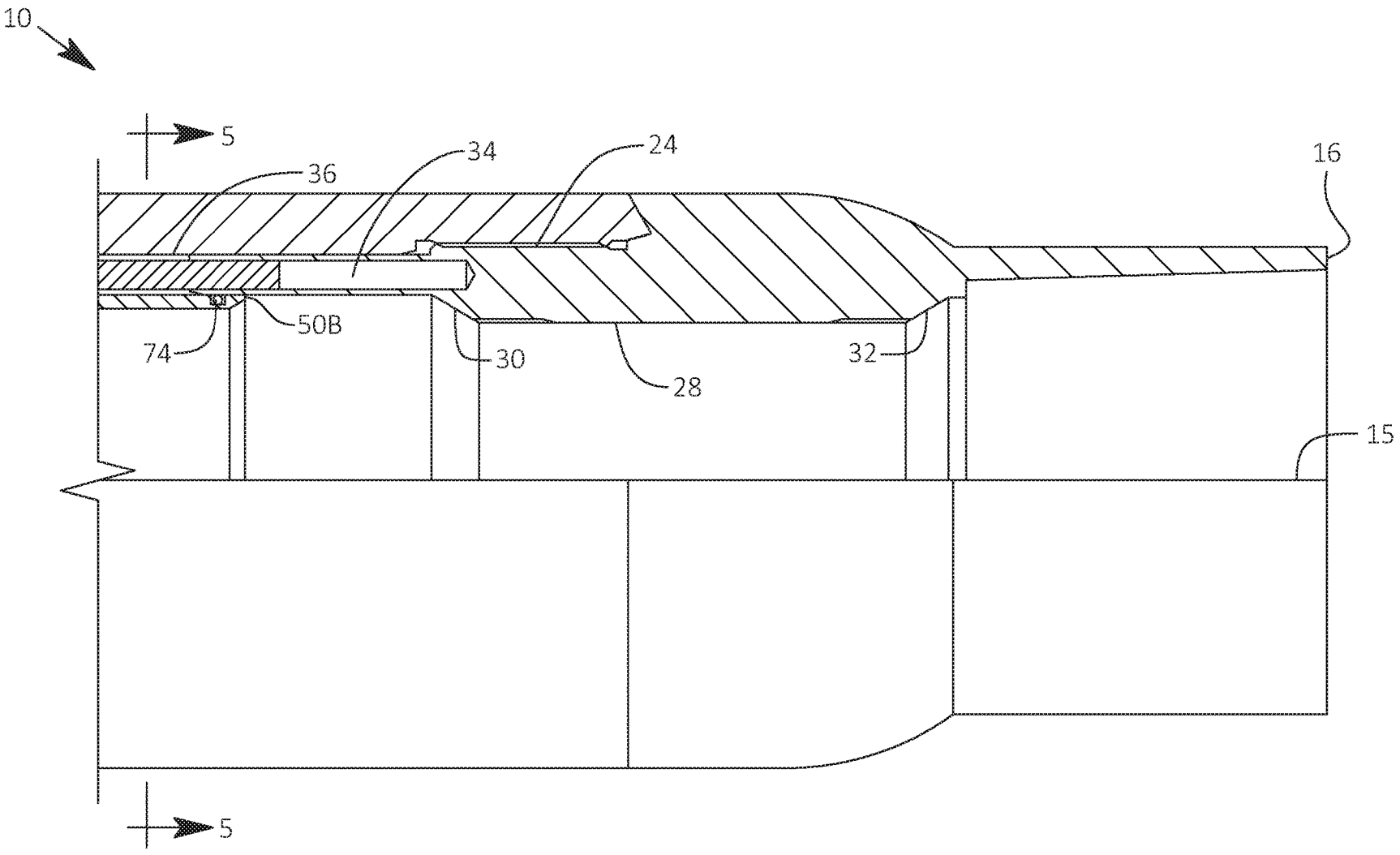
FIG. 2B is a section view of the lowermost end of the sliding sleeve valve shown in FIG. 2A.
Figure 4:
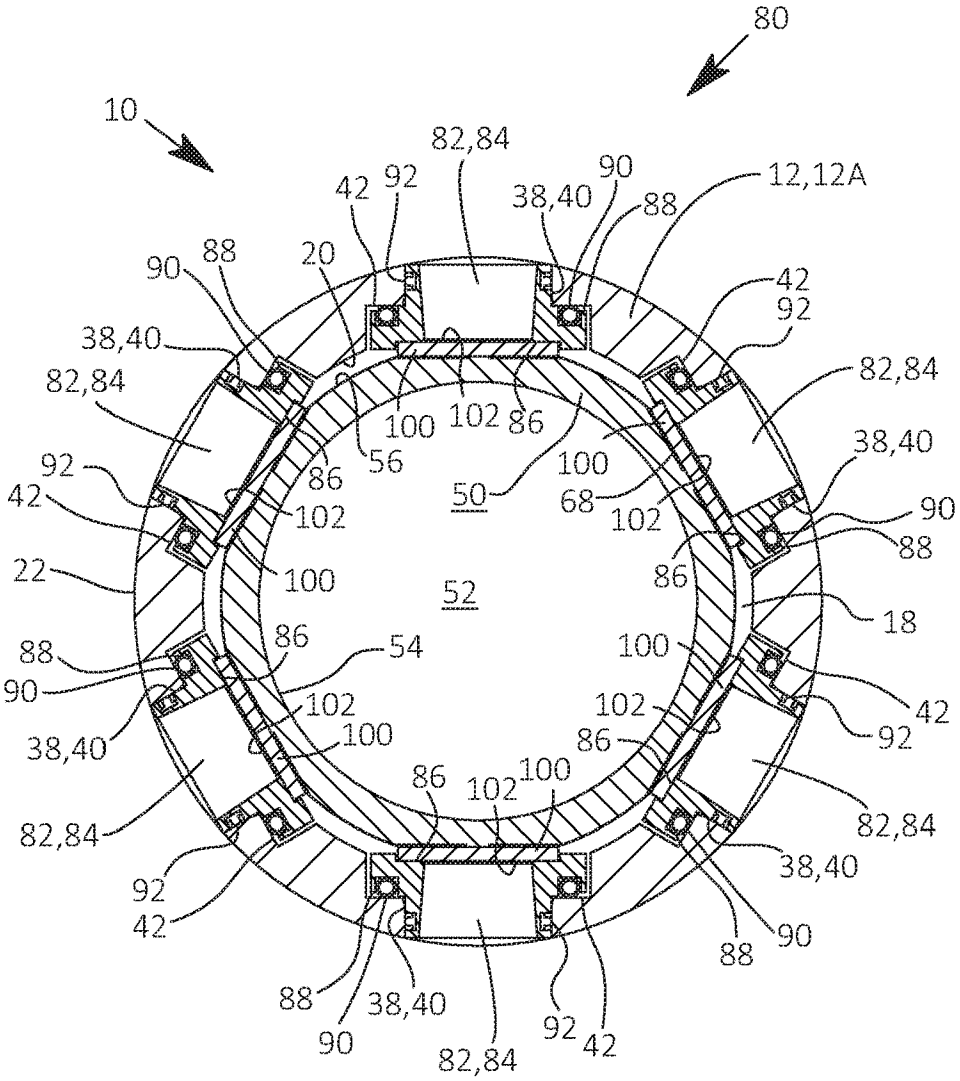
FIG. 4 is a section view along lines 4-4 of the segment of the sliding sleeve valve shown in FIG. 2A.
Figure 3:
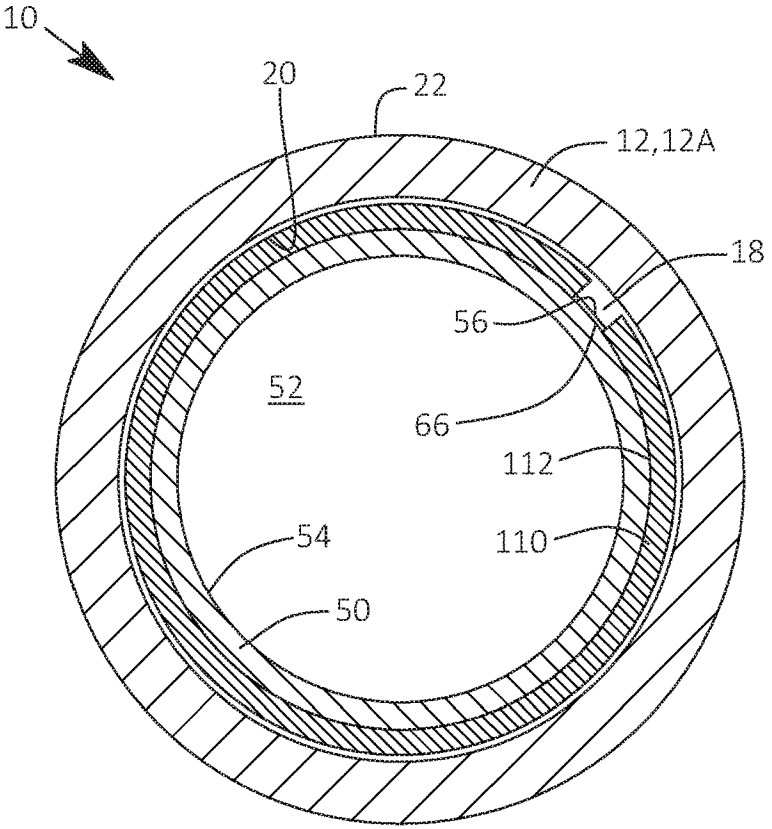
FIG. 3 is a section view along lines 3-3 of the segment of the sliding sleeve valve shown in FIG. 2A.
Figure 5:
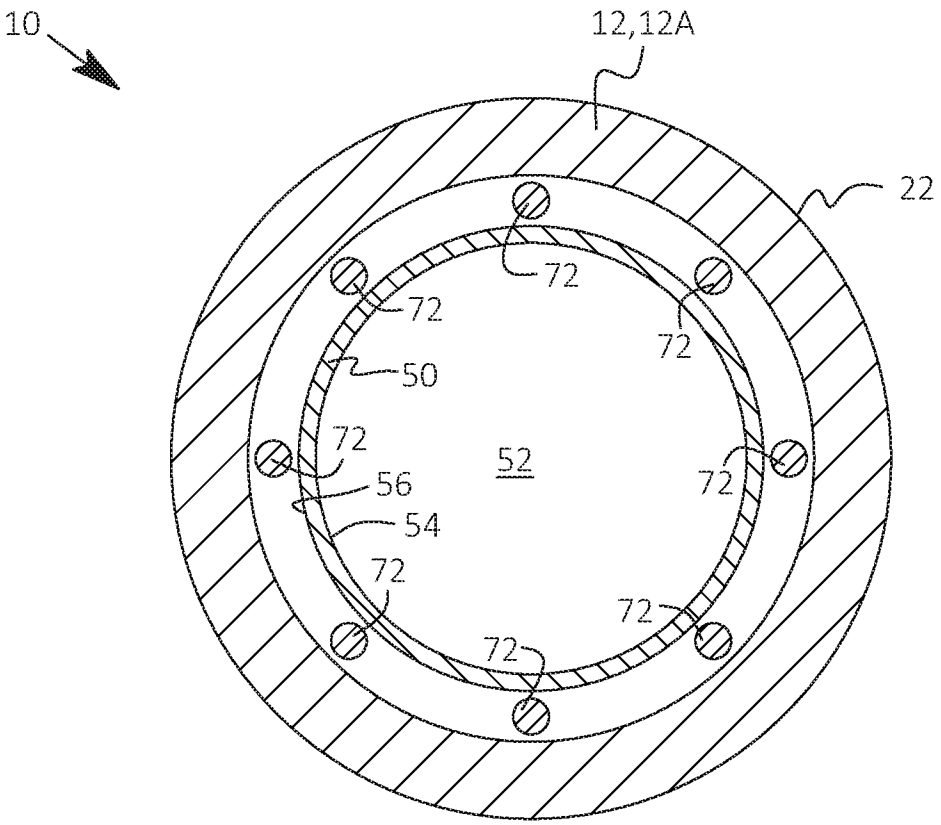
FIG. 5 is a section view along lines 5-5 of the segment of the sliding sleeve valve shown in FIG. 2B.
Figure 6A:
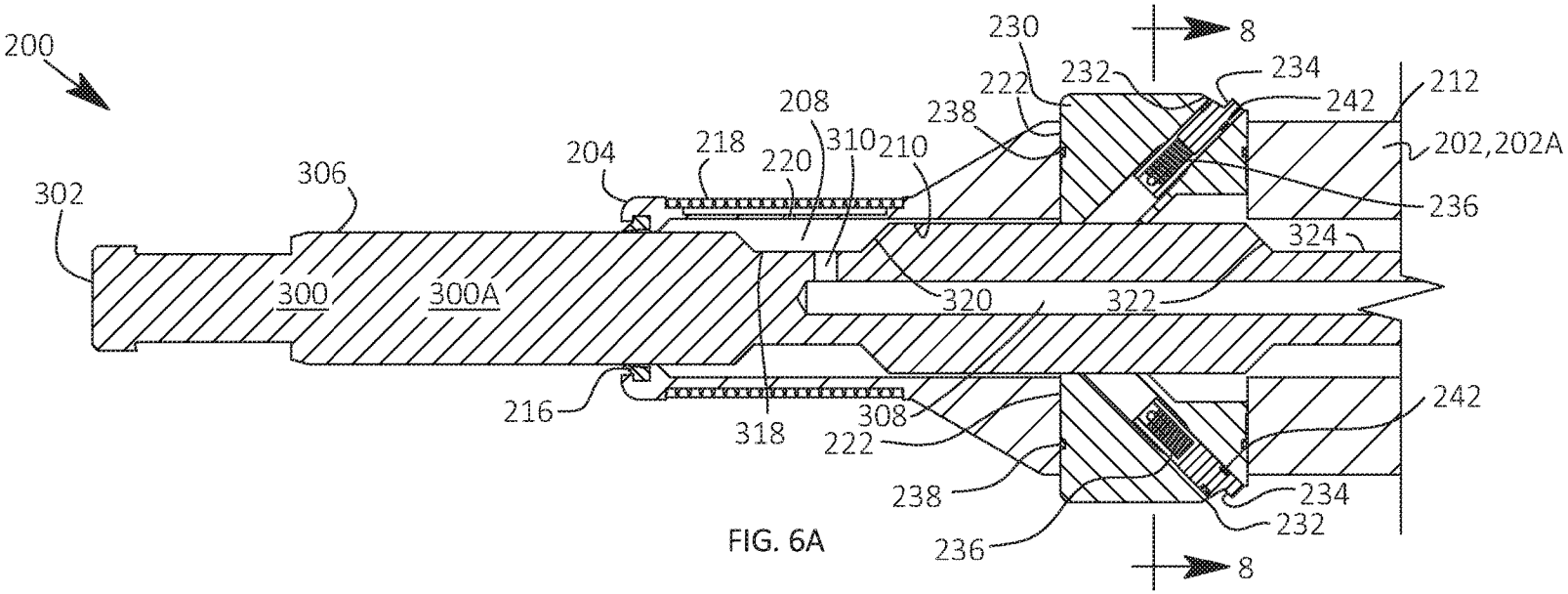
FIG. 6A is a section view of the uppermost end of an embodiment of a flow transported obturating tool for actuating the sliding sleeve valve shown in FIGS. 2A-5 in accordance with principles disclosed herein.
Figure 7A:
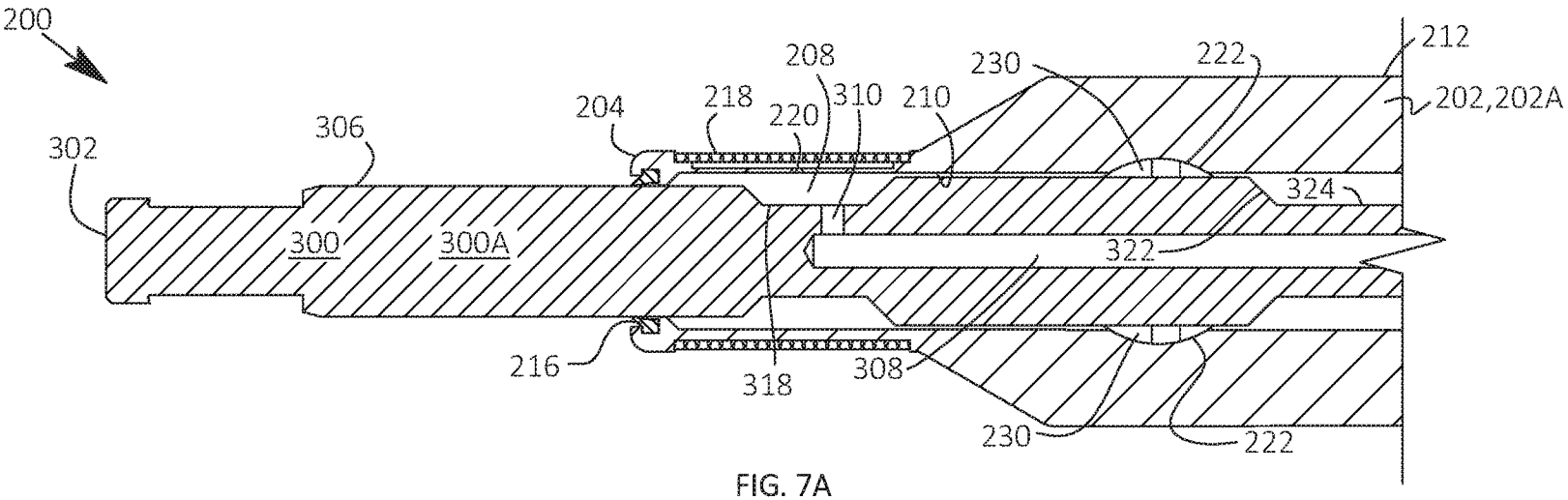
FIG. 7A is another section view of the uppermost end of the obturating tool shown in FIGS. 6A-6D.
Figure 6B:
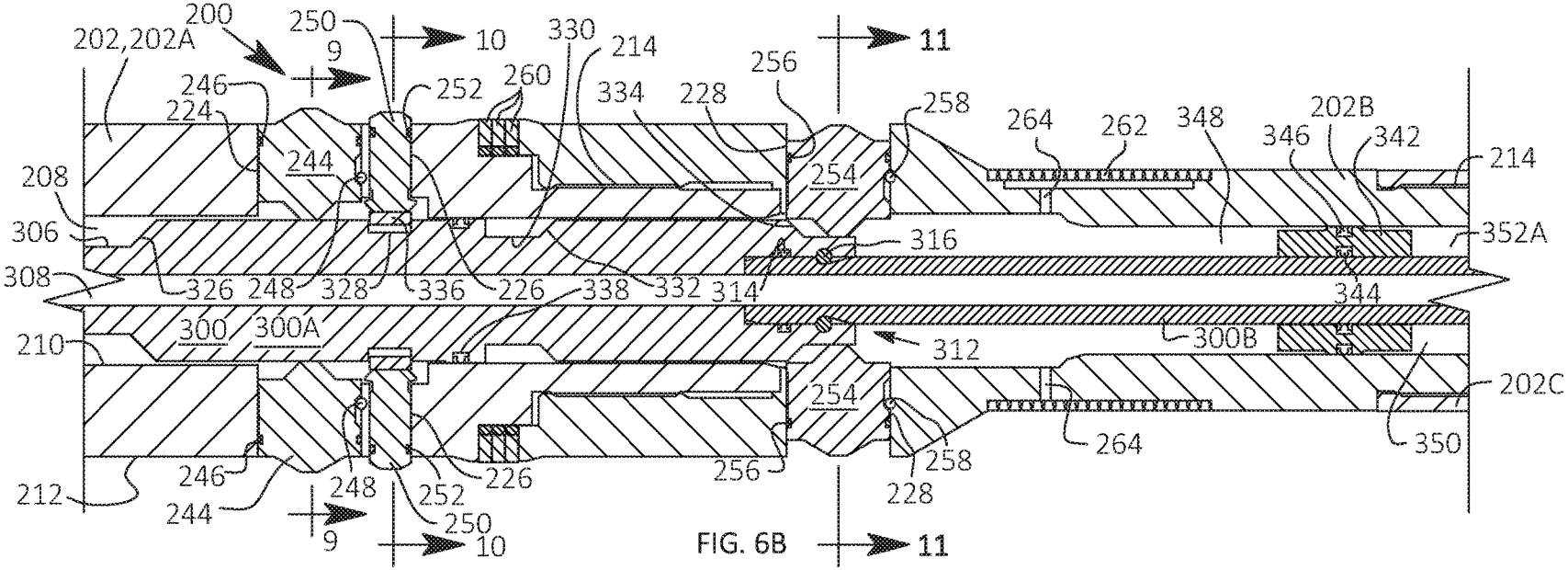
FIG. 6B is a section view of an intermediate section of the obturating tool shown in FIG. 6A.
Figure 7B:
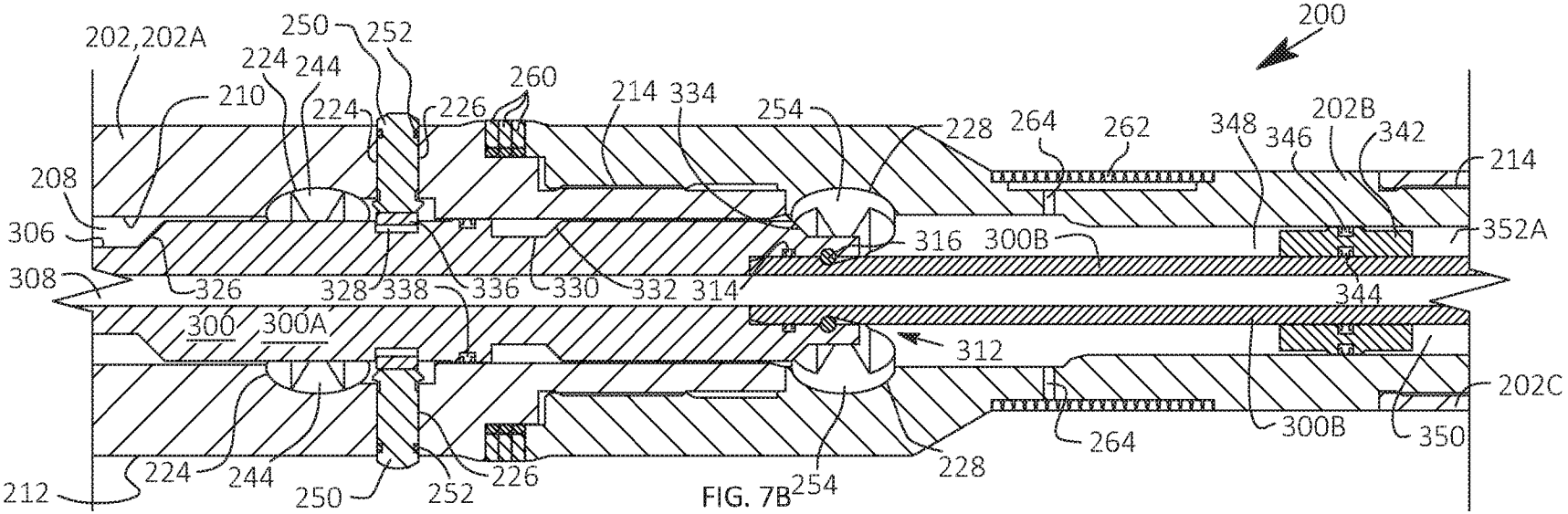
FIG. 7B is a section view of an intermediate section of the obturating tool shown in FIG. 7A.
Figure 6C:
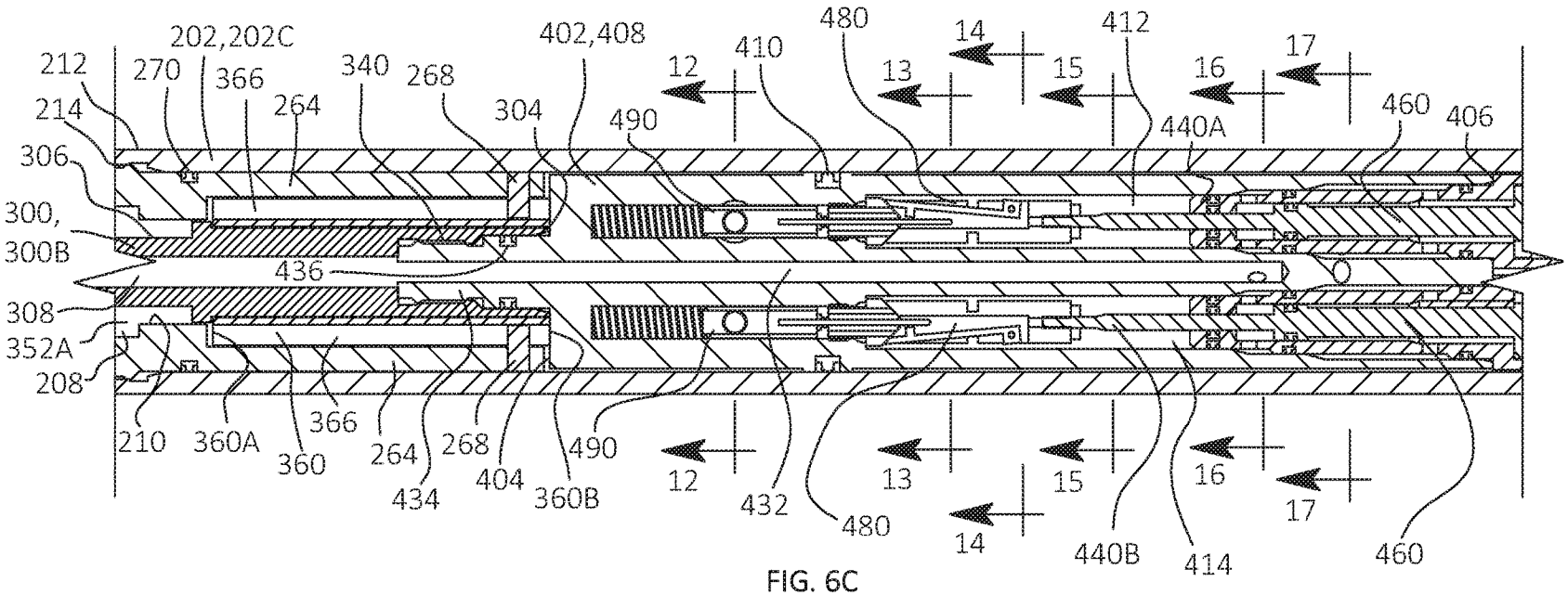
FIG. 6C is a section view of another intermediate section of the obturating tool shown in FIG. 6A.
Figure 7C:
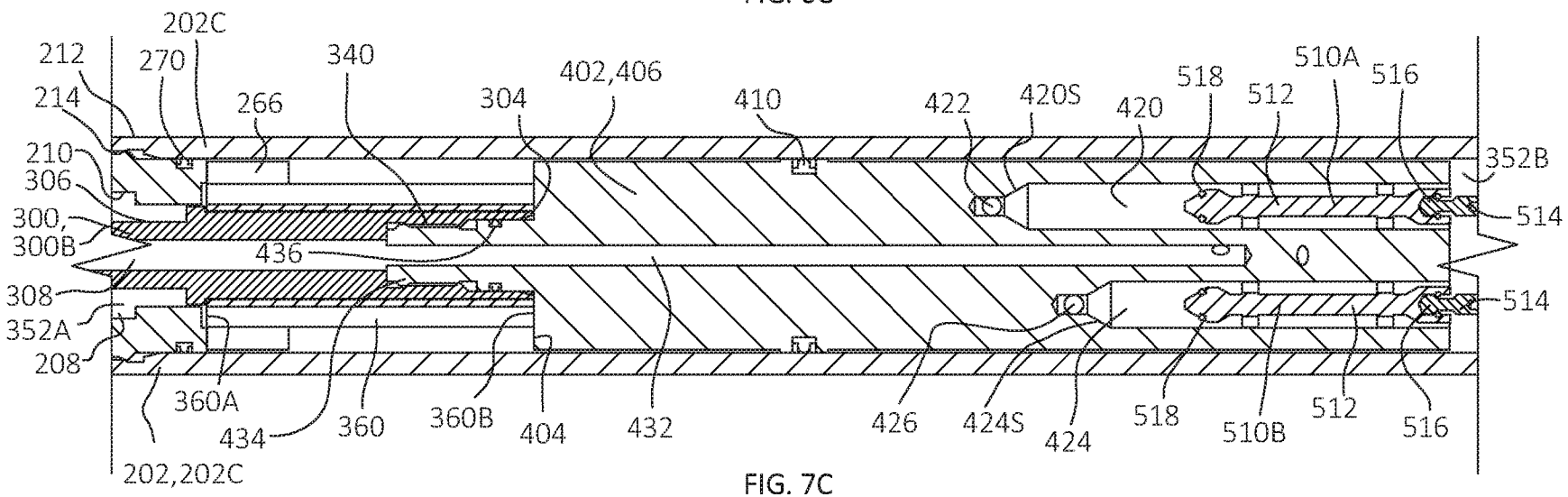
FIG. 7C is a section view of another intermediate section of the obturating tool shown in FIG. 7A.
Figure 6D:
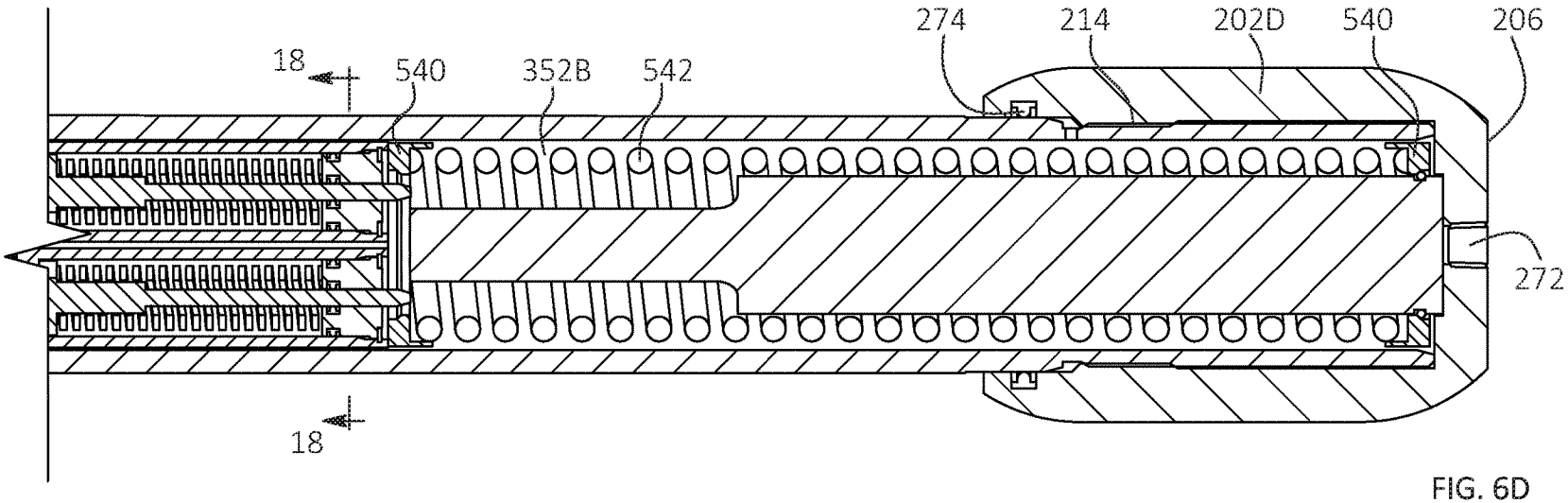
FIG. 6D is a section view of the lowermost end of the obturating tool shown in FIG. 6A.
Figure 7D:
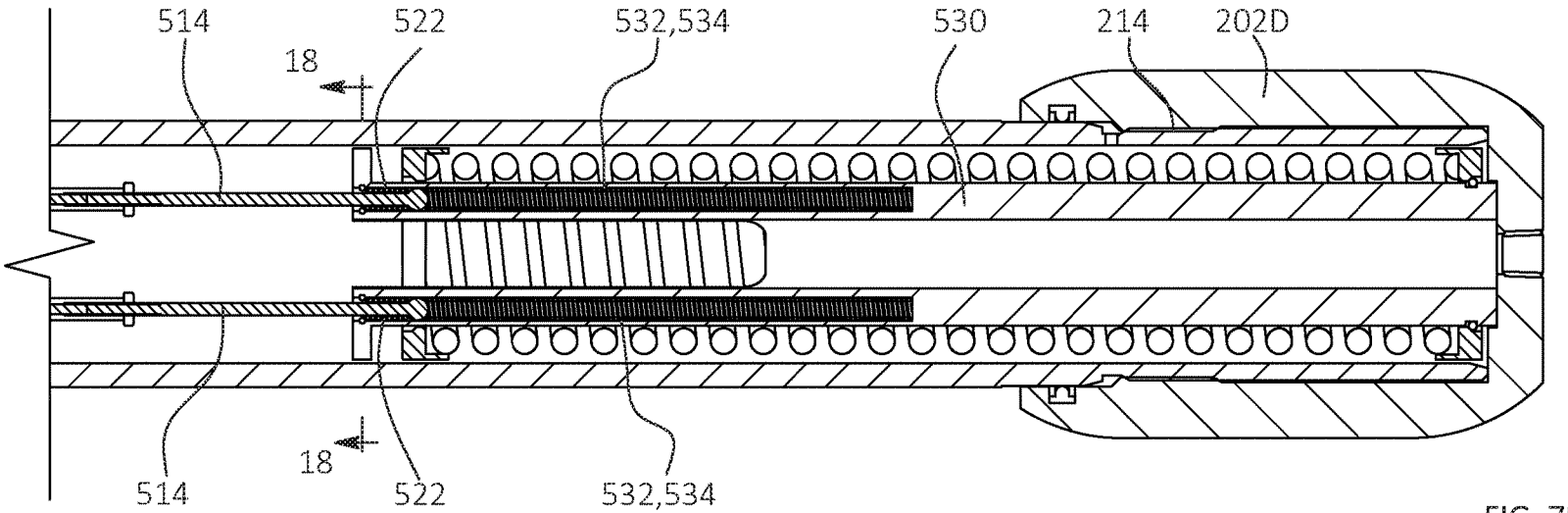
FIG. 7D is a section view of the lowermost end of the obturating tool shown in FIG. 7A.
Figure 8:
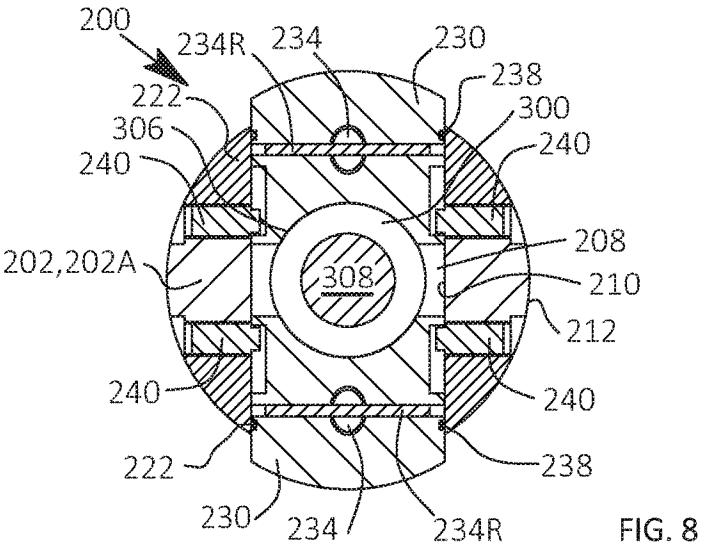
FIG. 8 is a section view along lines 8-8 of the obturating tool shown in FIG. 6A.
Figure 9:
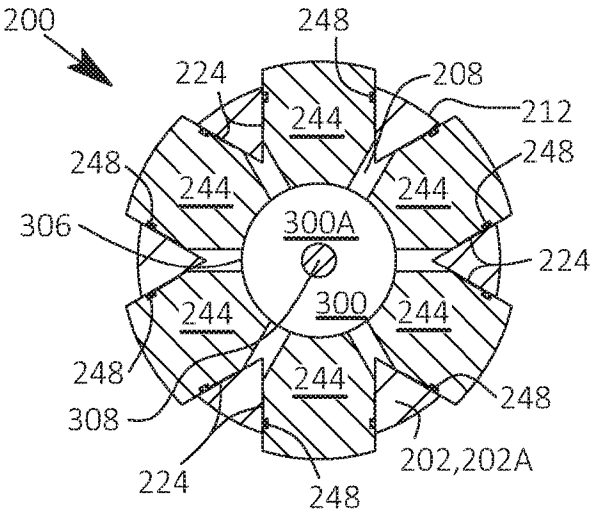
FIG. 9 is a section view along lines 9-9 of the obturating tool shown in FIG. 6B.
Figure 10:
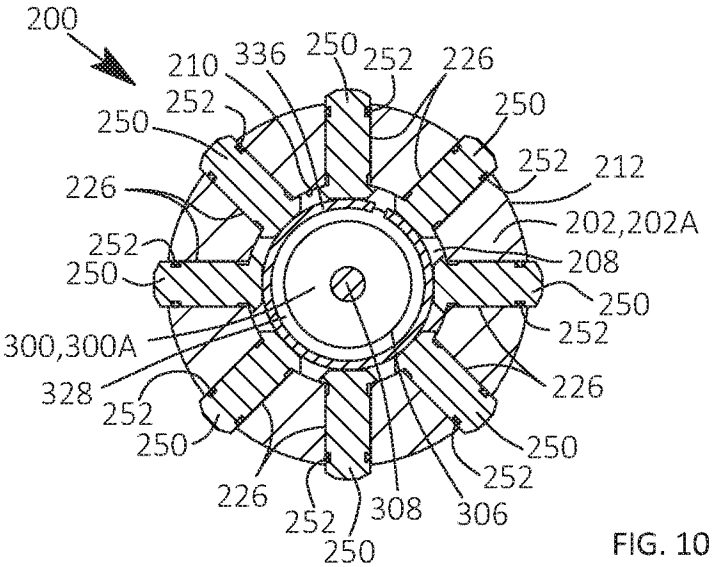
FIG. 10 is a section view along lines 10-10 of the obturating tool shown in FIG. 6B.
Figure 11:
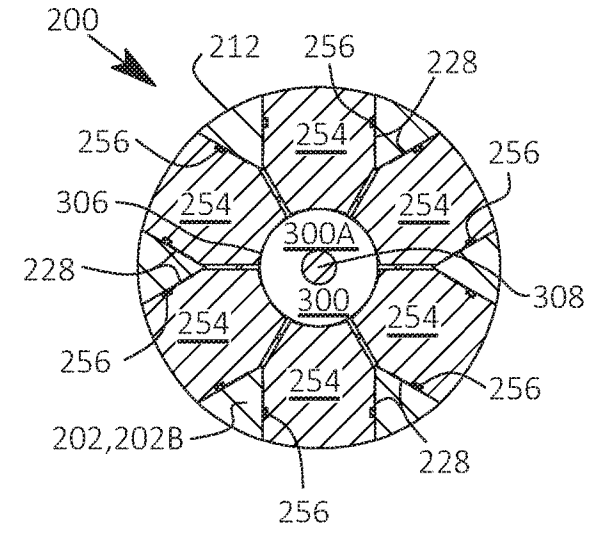
FIG. 11 is a section view along lines 11-11 of the obturating tool shown in FIG. 6B.
Figure 13:
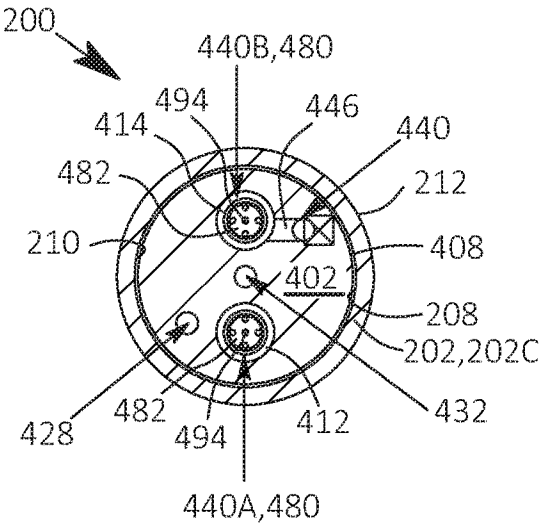
FIG. 13 is a section view along lines 13-13 of the obturating tool shown in FIG. 6C.
Figure 12:
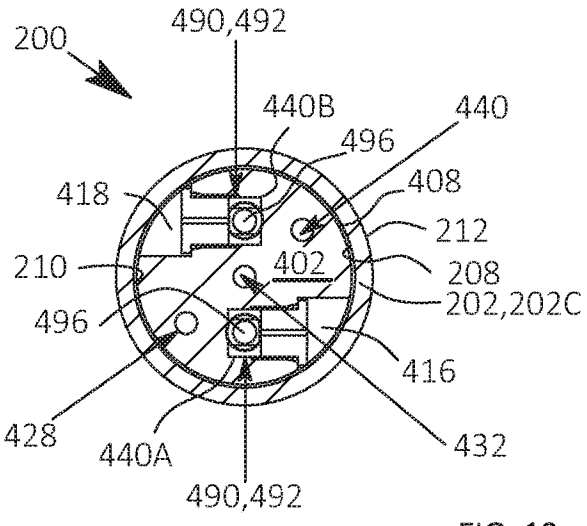
FIG. 12 is a section view along lines 12-12 of the obturating tool shown in FIG. 6C.
Figure 14:
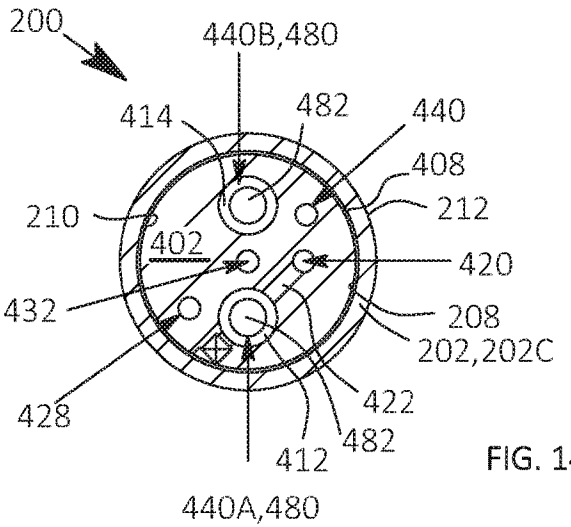
FIG. 14 is a section view along lines 14-14 of the obturating tool shown in FIG. 6C.
Figure 16:
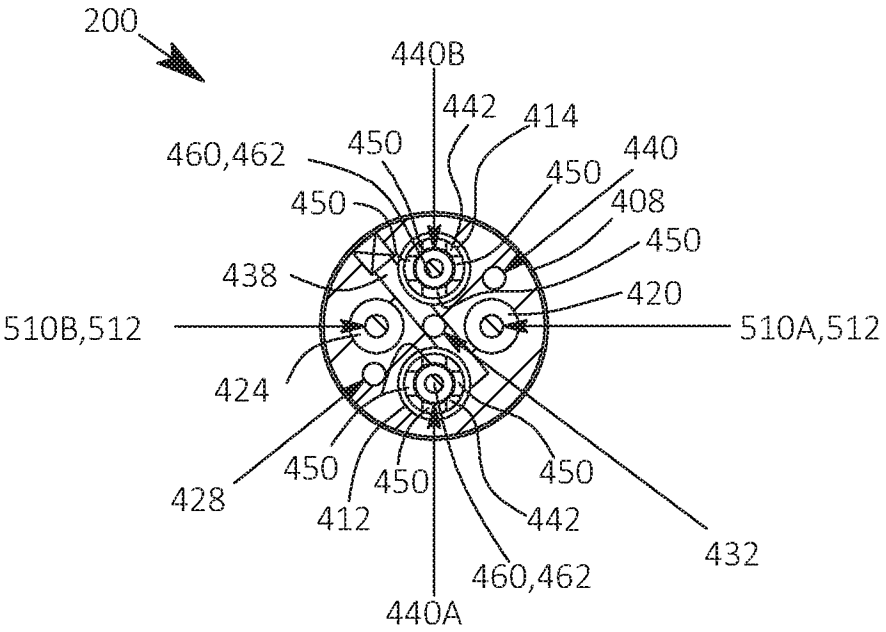
FIG. 16 is a section view along lines 16-16 of the obturating tool shown in FIG. 6C.
Figure 15:
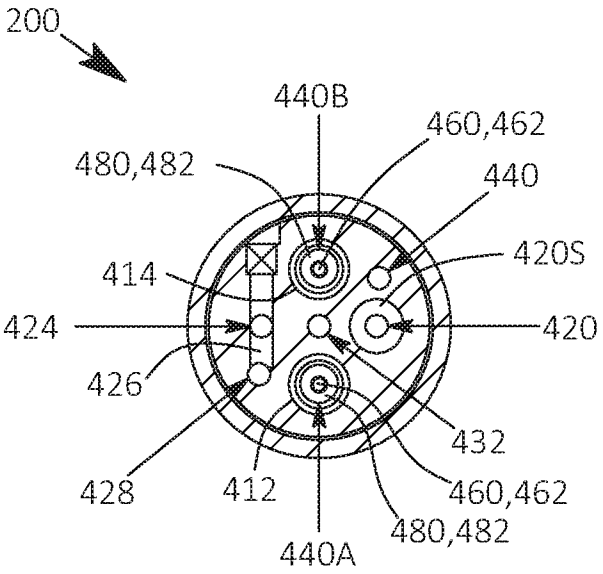
FIG. 15 is a section view along lines 15-15 of the obturating tool shown in FIG. 6C.
Figure 18:
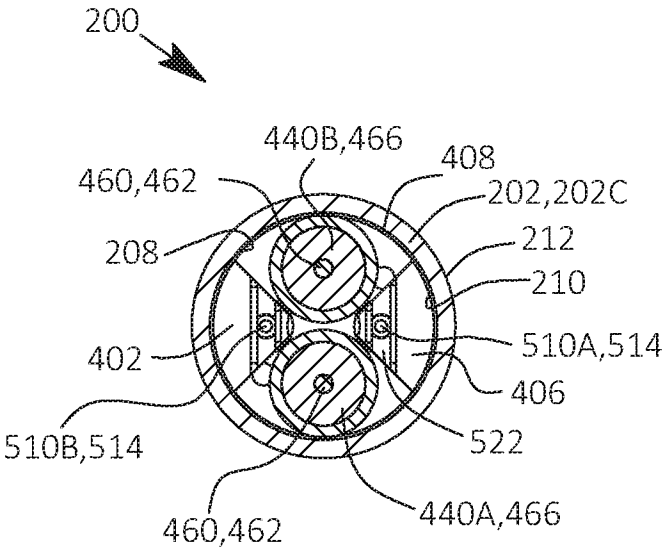
FIG. 18 is a section view along lines 18-18 of the obturating tool shown in FIG. 6D.
Figure 17:
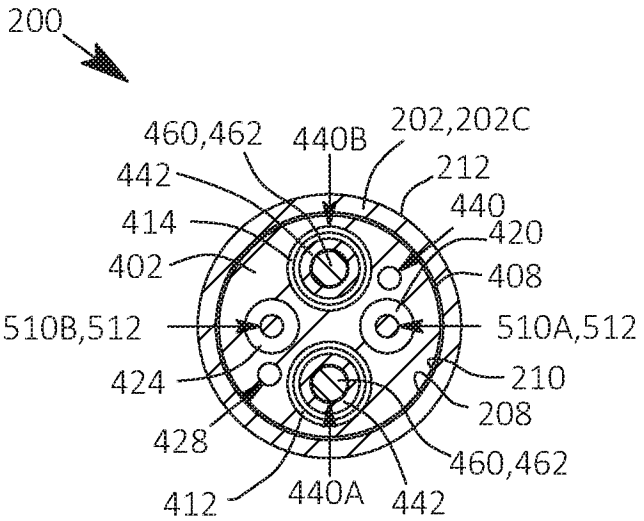
FIG. 17 is a section view along lines 17-17 of the obturating tool shown in FIG. 6C.
Figure 19:
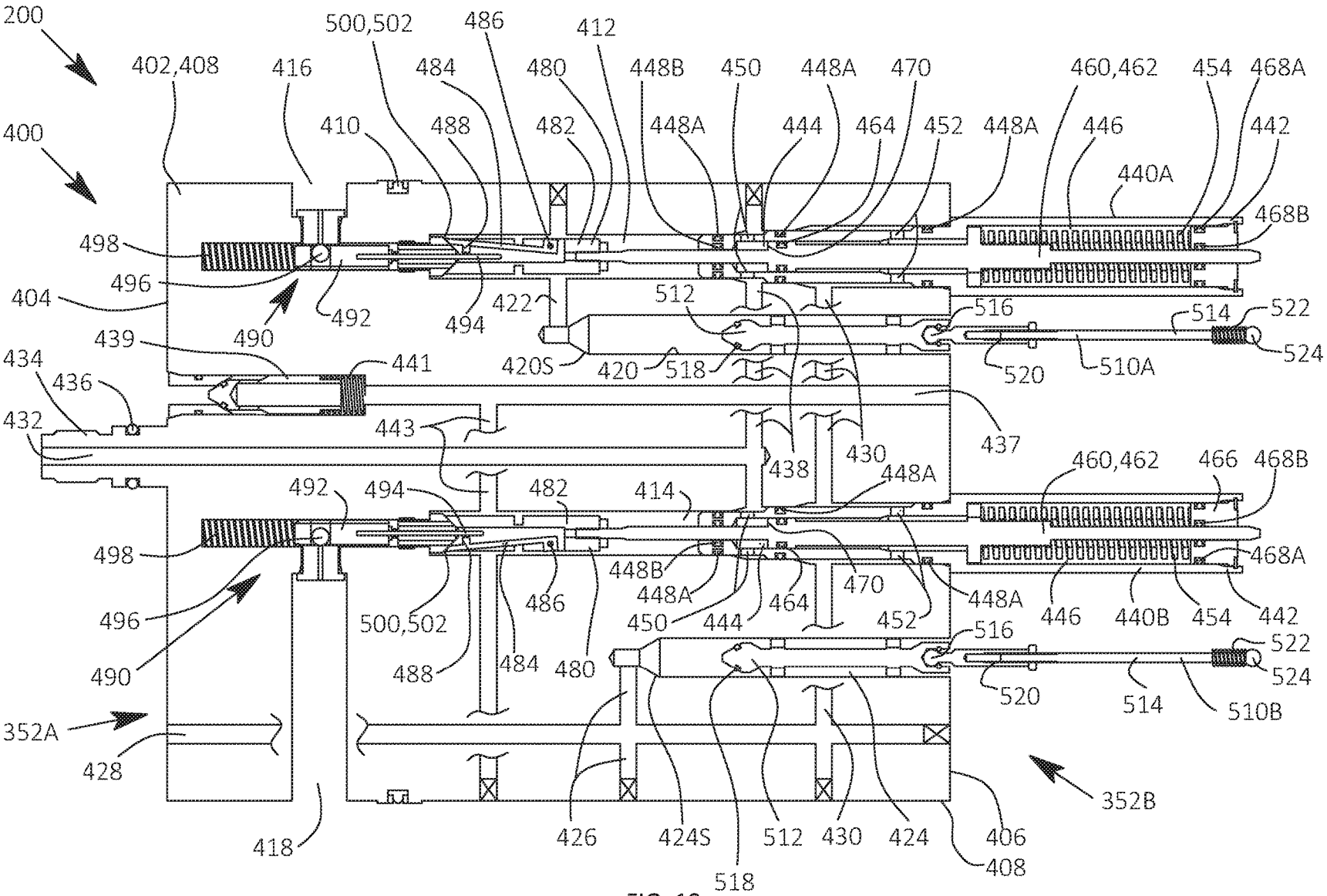
FIG. 19 is a top view of an embodiment of an actuation assembly (shown as unrolled for clarity) of the obturating tool of FIGS. 6A-6D in accordance with principles disclosed herein.
Figure 21:
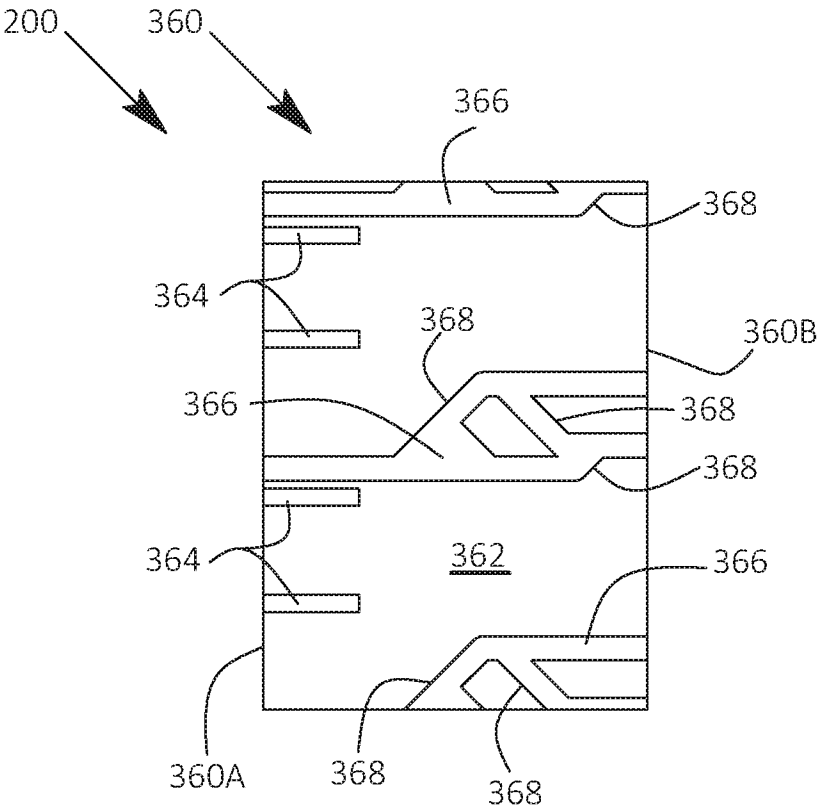
FIGS. 20 and 21 are top views of an embodiment of an indexer (shown as unrolled for clarity) of the obturating tool of FIGS. 6A-6D in accordance with principles disclosed herein.
Figure 20:
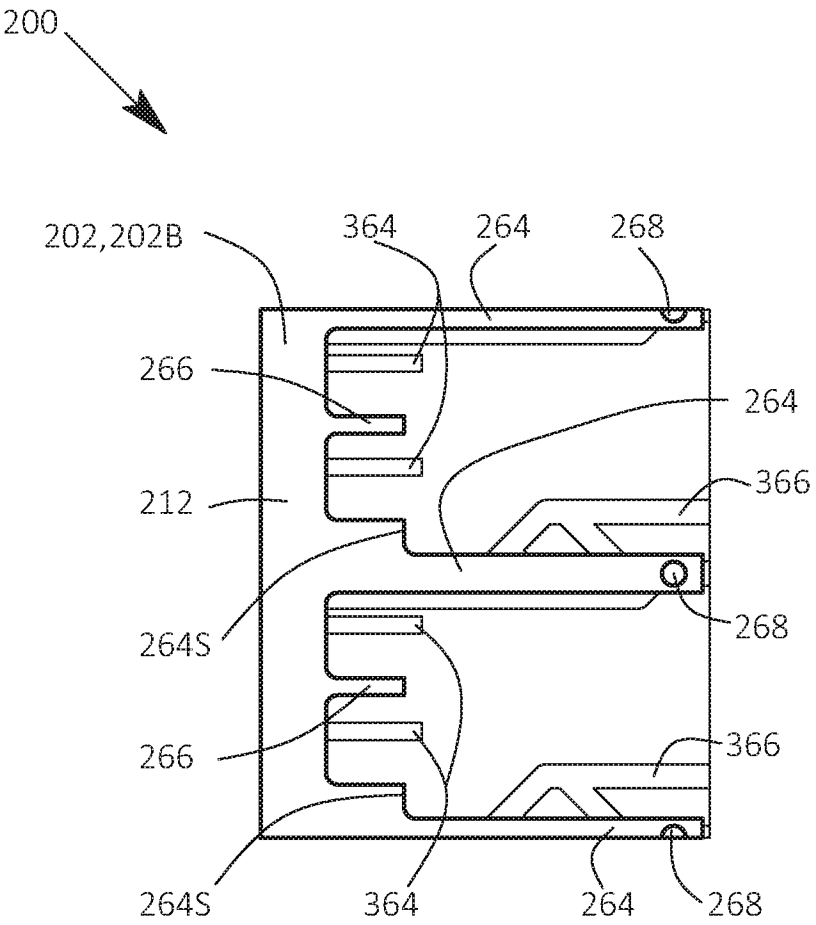

Similar to sliding sleeve valve 10 shown in FIG. 2, sliding sleeve valve 950 comprises a three position sliding sleeve valve having an upper-closed position (shown in FIGS. 51A, 51B), an open position, and a lower-closed position. In the upper-closed position of sliding sleeve valve 950, flange 986 of carrier 980 is disposed directly adjacent or engages the upper shoulder 964 of housing 952 and detent ring 972 is disposed in a radially inner position received at least partially in the lower groove 990C of carrier 980. In the open position, detent ring 972 is disposed in the radially inner position received in the intermediate groove 990B of carrier 980 and each end 981, 982 of carrier 980 is axially spaced from shoulders 964, 966 of housing 952, respectively. In the lower-closed position, detent ring 972 is disposed in the radially inner position received in the upper groove 990A of carrier 980 while an annular lower surface of flange 987 is disposed directly adjacent or contacts the lower shoulder 966 of housing 952. When sliding sleeve valve 950 is actuated between the upper-closed, open, and lower-closed positions (e.g., via wireline shifting tools 200, 600, etc.), detent ring 972 is forced to elastically deform into a radially expanded position spaced from grooves 990A, 990B, and 990C to permit relative axial movement between carrier 980 and housing 952. In this manner, detent ring 972 acts to secure sliding sleeve valve 950 into one of its upper-closed, open, and lower-closed positions without the need of locking mechanisms or shear members.

Referring to FIGS. 52A-63, another embodiment of an untethered, flow transported obturating tool 1000 of well system 1 is shown in FIGS. 52A-63, where obturating tool 1000 is configured to actuate one or more of the sliding sleeve valves described herein (e.g., sliding sleeve valves 10, 750, 800, 850, 900, and 950) between their respective upper-closed, open, and lower-closed positions. Obturating tool 1000 can be disposed in the bore 4B of well string 4 at the surface of wellbore 3 and pumped downwards through wellbore 3 towards the heel of wellbore 3, where obturating tool 1000 can selectively actuate one or more sliding sleeve valves 10 moving from the heel of wellbore 3 to the toe of wellbore 3. Additionally, obturating tool 1000 includes features in common with the obturating tools 200, 600, and 700 shown in FIGS. 6A-30B, and shared features are labeled similarly.

In the embodiment of FIGS. 52A-63, obturating tool 1000 generally includes a cylindrical housing 1002, a cam or core 1100 slidably disposed therein, and an actuation assembly 1200 configured to control the actuation or displacement of core 1100 in housing 1002. Housing 1002 has a first or upper end 1004, a second or lower end 1006, a central bore or passage 1008 defined by a generally cylindrical inner surface 1010 extending between ends 1004 and 1006, and a generally cylindrical outer surface 1012 extending between ends 1004 and 1006. In this embodiment, housing 1002 comprises a plurality of sections releasably coupled together via threaded couplers 214, including an upper section 1002A, intermediate sections 1002B-1002H, and a lower section 1002I. The connections formed between each section 1002A-1002I of housing 1002 is sealed via one or more annular seals, including an annular seal 1013 positioned between intermediate sections 1002B and 1002C of housing 1002, an annular seal 1014 positioned between intermediate sections 1002C and 1002D, an annular seal 1050 positioned between intermediate sections 1002G and 1002H, and an annular seal 1052 positioned between intermediate section 1002H and lower section 1002I.

In this embodiment, housing 1002 includes a first plurality of circumferentially spaced slots 1016, and a second plurality of circumferentially spaced slots 1024, where intermediate slots 1016 are axially positioned between slots 630 and 1024. Slots 1016 are disposed axially proximal to, but circumferentially spaced from, slots 1024, where each slot 1016 receives a radially translatable member or key 1020. Keys 1020 are similar to intermediate keys 244 of obturating tool 200 except that each key 1020 includes an arcuate slot 1022 extending into a lower end thereof. In this embodiment, similar to slots 630, slots 1016 each comprise a cylindrical bore against which seals 246 of keys 1020 may sealingly engage. Slots 1024 of housing 1002 each receive a radially translatable member or bore sensor 1026. In this embodiment, slots 1024 each comprise a cylindrical bore against which seals 252 of bore sensors 1026 may sealingly engage. As will be described further herein, the radially outer end of each key 1020 has a smaller radius from the central axis of obturating tool 1000 than the radially outer end of each compound key 640. Particularly, in this embodiment, the length extending between the radially inner and outer ends of each key 1020 is less than the length extending between the radially inner and outer ends of compound keys 640.

Bore sensors 1026 are similar to the bore sensors 250 of obturating tool 200 except that each bore sensor 1026 includes a slot 1028 extending into a lower end thereof. In this embodiment, an annular extension 1030 is positioned adjacent an upper end 1025 of intermediate section 1002E of housing 1002, where an upper end of extension 1030 forms an axially extending first or upper lip 1032 that extends into the slot 1022 of each key 1020 for retaining keys 1020 to housing 1002 while also permitting relative radial movement between keys 1020 and housing 1002. In this embodiment, extension 1030 is not threadably connected to housing 1002, and instead, is trapped between the upper end 1025 of the intermediate section 1002E of housing 1002 and slots 1022 of keys 1020. Extension 1030 additionally includes a plurality of circumferentially spaced slots 1034 extending axially into extension 1030 from the upper end thereof, where each slot 1034 receives a bore sensor 1026. The upper end 1025 of the intermediate section 1002E of housing 1002 extends into slots 1034 of extension 1030 and is received in the slot 1028 of each bore sensor 1026, thereby retaining bore sensors 1026 to housing 1002 while also permitting relative radial movement between bore sensors 1026 and housing 1002. Further, extension 1030 includes a radially inwards extending shoulder 1035, where shoulder 1035 and a shoulder 1037 formed near the upper end of intermediate section 1002E of housing 1002 are configured to engage C-ring 336 when bore sensors 1026 are in their radially outer positions to restrict relative axial movement between core 1100 and housing 1002.

Intermediate section 1002E of housing 1002 includes a radially outwards extending flange 1036 that is positioned axially between intermediate sections 1002D and 1002F. A first annular seal 1038 is positioned between intermediate sections 1002D and 1002E to seal the connection formed therebetween while a second annular seal 1038 is positioned between intermediate sections 1002E and 1002F to seal the connection formed therebetween. In this embodiment, the outer surface 1012 of housing 1002 includes a first or upper annular groove 1040A positioned between intermediate section 1002D and flange 1036 of intermediate section 1002E and a second or lower annular groove 1040B positioned between flange 1036 and intermediate section 1002F. Each groove 1040A and 1040B receives an annular seal assembly comprising an annular elastomeric seal 1042 and an annular, metallic piston ring 1044. Each elastomeric seal 1042 has an L-shaped cross-sectional profile and sealingly engages its corresponding piston ring 1044. The seal assemblies comprising seals 1042 and 1044 are configured to sealingly engage the seal bore of a sliding sleeve valve, such as the seal bore 28 of sliding sleeve valves 10, 750, 800, 850, 900, and 950. While in this embodiment housing 1002 of obturating tool 1000 is shown as including the seal assemblies comprising seals 1042 and 1044, in other embodiments, housing 1002 may include other means for sealing against the seal bore of the sliding sleeve valve in which it is disposed. In this embodiment, a cylindrical sleeve 1046 is positioned about the outer surface 1012 of the intermediate section 1002G of housing 1002, where sleeve 1046 is configured to apply an axial force against lower filter 262 to thereby compress lower filter 262.

In this embodiment, an axially extending stem 1054 is coupled to lower section 1002I of housing 1002 at lower end 1006. Stem 1054 includes a pair of annular fins 1056 extending radially outwards therefrom for assisting in the transportation of obturating tool 1000 through wellbore 3. Particularly, fins 1056 each comprise a flexible material (e.g., an elastomeric material) and have an outer diameter that is larger than a maximum outer diameter of housing 1002. As obturating tool 1000 is pumped downwards through wellbore 3, fins 1056 contact or sealingly engage the inner surface of well string 4, thereby inhibiting fluid flow around obturating tool 1000. In this manner, the amount of fluid required to pump obturating tool 1000 through wellbore 3 by eliminating or reducing the amount of fluid that flows past obturating tool 1000 as obturating tool 1000 is transported through wellbore 3.

Core 1100 of obturating tool 1000 is disposed coaxially with the longitudinal axis of housing 1002 and includes a first or upper end 1102, second or a lower end 1104, and a generally cylindrical outer surface 1106 extending between ends 1102 and 1104. In this embodiment, core 1100 comprises a first or upper segment 1100A and a second or lower segment 1100B, where segments 1100A and 1100B are releasably connected at shearable coupling 312. Each segment 1100A and 1100B of core 1100 may comprise multiple segments releasably coupled together or unitary members. In this embodiment, a plurality of circumferentially spaced ports 1108 extend radially into core 1100 proximal a lower end of upper segment 1100A. Additionally, lower segment 1100B includes a central bore or passage 1110 extending between an upper end of lower segment 1100B and the lower end 1104 of core 1100, where passage 1110 is in fluid communication with ports 1108.

The lower end of upper segment 1100A includes an annular first or upper shoulder 1112, an annular second or lower shoulder 1114, and an annular seal 1116 located axially between shoulders 1112 and 1114 that sealingly engages an inner surface 1010F of the intermediate section 1002F of housing 1002. Additionally, a cylindrical pulsation damper 1118 is positioned in passage 1110 proximal to the lower end of core 1100, where pulsation damper 1118 is configured to provide a fluid restriction in passage 1110 to mitigate or prevent hydraulic shock or vibration. In some embodiments, pulsation damper 1118 may comprise a Visco Jet flow restrictor produced by The Lee Company of Westbrook, Conn.

In this embodiment, obturating tool 1000 additionally includes a first or upper floating piston 1130 and a second or lower floating piston 1140, where floating pistons 1130 and 1140 are each slidably disposed about the outer surface 1106 of core 1100 within the bore 1008 of housing 1002. Upper floating piston 1130 is generally cylindrical and includes an annular radially inner seal 1132 that sealingly engages an outer surface 1106A of the upper segment 1100A of core 1100 and an annular radially outer seal 1134 that sealingly engages an inner surface 1010B of the intermediate section 1002B of housing 1002. Upper floating piston 1130 is permitted to move axially relative to housing 1002 and core 1100 and is positioned generally in housing 1002 such that inner seal 1132 of upper floating piston 1130 seals against the portion of outer surface 1106A extending between the upper end 1102 of core 1100 and an upper end of upper groove 318. In this embodiment, the inner surface 1010B of intermediate section 1002B of housing 1002 includes a pair of axially spaced annular shoulders or grooves 1011. Grooves 1011 have a greater inner diameter than the portion of inner surface 1010B extending therebetween, permitting fluid to pass around outer seal 1134 in the event that upper floating piston 1130 is over or under stroked relative to housing 1002, and thereby becomes disposed in an axial position aligned with one of the annular grooves 1011. Lower floating piston 1140 is also generally cylindrical and includes an annular radially inner seal 1142 that sealingly engages an outer surface 1106B of the lower segment 1100B of core 1100 and an annular radially outer seal 1144 that sealingly engages an inner surface 1010G of the intermediate section 1002G of housing 1002. Lower floating piston 1140 is permitted to move axially relative to housing 1002 and core 1100 and is positioned generally in intermediate segment 1002G of housing 1002, proximal to, but positioned axially above actuation assembly 1200.

In this embodiment, bore 1008 of housing 1002 is divided into a plurality of separate annular chambers 1060, 1062, 1064, 1066, and 1068, that are fluidically isolated or sealed from each other. Particularly, chamber 1060 comprises an upper chamber 1060 that is in fluid communication with the surrounding environment via port 220 of housing 1002 and is sealed from chamber 1062 via seals 1132 and 1134 of upper floating piston 1130. Chamber 1062 extends between seals 1132 and 1134 of upper floating piston 1130 and seal 1116 of core 1100, which isolates chamber 1062 from chamber 1064. Chamber 1064 is in fluid communication with the surrounding environment via port 264 of housing 1002 and extends between seal 1116 and seals 1142 and 1144 of lower floating piston 1140, which seal chamber 1064 from chamber 1066. Chamber 1066 comprises a first or upper actuation chamber 1066 of actuation assembly 1200 and extends between seals 1042 and 1044 of lower floating piston 1140 and seal 410 of actuation assembly 1200, where seal 410 seals against an inner surface 1010H of the intermediate section 1002H of housing 1002 to thereby seal upper actuation chamber 1066 from chamber 1068. Chamber 1068 comprises a second or lower actuation chamber 1068 of actuation assembly 1200 and extends between seal 410 and a lower end of bore 1008.

Upper chamber 1060 and chamber 1064 are each in fluid communication with the surrounding environment, whereas chambers 1062, 1066, and 1068 are each sealed from the surrounding environment. Particularly, when obturating tool 1000 is received within the seal bore 28 of a sliding sleeve valve (e.g., sliding sleeve valves 10, 750, 800, 850, 900, and 950) of well string 4, upper chamber 1060 is in fluid communication with the portion of the bore 4B of well string 4 disposed above seals 1042 and 1044 of housing 1002 while chamber 1064 is in fluid communication with the portion of bore 4B disposed below seals 1042 and 1044. Thus, when bore 4B of well string 4 is pressurized for hydraulically fracturing formation 6, upper chamber 1040 is exposed to the fracturing pressure applied to well string 4 whereas the surrounding environment in fluid communication with chamber 1064 is isolated from the fracturing pressure via seals 1042 and 1044 of housing 1002. Additionally, although upper chamber 1060 is sealed from chamber 1062, upper floating piston 1130 transmits or communicates the pressure within upper chamber 1060 to chamber 1062. Passage 1110 of core 1100 is in fluid communication with chamber 1062, and thus, pressure communicated to chamber 1062 from upper chamber 1060 is also communicated to passage 1110. Further, pressure may also be transmitted or communicated between chambers 1064 and 1066 via lower floating piston 1140.

Actuation assembly 1200 controls the actuation or displacement of core 1100 of the obturating tool 1000. In this embodiment, actuation assembly 1200 generally includes a cylindrical valve lock or body 1202, the first pair of valve assemblies 440A and 440B, and valve assembly 510A. Thus, unlike the actuation assembly 400 of obturating tool 200, actuation assembly 1200 does not include valve assembly 510B. Additionally, also unlike obturating tool 200, which includes rotatable indexer 360, obturating tool 1000 does not include an indexer. Valve body 1202 of actuation assembly 1200 includes a first or upper end 1204, a second or lower end 1206, and a generally cylindrical outer surface 1208 extending between ends 1204 and 1206 and having seal 410 disposed therein.

Actuation assembly 1200 also includes a cylindrical first spring retainer 1250 comprising a passage 1252 that receives the extension rod 522 of valve assembly 510A. Passage 1252 of first spring retainer 1250 receives a biasing member 1254 that engages the ball connector 524 of the extension rod 514 of valve assembly 510A, biasing plug 512 of valve assembly 510A towards the sealing surface 420S of third valve bore 420 formed in valve body 1202. The biasing member 522 of valve assembly 510A is also received in the passage 1252 of first spring retainer 1250, extending between an upper end of passage 1252 and ball connector 524. In this arrangement, biasing member 522 may cushion the impact of plug 512 during the actuation of valve assembly 510A. In this embodiment, actuation assembly 1200 also includes a second spring retainer 1260 that houses biasing member 542.

Referring to FIGS. 1, 47, 48, 52A-63, having described the structural features of the embodiment of obturating tool 1000, the operation of obturating tool 1000 will now be described herein. Particularly, the operation of sliding sleeve valve 850 shown in FIGS. 47, 48, and obturating tool 1000 shown in FIGS. 52A-63 are described herein; however, the operation of sliding sleeve valves 800, 900, and 950 is similar to the operation of sliding sleeve valve 850 described below. FIGS. 52A-63 illustrate obturating tool 1000 in the run-in position as obturating tool 1000 is pumped through the wellbore 3 shown in FIG. 1. In the run-in position, compound keys 230, intermediate keys 244, and bore sensors 250 are each in a radially outer position. Additionally, the pair of first valve assemblies 440A and 440B of actuation assembly 1200 are both in a closed position while the second valve assembly 510A is in an open position. In this arrangement, fluid flow from upper actuation chamber 1066 to lower actuation chamber 1068 is permitted via bypass passage 437 while fluid flow from lower actuation chamber 1068 to upper actuation chamber 1066 is restricted by check valve 439. Thus, when obturating tool 1000 is in the run-in position, in addition to interfering contact between shoulder 1035 and C-ring 336, hydraulic lock within lower actuation chamber 1068 also prevents core 1100 from travelling downwards through bore 1008 of housing 1002.

As obturating tool 1000 is pumped through bore 4B of well string 4, obturating tool 1000 will enter the bore 854 of an uppermost sliding sleeve valve 850 of the well system 1. As obturating tool 1000 enters bore 854, keys 1020 (disposed in radially outer or locked positions) are permitted to pass through the upper shoulder 62 of carrier member 870, whereas the upper shoulder 642 of each compound key 640 (disposed in a radially outer or locked position) subsequently engages the upper shoulder 62 of the carrier member 870 while lower shoulder 644 is permitted to pass through upper shoulder 62, via retracting within its associated slot, so as to engage lower shoulder 64 of carrier member 870 and thereby lock carrier member 870 with housing 1002 of obturating tool 1000.

With housing 1002 of obturating tool 1000 is axially locked to carrier member 870, obturating tool 1000 continues to travel axially through bore 854 of sliding sleeve valve 850, thereby forcibly displacing or dragging carrier member 870 axially through bore 854. Particularly, the pressure force pumping obturating tool 1000 through the bore 4B of well string 4 elastically deforms locating 862 into the radially expanded position, thereby permitting carrier member 870 to move axially relative to housing 852 of sliding sleeve valve 850. Carrier member 870 and obturating tool 1000 then travel axially through bore 854 of sliding sleeve valve 850 until keys 1020 physically engage the intermediate shoulder 30 of housing 852, thereby arresting the downward axial motion of both obturating tool 1000 and carrier member 870 through bore 854. Once keys 1020 (disposed in radially outer or locked positions) have contacted intermediate shoulder 30, arresting the downward travel of carrier member 870 and obturating tool 1000, sliding sleeve valve 850 is fully actuated from the upper-closed position to the open position. In this position, seals 1042 and 1044 of obturating tool 1000 sealingly engage the seal bore 28 of housing 852, preventing fluid flow between the upper and lower ends of housing 852 through bore 854. Additionally, in this position, bore sensors 1026 have also entered seal bore 28, forcing bore sensors 1026 and C-ring 336 into their respective radially inwards positions.

In this embodiment, following the actuation of sliding sleeve valve 850 to the open position, hydraulic pressure in the portion of bore 4B of well string 4 located above obturating tool 1000 may be increased to hydraulically fracture the area of subterranean formation 6 disposed adjacent sliding sleeve valve 850. Hydraulic lock formed in lower actuation chamber 1068 restricts core 1100 from travelling downwards through bore 1008 of housing 1002. Thus, obturating tool 1000 is configured to actuate sliding sleeve valve 850 from the upper-closed position to the open position with core 1100 disposed in a first or initial position in housing 1002. Additionally, the increased pressure in bore 4B during hydraulic fracturing is communicated to core passage 432 and the upper chamber 444 of each valve assembly 440A and 440B via sixth radial passage 438 formed in valve body 1202. Increased pressure in each upper chamber 444 displaces the piston 462 of each valve assembly 440A and 440B downwards, thereby axially spacing the flapper 484 of each valve assembly 440A and 440B from its corresponding stem 494. In some embodiments, the increased pressure used to displace the piston 462 of each valve assembly 440A and 440B downwards may be created by controlling the rate of fluid flow into the bore 4B of well string 4. For instance, the passages 104 of the planar members 100 of the sliding sleeve valve 850 may be sized to create a fluid flow restriction therethrough that results in increased pressure in the portion of the bore 4B of well string 4 extending above obturating tool 1000. Thus, actuation of obturating tool 1000 may be controlled by controlling either fluid pressure or fluid flow rate in the bore 4B of well string 4.

Once the portion of subterranean formation 6 disposed adjacent sliding sleeve valve 850 is sufficiently fractured, obturating tool 1000 may be operated to actuate sliding sleeve valve 850 from the open position to the lower-closed position. Particularly, fluid pressure in the portion of bore 4B of well string 4 located above obturating tool 1000 may be reduced, with the reduction in fluid pressure being communicated to the upper chamber 444 of each valve assembly 440A and 440B via core passage 432 and sixth radial passage 438 formed in valve body 1202. The reduction in fluid pressure in upper chamber 444 reduces, in-turn, the pressure force acting against shoulder 470 of the piston 462 of each valve assembly 440A and 440B, causing the biasing member 454 of each valve assembly 440A and 440B to axially displace each piston 462 axially towards its respective check valve assembly 490. In this embodiment, the stem 494 of valve assembly 440A is greater in axial length than the stem 494 of valve assembly 440B, and thus, flapper 484 of valve assembly 440A contacts its corresponding stem 494 before the flapper 484 of valve assembly 440B may contact its corresponding stem 494. In this configuration, reduction in fluid pressure in the upper chamber 444 of valve assembly 440A causes flapper 484 to engage stem 494 and axially displace obturating member 496 out of sealing contact with first radial passage 416. With obturating member 496 of valve assembly 440A out of sealing contact with first radial passage 416, fluid previously trapped in lower actuation chamber 1068 is permitted to flow into upper actuation chamber 1066. Thus, valve assembly 440A actuates in response to actuation assembly 1200 sensing a predetermined first pressure differential between the upper and lower ends of obturating tool 1000.

With fluid communication reestablished between actuation chambers 1066 and 1068, core 1100 is permitted to travel axially downwards through bore 1008 of housing 1002 until plug 512 of valve assembly 510A seals against the sealing surface 420S of third valve bore 420, thereby restricting fluid flow from lower actuation chamber 1068 to upper actuation chamber 1066 and reestablishing hydraulic lock in lower actuation chamber 1068. Particularly, the pressure applied to the upper end 1102 of core 1100 produces an axially downwards directed force against core 1100, where the amount of force applied to core 1100 is determined by the amount of pressure applied to upper end 1102 and the diameter of annular seal 1114. In this embodiment, the diameter of annular seal 1114 is greater than the diameter of the annular seal 338 of the core 300 of obturating tool 200, and thus, seal 1114 is configured to result in a greater amount of axial force being applied against core 1100 relative to core 300 of obturating tool 200 when the upper end 1102 of core 1100 is exposed to the same pressure as the upper end 302 of core 300. The additional axial force applied against core 1100 may assist with overcoming resistive frictional forces that result from axial movement of core 1100 through housing 1002, such as frictional forces between compound keys 640 and slots 630, keys 1020 and slots 1016, and bore sensors 1026 and slots 1024.

Following the downward displacement of core 1100 through bore 1008 of housing 100, keys 1020 are permitted to actuate into a radially inwards or unlocked positions received in intermediate groove 324 of core 1100, thereby unlocking obturating tool 1000 from the housing 852 of sliding sleeve valve 850. With obturating tool 1000 unlocked from housing 852, the remaining pressure differential across seals 1042 and 1044 of housing 1002 displaces obturating tool 1000 and carrier member 870 (locked to housing 1002 by compound keys 640) downwards through bore 854 of housing 852 until the lower end of carrier member 870 engages intermediate shoulder 30 of housing 852, disposing sliding sleeve valve 850 in the lower-closed position. Thus, obturating tool 1000 is configured to actuate sliding sleeve valve 850 from the open position to the lower-closed position in response to the core 1100 being disposed in a first axial direction from the first position in housing 1002 to a second position in housing 1002 that is axially spaced from the first position.

Once sliding sleeve valve 850 is disposed in the lower-closed position, obturating tool 1000 may be released from sliding sleeve valve 850 such that obturating tool 1000 may be flow transported downhole through bore 4B of well string 4 to the next sliding sleeve valve 850 of well string 4. In this embodiment, to release obturating tool 1000 from the carrier member 870 of sliding sleeve valve 850, hydraulic pressure acting against the upper end 1102 of core 1100 is further reduced to axially transport core 1100 farther downwards through bore 1008 of housing 102. Particularly, the additional reduction in hydraulic pressure is communicated to upper chamber 444 of valve assembly 440B, permitting the biasing member 454 of valve assembly 440B to displace piston 462 axially upwards such that flapper 484 engages stem 494 and displaces obturating member 496 out of sealing engagement with second radial passage 418. Thus, valve assembly 440B actuates in response to actuation assembly 1200 sensing a predetermined second pressure differential between the upper and lower ends of obturating tool 1000, where the second pressure differential is less than the first pressure differential that triggers the actuation of valve assembly 440A.

With valve assembly 440B now in the open position, fluid previously trapped in lower actuation chamber 1068 may be communicated to upper actuation chamber 1068 via bypass passage 437, sixth radial passage 443, second valve bore 414, and second radial passage 418 formed in valve body 1202. Following the opening of valve assembly 440B, core 1100 is permitted to travel axially downwards through bore 1008 of housing 1002 until compound keys 640 are permitted to actuate into radially inwards or unlocked positions received in upper groove 318 of core 1100. In this position, compound keys 640 may pass through seal bore 28 of the housing 852 of sliding sleeve valve 850, thereby allowing obturating tool 1000 to pass completely through the bore 854 of housing 852 as obturating tool 1000 flows towards the next sliding sleeve valve 850 of well string 4. Once obturating tool 1000 is released from sliding sleeve valve 850, fluid disposed in upper actuation chamber 1066 is permitted to return to lower actuation chamber 1068 via bypass passage 437 as core 1100 returns to its original position shown in FIGS. 52A-63.

It should be understood by those skilled in the art that the disclosure herein is by way of example only, and even though specific examples are drawn and described, many variations, modifications and changes are possible without limiting the scope, intent or spirit of the claims listed below.

What is claimed is:

1. A flow transported obturating tool for actuating a valve in a wellbore, comprising:

a housing comprising a radially translatable engagement assembly;

a core slidably disposed in the housing;

an actuation assembly disposed in the housing and configured to permit the core to displace from a first position to a second position that is spaced from the first position in a first axial direction in response to sensing a predetermined pressure differential between first and second ends of the obturating tool; and a floating piston slidably disposed between the core and the housing;

wherein the floating piston forms a first chamber in the housing in fluid communication with the surrounding environment and a second chamber in the housing sealed from the surrounding environment, and wherein the actuation assembly is disposed in the second chamber, and wherein the floating piston is configured to equalize fluid pressure between the first chamber and the second chamber wherein the engagement assembly is configured to shift the valve from a first closed position to an open position when the core is in the first position relative to the housing;

wherein the engagement assembly is configured to shift the valve from the open position to a second closed position in response to the core being displaced from the first position to the second position.

2. The obturating tool of claim 1, wherein the engagement assembly comprises a first engagement member comprising an unlocked position and a locked position, and a second engagement member, axially spaced from the first engagement member, comprising an unlocked position and a locked position.

3. The obturating tool of claim 2, wherein:

the first engagement member is disposed in a receptacle formed in the housing and comprises an arcuate slot that receives a lip of the housing to prevent the first engagement member from escaping the receptacle; and engagement between the lip of the housing and the arcuate slot of the first engagement member prevents the first engagement member from rotating in the receptacle of the housing.

4. The obturating tool of claim 2, wherein the first engagement member comprises a compound key that comprises a first shoulder and a second shoulder that is radially translatable relative to the first shoulder.

5. The obturating tool of claim 1, further comprising:

a filter coupled to the housing and configured to permit fluid communication between the housing and the surrounding environment;

wherein the filter comprises a plurality of stacked washers, wherein a first end of each washer includes a notch providing an axially extending gap between each washer.

6. A flow transported obturating tool for actuating a valve in a wellbore, comprising:

a housing comprising a first engagement member comprising an unlocked position and a locked position, and a second engagement member, axially spaced from the first engagement member, comprising an unlocked position and a locked position; and a core slidably disposed in the housing;

wherein, when the first engagement member is in the locked position, the first engagement member is configured to shift the valve from an open position to a closed position;

wherein, when the second engagement member is in the locked position, the second engagement member is configured to land against a landing shoulder of the valve to prevent the obturating tool from passing through the valve;

wherein the core is configured to actuate the first engagement member from the locked position to the unlocked position in response to displacing the core relative to the housing in a first axial direction between a first position and a second position;

wherein the core is configured to actuate the second engagement member from the locked position to the unlocked position in response to displacing the core relative to the housing in the first axial direction between the second position and a third position.

7. The obturating tool of claim 6, wherein:

the first engagement member is slidably received in a receptacle formed in the housing; and the first engagement member comprises an annular seal disposed on an outer surface of the first engagement member, and wherein the annular seal sealingly engages an inner surface of the receptacle to restrict fluid flow through the receptacle.

8. The obturating tool of claim 6, wherein:

the first engagement member comprises a compound key that comprises a first shoulder and a second shoulder that is radially translatable relative to the first shoulder; and the compound key further comprises a biasing member that biases the second shoulder into a radially outer position.

9. The obturating tool of claim 6, further comprising an annular seal assembly disposed in a groove formed in the housing, wherein the seal assembly comprises a metallic piston ring and an annular elastomeric seal having an L-shaped cross-sectional profile.

10. The obturating tool of claim 6, further comprising an actuation assembly disposed in the housing and configured to permit the core to displace from the first position to the second position in response to sensing a predetermined pressure differential between first and second ends of the obturating tool.

11. The obturating tool of claim 10, wherein:

the actuation assembly comprises a valve body that includes a first passage configured to receive fluid pressure acting against the first end of the obturating tool; and the obturating tool further comprises a fluid damper positioned upstream of the first passage of the valve body in a passage formed in the core, and wherein the fluid damper is configured to provide to a flow restriction in the passage of the core.

12. A flow transported obturating tool for actuating a valve in a wellbore, comprising:

a housing comprising a first engagement member comprising an unlocked position and a locked position, and a second engagement member comprising an unlocked position and a locked position;

a core slidably disposed in the housing and configured to actuate the first engagement member from the locked position to the unlocked position in response to displacing the core from a first position to a second position in the housing; and an actuation assembly disposed in the housing and comprising a first valve assembly configured to permit the core to displace from the first position to the second position in response to sensing a first pressure differential between first and second ends of the obturating tool;

wherein the core is configured to actuate the second engagement member from the locked position to the unlocked position in response to displacing the core from the second position to a third position in the housing;

wherein the actuation assembly comprises a first valve assembly configured to permit the core to displace from the first position to the second position in response to sensing a second differential between the first and second ends of the obturating tool.

13. The obturating tool of claim 12, wherein the second pressure differential is less than the first pressure differential.

14. The obturating tool of claim 12, further comprising:

a floating piston slidably disposed between the core and the housing;

wherein the floating piston forms a first chamber in the housing in fluid communication with the surrounding environment and a second chamber in the housing sealed from the surrounding environment;

wherein the floating piston is configured to equalize fluid pressure between the first chamber and the second chamber.

15. The obturating tool of claim 12, further comprising:

a filter coupled to the housing and configured to permit fluid communication between the housing and the surrounding environment;

wherein the filter comprises a plurality of stacked washers, wherein a first end of each washer includes a notch providing an axially extending gap between each washer;

wherein the notch of each washer is configured to permit particulates of a predetermined size to enter the housing from the surrounding environment.

16. The obturating tool of claim 12, wherein both the first valve assembly and the second valve assembly of the actuation assembly comprise:

a housing;

a piston slidably received in the housing; and a check valve assembly received in a valve body of the actuation assembly;

wherein the valve body of the actuation assembly includes a first passage configured to receive fluid pressure acting against the first end of the obturating tool and a second passage configured to receive fluid pressure acting against the second end of the obturating tool.

17. A flow transported obturating tool for actuating a valve in a wellbore, comprising:

a housing comprising a radially translatable engagement assembly; and a core slidably disposed in the housing;

wherein the engagement assembly is configured to shift the valve from a first closed position to an open position when the core is in a first position relative to the housing;

wherein the engagement assembly is configured to shift the valve from the open position to a second closed position in response to the core being displaced from the first position to a second position that is spaced from the first position in a first axial direction wherein the engagement assembly comprises a first engagement member comprising an unlocked position and a locked position, and a second engagement member, axially spaced from the first engagement member, comprising an unlocked position and a locked position;

wherein the engagement assembly comprises a first engagement member comprising an unlocked position and a locked position, and a second engagement member, axially spaced from the first engagement member, comprising an unlocked position and a locked position;

wherein the first engagement member is disposed in a receptacle formed in the housing and comprises an arcuate slot that receives a lip of the housing to prevent the first engagement member from escaping the receptacle, and wherein engagement between the lip of the housing and the arcuate slot of the first engagement member prevents the first engagement member from rotating in the receptacle of the housing.

18. The obturating tool of claim 17, wherein the first engagement member comprises a compound key that comprises a first shoulder and a second shoulder that is radially translatable relative to the first shoulder.

19. The obturating tool of claim 17, further comprising:

an actuation assembly disposed in the housing and configured to permit the core to displace from the first position to the second position in response to sensing a predetermined pressure differential between first and second ends of the obturating tool; and a floating piston slidably disposed between the core and the housing;

wherein the floating piston forms a first chamber in the housing in fluid communication with the surrounding environment and a second chamber in the housing sealed from the surrounding environment, and wherein the actuation assembly is disposed in the second chamber;

wherein the floating piston is configured to equalize fluid pressure between the first chamber and the second chamber.

20. The obturating tool of claim 17, further comprising:

a filter coupled to the housing and configured to permit fluid communication between the housing and the surrounding environment;

wherein the filter comprises a plurality of stacked washers, wherein a first end of each washer includes a notch providing an axially extending gap between each washer.

21. A flow transported obturating tool for actuating a valve in a wellbore, comprising:

a housing comprising a radially translatable engagement assembly; and a core slidably disposed in the housing;

wherein the engagement assembly is configured to shift the valve from a first closed position to an open position when the core is in a first position relative to the housing;

wherein the engagement assembly is configured to shift the valve from the open position to a second closed position in response to the core being displaced from the first position to a second position that is spaced from the first position in a first axial direction wherein the engagement assembly comprises a first engagement member comprising an unlocked position and a locked position, and a second engagement member, axially spaced from the first engagement member, comprising an unlocked position and a locked position;

wherein the engagement assembly comprises a first engagement member comprising an unlocked position and a locked position, and a second engagement member, axially spaced from the first engagement member, comprising an unlocked position and a locked position;

wherein the first engagement member comprises a compound key that comprises a first shoulder and a second shoulder that is radially translatable relative to the first shoulder.

22. The obturating tool of claim 21, wherein:

the first engagement member is disposed in a receptacle formed in the housing and comprises an arcuate slot that receives a lip of the housing to prevent the first engagement member from escaping the receptacle; and engagement between the lip of the housing and the arcuate slot of the first engagement member prevents the first engagement member from rotating in the receptacle of the housing.

23. The obturating tool of claim 21, further comprising:

an actuation assembly disposed in the housing and configured to permit the core to displace from the first position to the second position in response to sensing a predetermined pressure differential between first and second ends of the obturating tool; and a floating piston slidably disposed between the core and the housing;

wherein the floating piston forms a first chamber in the housing in fluid communication with the surrounding environment and a second chamber in the housing sealed from the surrounding environment, and wherein the actuation assembly is disposed in the second chamber;

wherein the floating piston is configured to equalize fluid pressure between the first chamber and the second chamber.

24. The obturating tool of claim 21, further comprising:

a filter coupled to the housing and configured to permit fluid communication between the housing and the surrounding environment;

wherein the filter comprises a plurality of stacked washers, wherein a first end of each washer includes a notch providing an axially extending gap between each washer.

* * * * *